US012349747B1

(12) United States Patent
Ledford

(10) Patent No.: US 12,349,747 B1
(45) Date of Patent: Jul. 8, 2025

(54) HAND SHIELD AND DISPENSER

(71) Applicant: Henry Franklin Ledford, Greensboro, NC (US)

(72) Inventor: Henry Franklin Ledford, Greensboro, NC (US)

( * ) Notice: Subject to any disclaimer, the term of this patent is extended or adjusted under 35 U.S.C. 154(b) by 142 days.

(21) Appl. No.: 15/708,744

(22) Filed: Sep. 19, 2017

Related U.S. Application Data

(60) Provisional application No. 62/396,942, filed on Sep. 20, 2016.

(51) Int. Cl.
*A41D 19/015* (2006.01)

(52) U.S. Cl.
CPC ..... *A41D 19/015* (2013.01)

(58) Field of Classification Search
CPC ..... A41D 19/0068; A41D 19/0075; A41D 19/0003; A41D 19/015; A41D 19/003; A41D 19/0044; A41D 19/0072; A41D 19/01; A41D 19/0048
USPC ..... 2/907, 158, 159, 161.6, 161.7, 163, 167, 2/169
See application file for complete search history.

(56) References Cited

U.S. PATENT DOCUMENTS 2,773,264 A 12/1956 Nover ..... 2/159
4,916,757 A * 4/1990 Berlin ..... A41D 19/0068 2/159
5,020,160 A 6/1991 Cano ..... 2/159
5,025,503 A * 6/1991 O'Brien ..... A41D 19/0068 2/163
5,987,645 A 11/1999 Teaster ..... 2/159
6,637,035 B1 10/2003 Brinkmann et al. ..... 2/161.6
9,710,826 B1 7/2017 Daniel ..... 30/257
2004/0221367 A1* 11/2004 Darrow ..... A41D 19/0075 2/167
2006/0010563 A1 1/2006 Michel et al. ..... 2/159
2006/0200891 A1 9/2006 Geraci ..... 2/158
2010/0083453 A1 4/2010 Abbas ..... 15/210.1
2012/0311767 A1* 12/2012 Mizrahi ..... A41D 19/0072 2/158

FOREIGN PATENT DOCUMENTS

JP 102726857 10/2012 ..... 19/15

* cited by examiner

*Primary Examiner* — Sally Haden
(74) *Attorney, Agent, or Firm* — MacCord Mason PLLC

(57) ABSTRACT

A same-hand, hand shield formed of a flexible material. The same-hand, hand shield includes an opening adapted for receiving at least a portion of the hand and substantially parallel sides adapted for same-hand removal, whereby the hand shield may be donned and removed with the same hand without requiring an opposing hand. In one embodiment, the same-hand, hand shield includes a partial palm portion adapted for same-hand donning. The partial palm portion may include a palm flap adapted to cover a palm face of a user's hand and a back flap adapted to cover a back face of a user's hand. The present inventions may also include a same-hand dispenser adapted for same-hand donning of the hand shield.

9 Claims, 64 Drawing Sheets

HAND SHIELD AND DISPENSER

BACKGROUND OF THE INVENTIONS

(1) Field

The present invention relates generally to hand shields, and more particularly, to hand shields and dispensers adapted for same-hand donning and removal.

(2) Related Art

Hand shields are used in many situations to protect individuals from various hazards, including chemicals and germs, and are also effective in preventing contamination while handling certain items. While the benefits of using hand shields are well-known, there remains a lack of widespread use in many situations where one is preferred. For instance, hand shields may be a convenient option while dining to reduce paper waste associated with repeated napkin use.

Notably, recent studies have identified gas pump handles as one of the filthiest surfaces that Americans encounter in their everyday lives. Viruses and bacteria are prevalent in various items that are handled on a daily basis, including stair rails, vending machines, door handles, ATMs, checkout kiosks, etc. Yet, these publicly accessible machines are routinely operated without any type of hand shield.

The expense and lack of convenience of donning a hand shield are major reasons that prevent their widespread implementation. For example, dispensers oftentimes requires separating a single hand shield from a plurality stored in a container, wasting valuable time and nullifying the sanitary condition of the hand shields. Removing the hand shields from these dispensers typically requires both hands, contaminating the container and untaken shields while also contaminating the user from the contaminants left by the previous user having gone through the same process.

Once the hand shield is removed from the dispenser, it can be cumbersome to don the hand shield because of various factors, such as the overall fit and the material clinging to itself. The hand shield oftentimes remains cumbrous during use, since the hand shield may be shaped as a generic glove and not particularly well-designed for the specific task at hand. Moreover, removing the hand shield can be unnecessarily laborious and typically requires both hands, thereby causing contamination of the unshielded hand's fingers by being used to remove the now contaminated shield.

Thus, there remains a need for providing a dispenser and hand shield that can be easily donned and removed, while at the same time, remain inexpensive and convenient during use.

SUMMARY OF THE INVENTIONS

The present inventions are directed to a same-hand, hand shield formed of a flexible material and a same-hand dispenser adapted for single hand donning. The single hand donning design of both the shield and dispenser eliminates contamination from having to use unshielded hands to separate and remove a sanitary shield from a container having a plurality of shields.

The same-hand, hand shield includes an opening adapted for receiving at least a portion of the hand and substantially parallel sides adapted for same-hand removal, whereby the hand shield may be donned and removed with the same hand without requiring an opposing hand. In one embodiment, the same-hand, hand shield includes a partial palm portion adapted for same-hand donning. The partial palm portion may include a palm flap adapted to cover a palm face of a user's hand and a back flap adapted to cover a back face of a user's hand. The present inventions may also include a same-hand dispenser adapted for same-hand donning of the hand shield.

The hand shield may be comprised of two pieces. The two pieces can then be joined together to form the hand shield. In one embodiment, the two pieces are thermally joined together to form the hand shield.

The same-hand, hand shield may further include texturing on the hand shield adapted to prevent clinging of the hand shield to a user's hand. The texturing may comprise an embossed pattern for increasing the tear resistance of the hand shield. In one embodiment, the embossing comprises dimpling.

In one embodiment, the angle formed by the opening and the sides of the same-hand, hand shield is between about 90 degrees and about 140 degrees and the partial palm portion is between about 0 percent and about 80 percent removed to provide ease of operation for same-hand donning and same-hand removal. In one embodiment, the sides are substantially parallel and the angle is 90 degrees. In one embodiment, the partial palm portion is between about 40 percent and about 70 percent removed. Preferably, the partial palm portion is about 50 percent removed.

In one embodiment, the palm flap is between about 50 percent and about 90 percent and the back flap is between about 75 percent and about 100 percent to provide a barrier when a hand-held implement is held by a user. The back flap may extend past the proximate edge of the palm flap.

In one embodiment, the palm flap is about 50 percent and the back flap is about 75 percent. Also, in one embodiment, the back flap proximate edge is co-extensive with the proximate edge of the palm flap to provide an ambidextrous hand shield.

The implement may be a stylus.

The same-hand dispenser may include a plurality of hand shields fastened together by a header. In one embodiment, the plurality of hand shields are perforated at the opening of each hand shield to facilitate dispensing and same-hand donning. Also, the same hand-dispenser may include at least one post to attach the header and hand shields to the dispenser.

The same-hand dispenser may further include a header card to cover a portion of the header and the hand shields. In one embodiment, the header card covers the header and at least one post. The same-hand dispenser also my further include an indicia panel on the header card adapted to display information to a user.

In one embodiment, the same-hand, hand shield further includes a thumb portion and a digit portion on the hand shield adapted to cover a portion of a user's hand. The digit portion may comprise two digits. In one embodiment, the digit portion may further include at least a third digit on the digit portion.

Accordingly, one aspect of the present inventions is to provide a same-hand, hand shield formed of a flexible material including (a) an opening adapted for receiving at least a portion of the hand; (b) substantially parallel sides adapted for same-hand removal; and (c) a partial palm portion adapted for same-hand donning, whereby the hand shield may be donned and removed with the same hand without requiring an opposing hand.

Another aspect of the present inventions is to provide a same-hand, hand shield formed of a flexible material including (a) an opening adapted for receiving at least a portion of the hand; (b) substantially parallel sides adapted for same-hand removal; and (c) a partial palm portion adapted for same-hand donning, the partial palm portion including (i) a palm flap adapted to cover a palm face of a user's hand and (ii) a back flap adapted to cover a back face of a user's hand, wherein the hand shield may be donned and removed with the same hand without requiring an opposing hand.

Still another aspect of the present inventions is to provide a same-hand, hand shield formed of a flexible material including (a) an opening adapted for receiving at least a portion of the hand; (b) substantially parallel sides adapted for same-hand removal; (c) a partial palm portion adapted for same-hand donning, the partial palm portion including (i) a palm flap adapted to cover a palm face of a user's hand and (ii) a back flap adapted to cover a back face of a user's hand; and (d) a same-hand dispenser adapted for same-hand donning of the hand shield, whereby the hand shield may be donned and removed with the same hand without requiring an opposing hand.

These and other aspects of the present invention will become apparent to those skilled in the art after a reading of the following description of the preferred embodiment when considered with the drawings.

DESCRIPTION OF THE EMBODIMENTS

Figure 1:
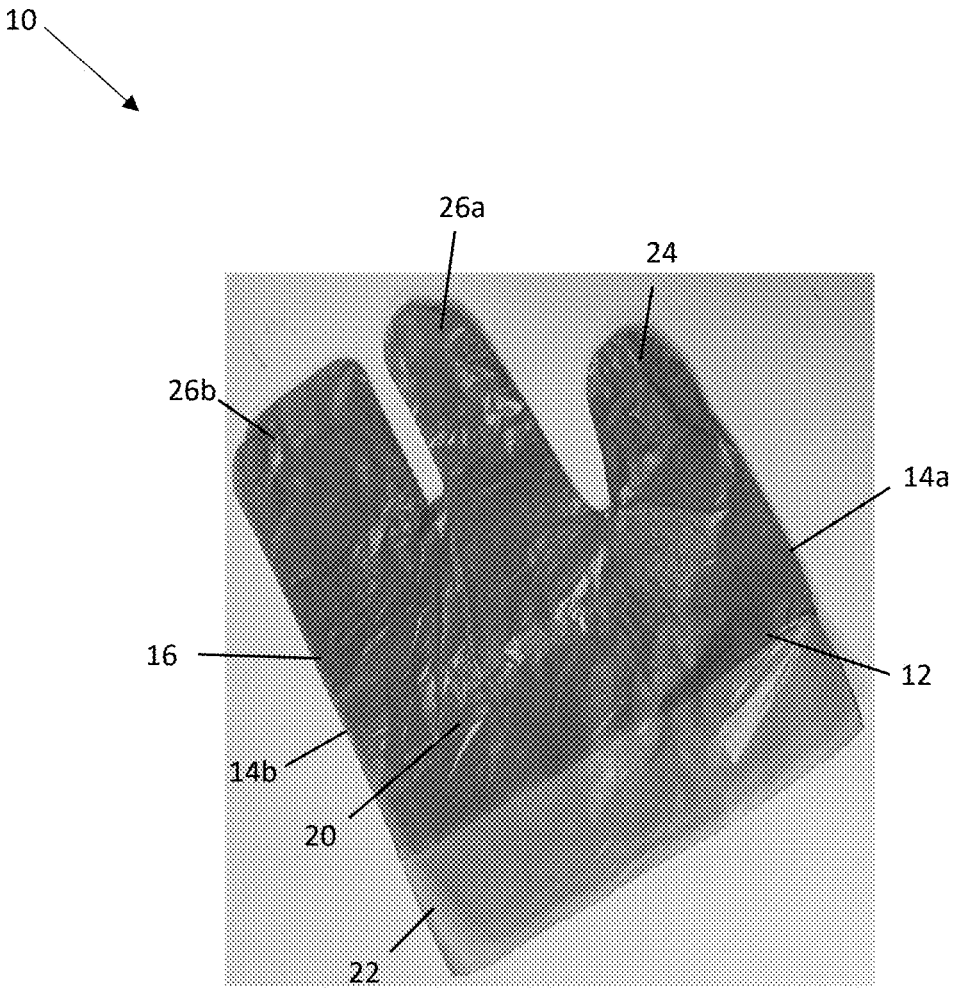
FIG. 1 is an overhead perspective view of an undonned same-hand, hand shield constructed according to one embodiment of the present inventions.
Figure 2:
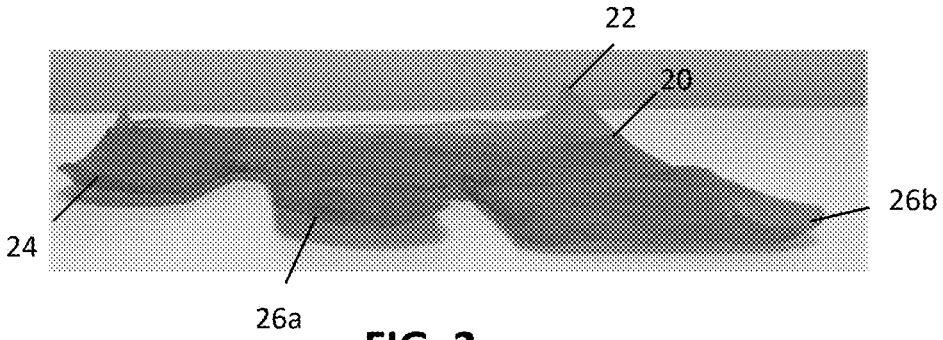
FIG. 2 is a front perspective view of the embodiment in FIG. 1.
Figure 3:
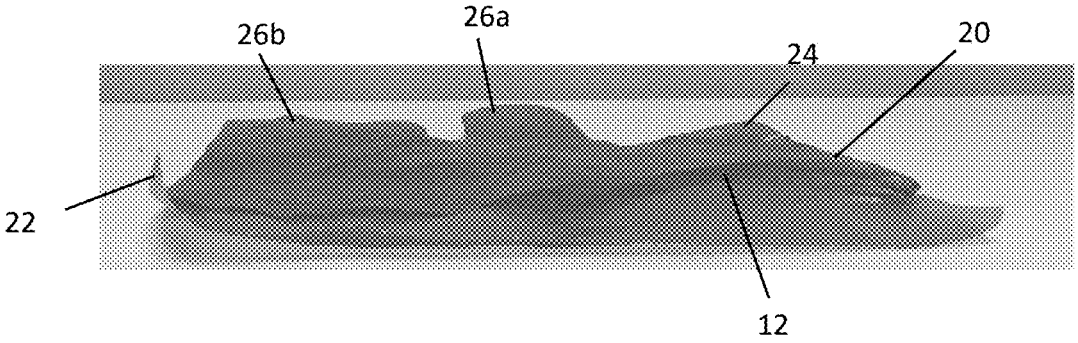
FIG. 3 is a back perspective view of the embodiment in FIG. 1.
Figure 4:
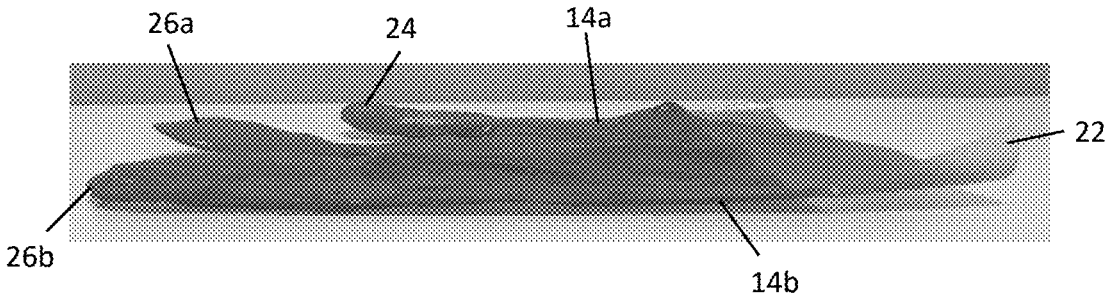
FIG. 4 is a left side perspective view of the embodiment in FIG. 1.
Figure 5:
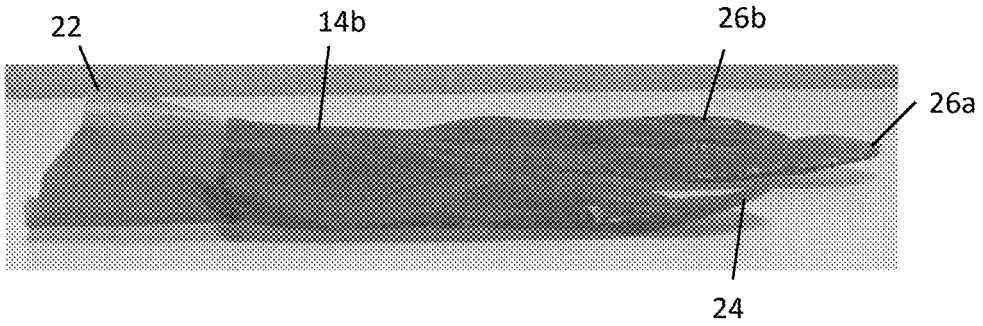
FIG. 5 is a right side perspective view of the embodiment in FIG. 1.
Figure 6:
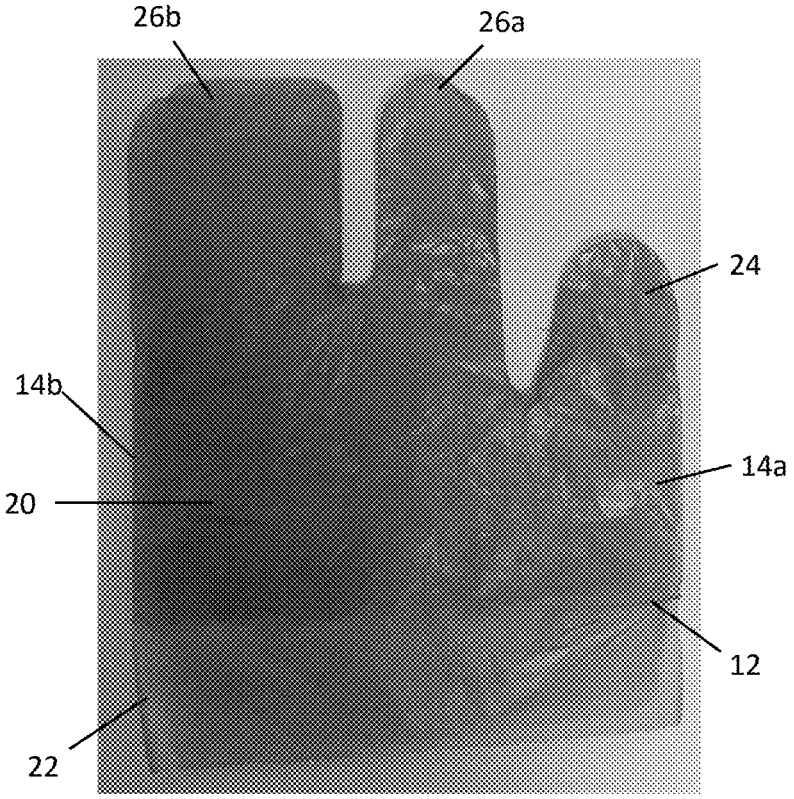
FIG. 6 is a top view of the embodiment in FIG. 1.
Figure 7:
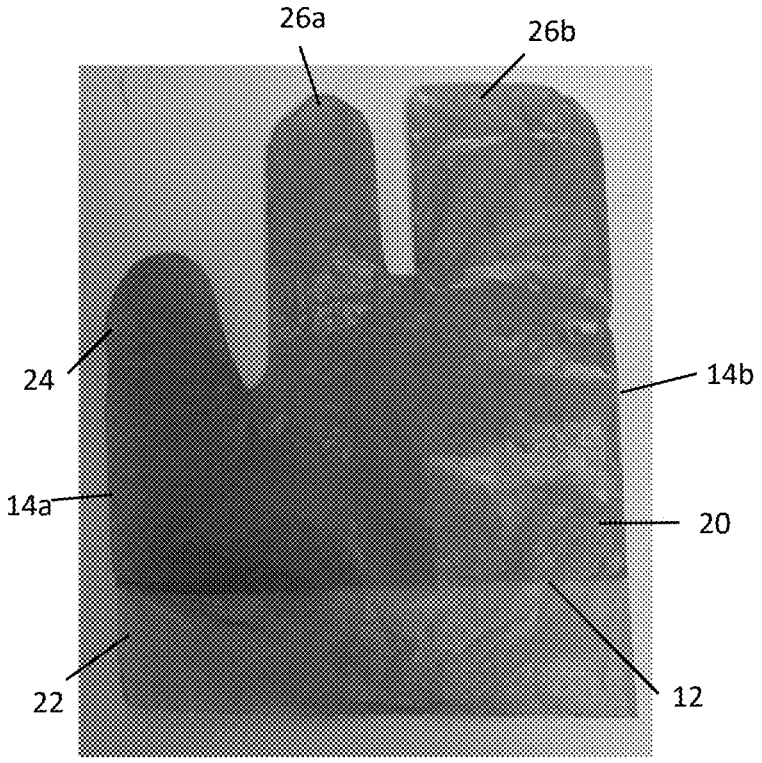
FIG. 7 is a bottom view of the embodiment in FIG. 1.
Figure 8:
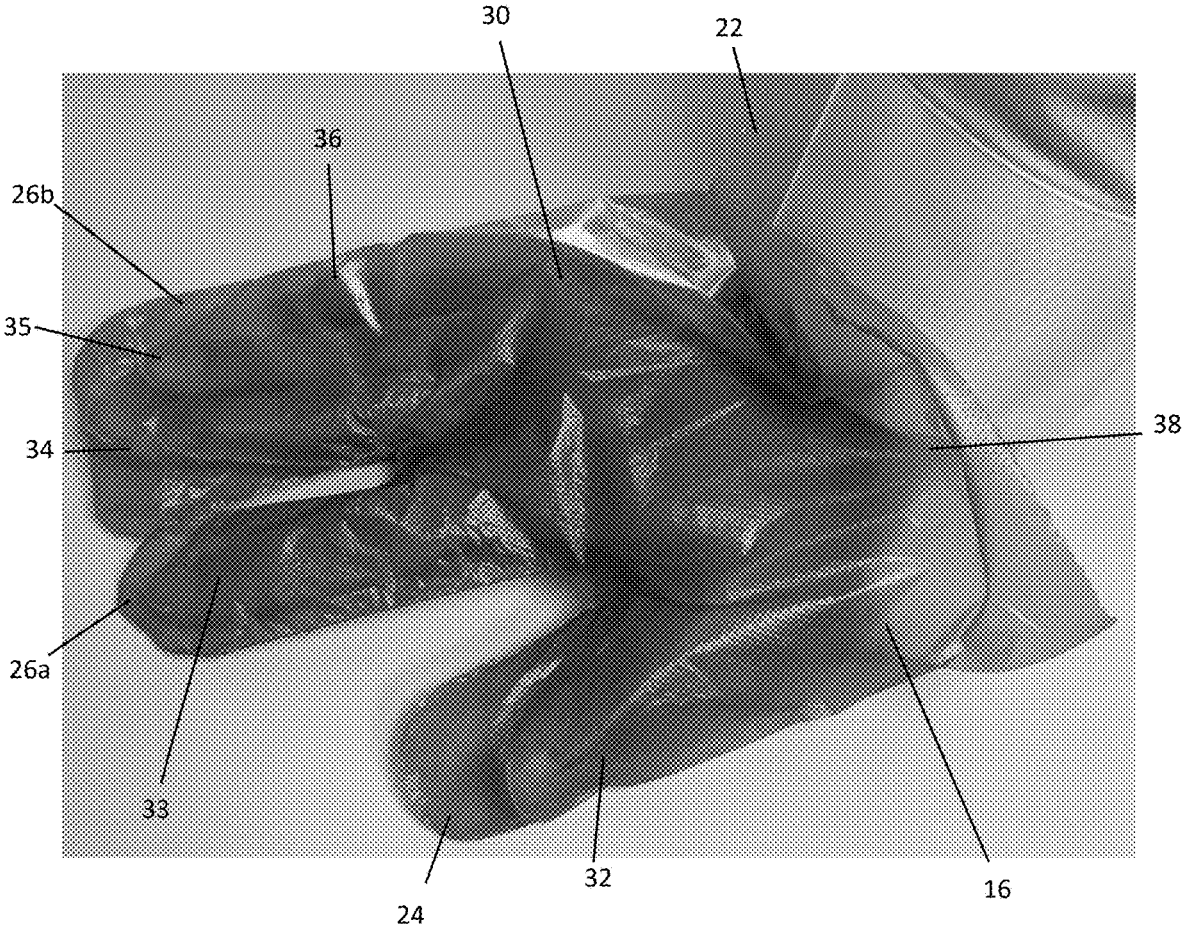
FIG. 8 is an overhead perspective view of the same-hand, hand shield shown in FIG. 1 donned by a user.
Figure 9:
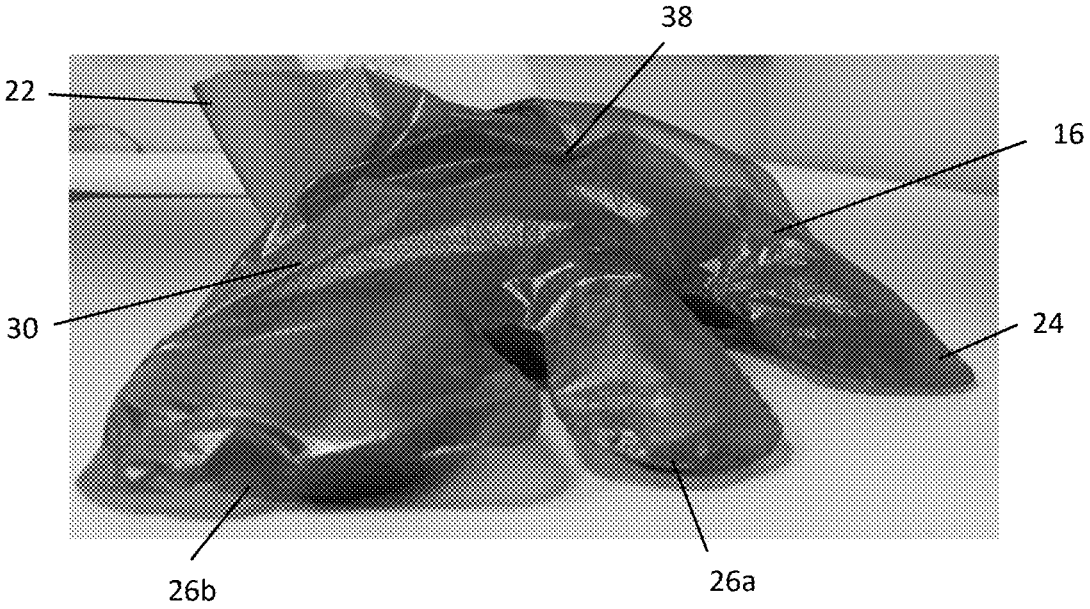
FIG. 9 is a front perspective view of the embodiment in FIG. 8.
Figure 10:
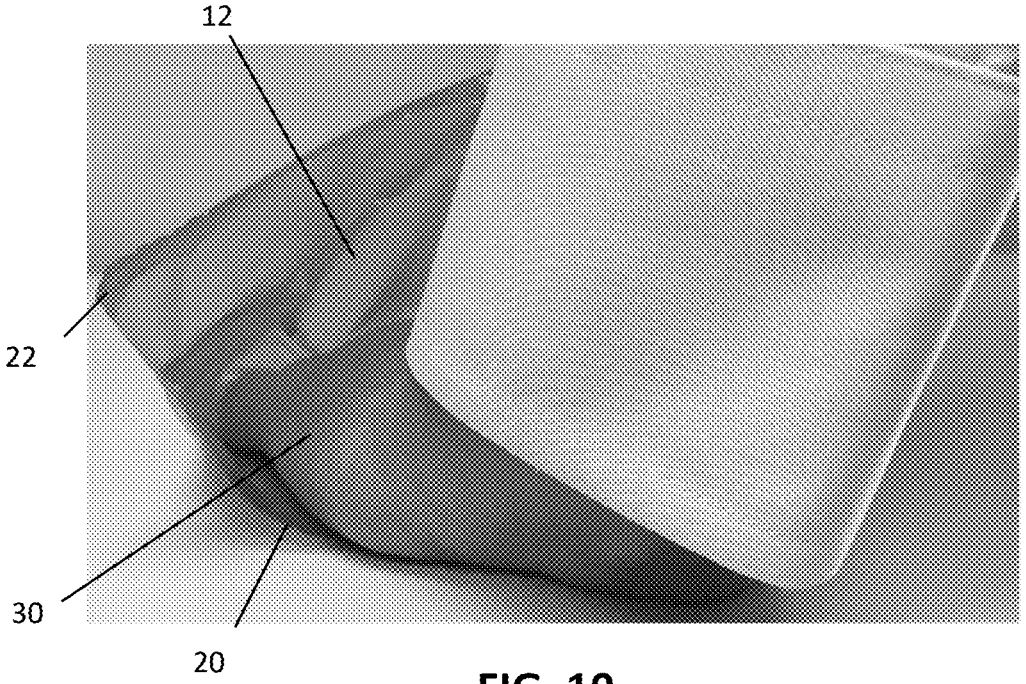
FIG. 10 is a back perspective view of the embodiment in FIG. 8.
Figure 11:
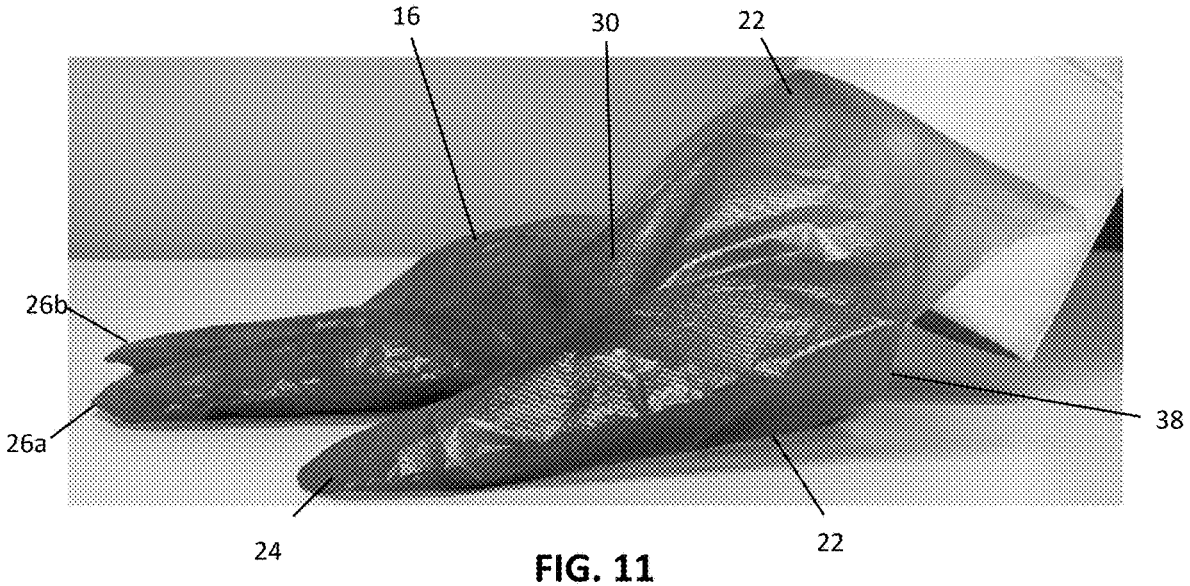
FIG. 11 is a left side perspective view of the embodiment in FIG. 8.
Figure 12:
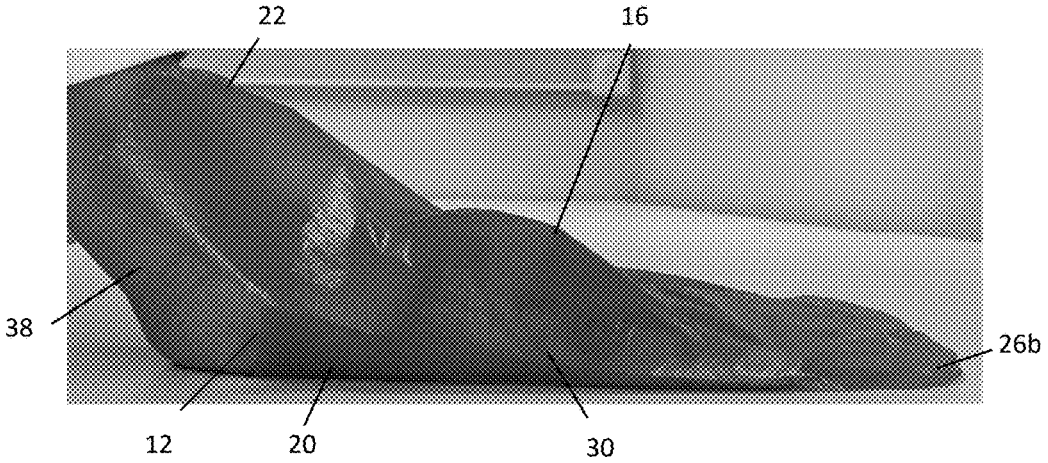
FIG. 12 is a right side perspective view of the embodiment in FIG. 8.
Figure 13:
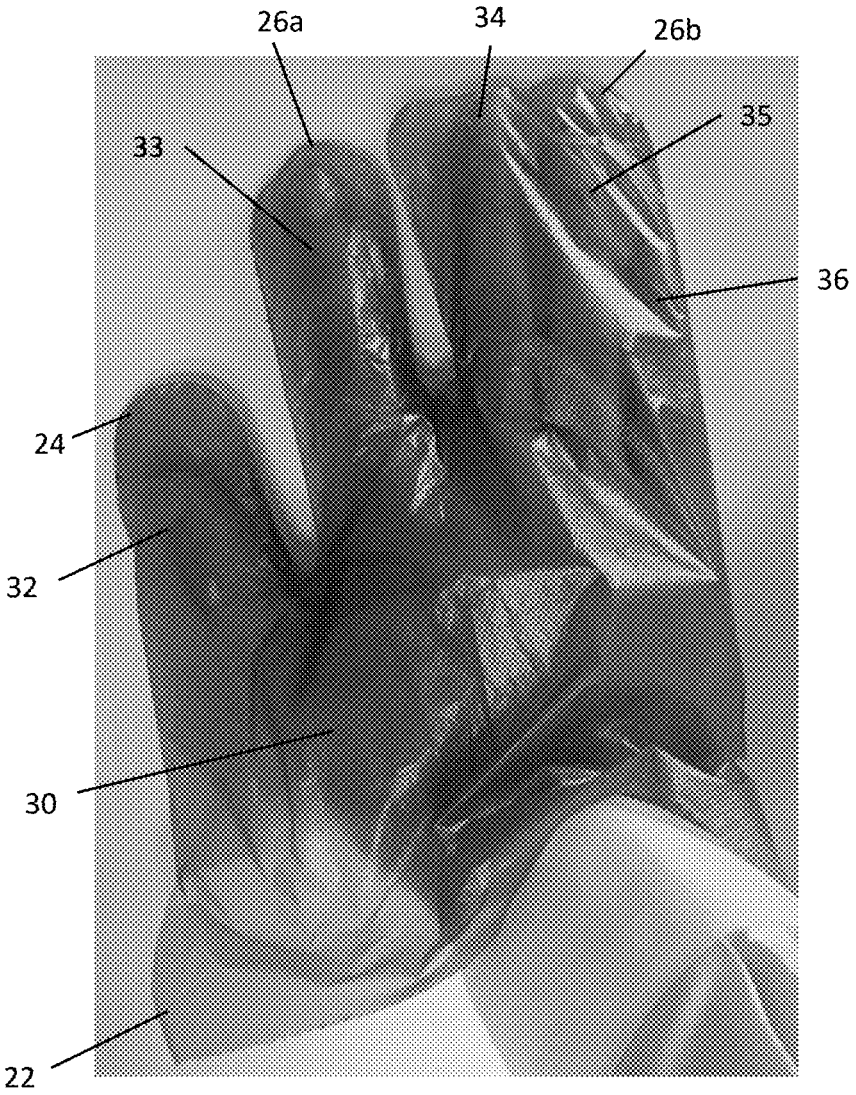
FIG. 13 is a top view of the embodiment in FIG. 8.
Figure 14:
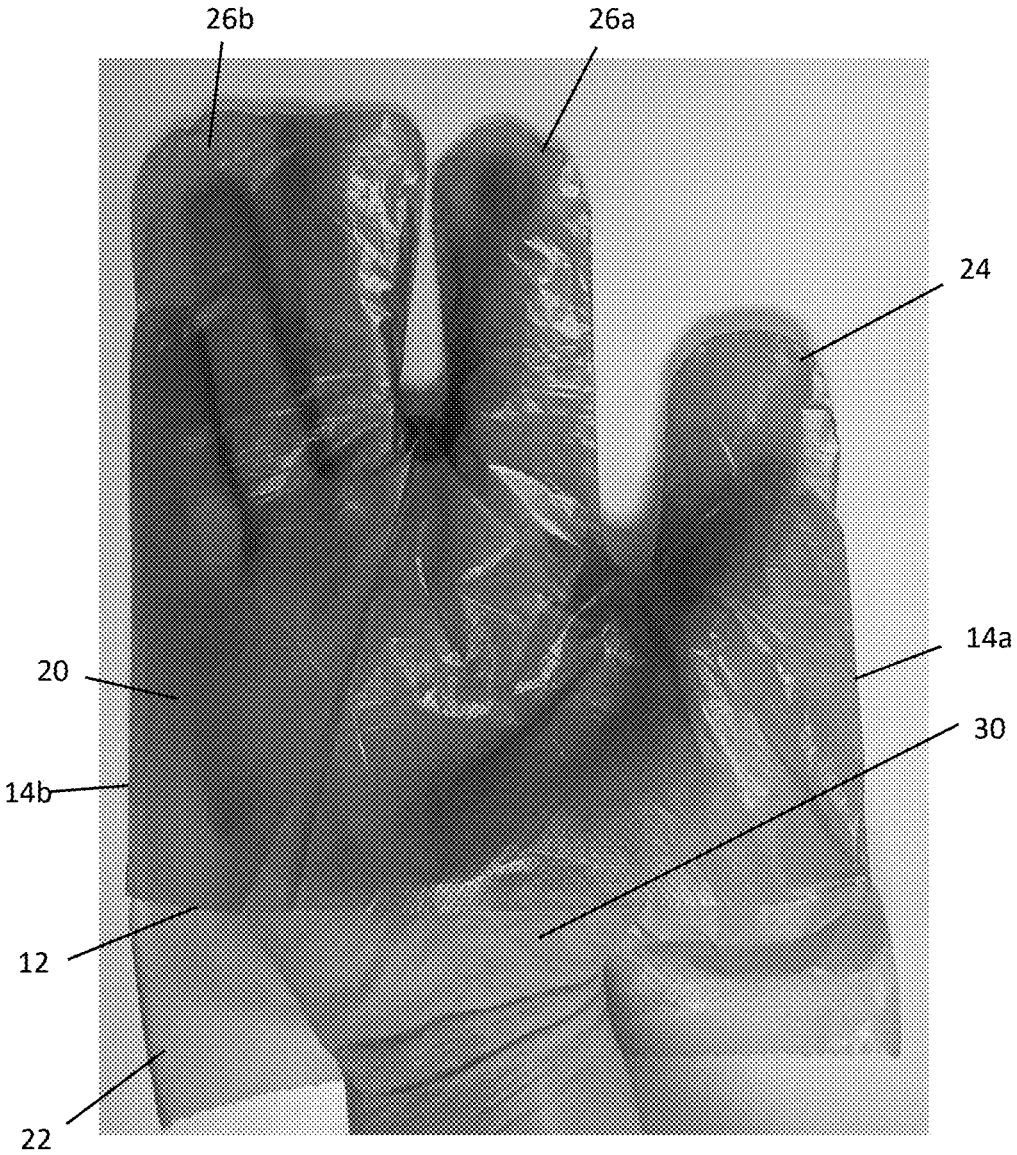
FIG. 14 is a bottom view of the embodiment in FIG. 8.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a same-hand, hand shield, generally designated 10, is shown constructed according to the present inventions. Hand shield 10 is formed of a flexible material and includes an opening 12 for receiving at least a portion of a user's hand, sides 14*a* and 14*b* adapted for enabling removal of the shield using the same hand that the shield is being donned, and a partial palm portion 16. Hand shield 10 may be donned and removed with the same hand without requiring a wearer's opposing hand for assistance.

The partial palm portion 16 may comprise a palm flap 20 and a back flap 22 that cover the palm and back faces of a user's hand, respectively. For example, palm flap 20 and back flap 22 may be comprised of two pieces that are joined together to form partial palm portion 16. Palm flap 20 and back flap 22 may be thermally joined together to form said hand shield.

Hand shield 10 may further including a thumb portion 24 and a digit portion 26 to cover the thumb and one or more digits of a wearer's hand. FIGS. 1-7 illustrate one embodiment wherein the digit portion is comprised of two portions 26*a* and 26*b* adapted to accommodate all digits. As best seen in FIGS. 8-14, hand shield 10 is donned by a hand 30. Thumb portion 24 accommodates the thumb 32 of hand 30. The index finger 33 of hand 30 is inserted into digit portion 26*a*, while fingers 34, 35 and 36 are inserted into digit portion 26*b*. The embodiment shown in FIGS. 1-14 may be useful in applications wherein an opposable thumb and index finger are needed, but the remaining digits are not necessary. For example, hand shield 10 may be placed at gas stations, wherein a customer can don hand shield 10 having a thumb portion 24 and digit portions 26*a* and 26*b*. Thumb portion 24 and digit portions 26*a* enable the user to effectively handle the gas nozzle and trigger, while digit portion 26*b* keeps the remaining digits shielded.

Figure 15:
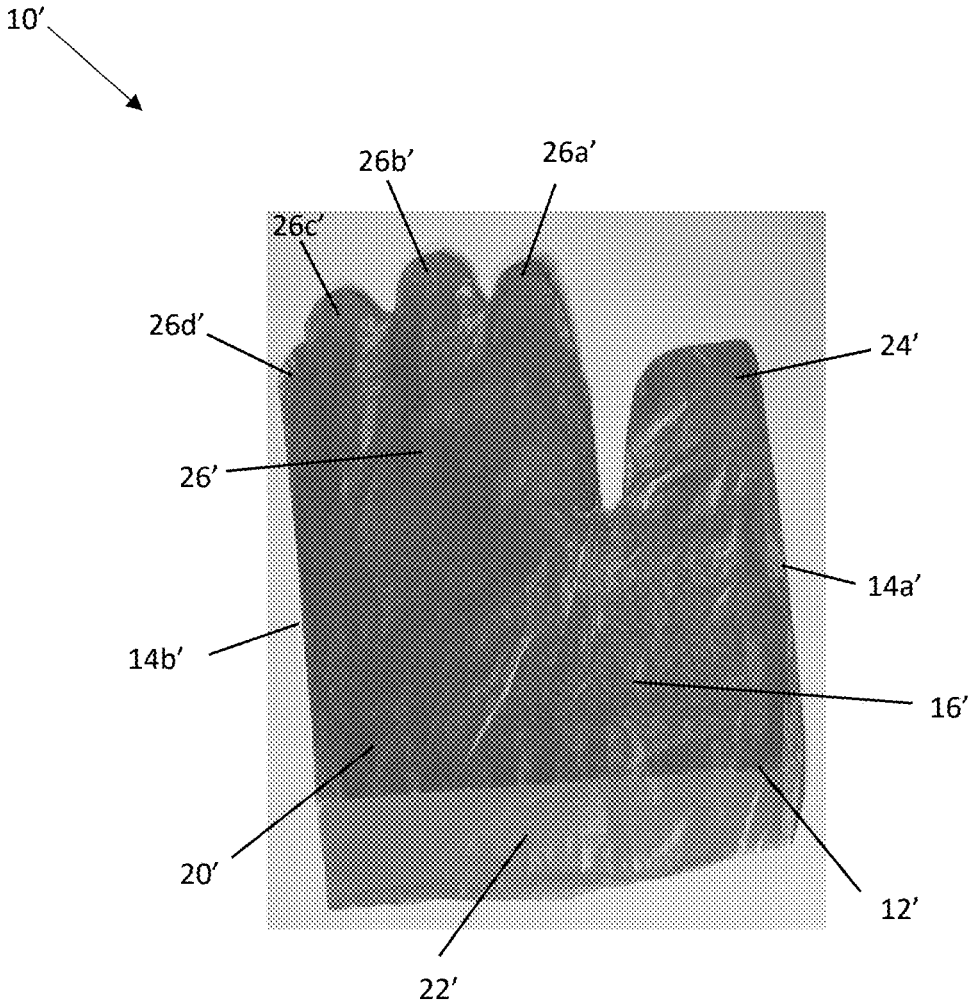
FIG. 15 is an overhead perspective view of an undonned same-hand, hand shield constructed according to another embodiment of the present inventions.
Figure 16:
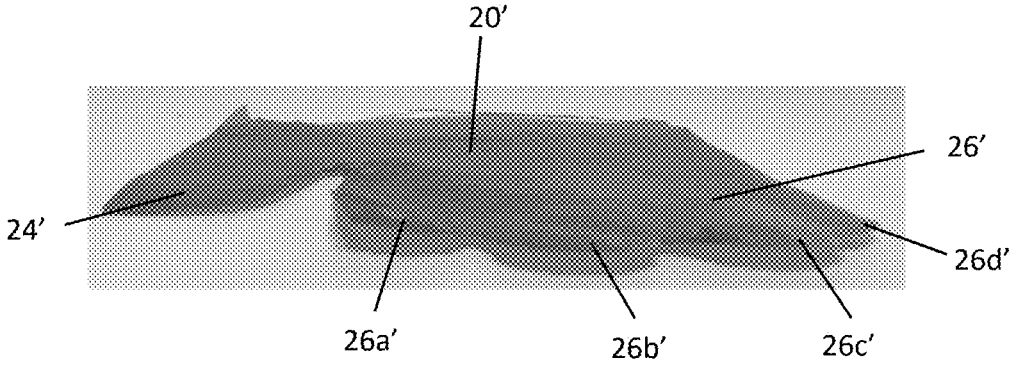
FIG. 16 is a front perspective view of the embodiment in FIG. 15.
Figure 17:
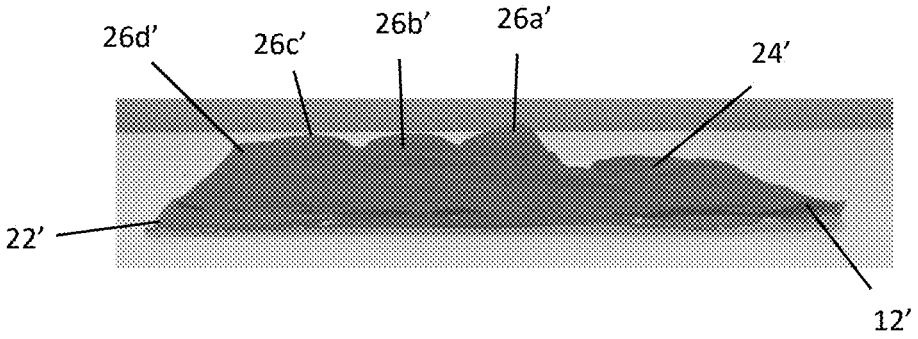
FIG. 17 is a back perspective view of the embodiment in FIG. 15.
Figure 18:
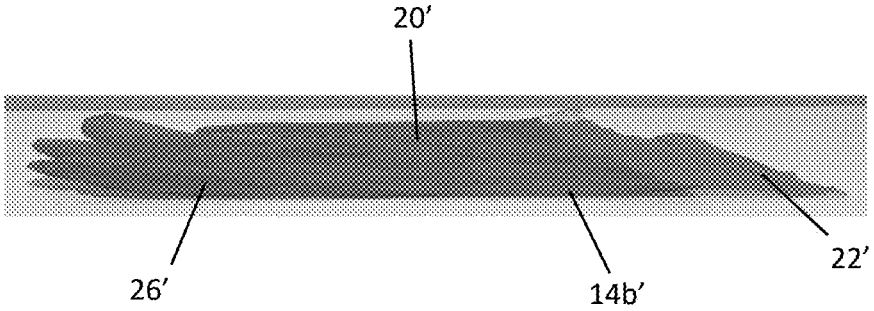
FIG. 18 is a left side perspective view of the embodiment in FIG. 15.
Figure 19:
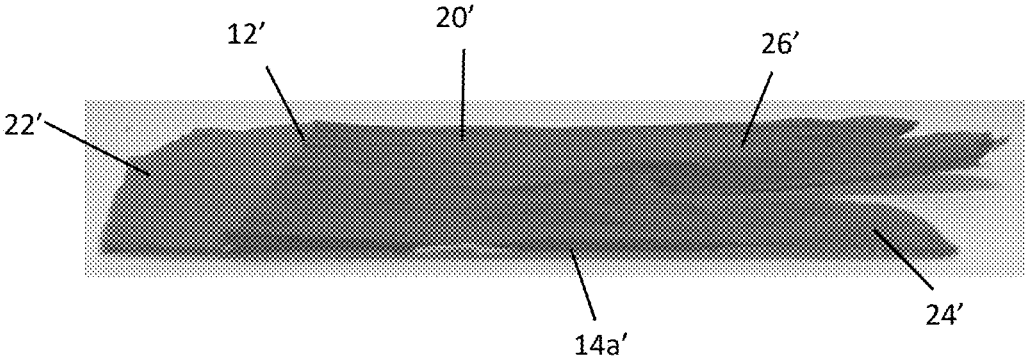
FIG. 19 is a right side perspective view of the embodiment in FIG. 15.
Figure 20:
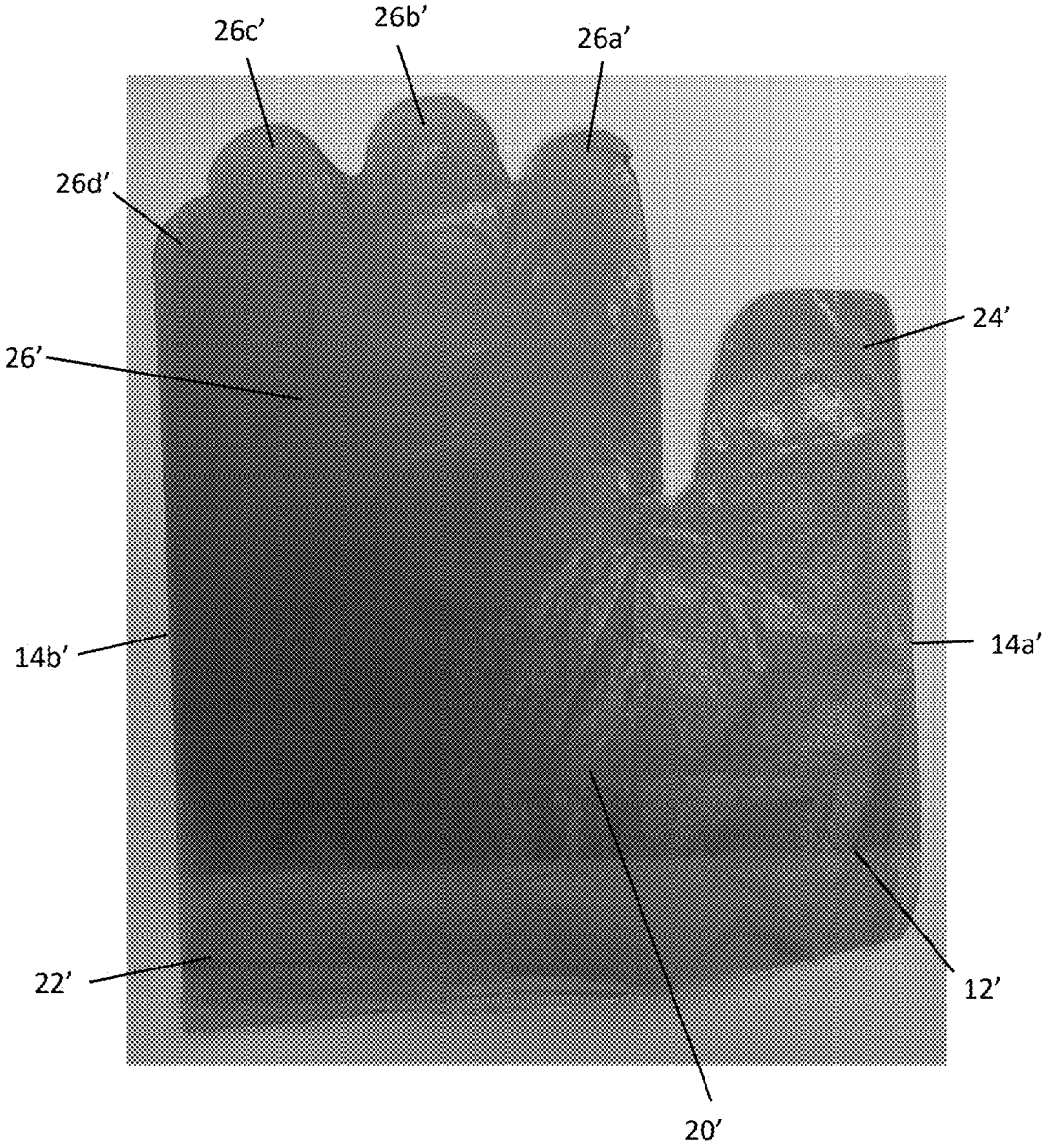
FIG. 20 is a top view of the embodiment in FIG. 15.
Figure 21:
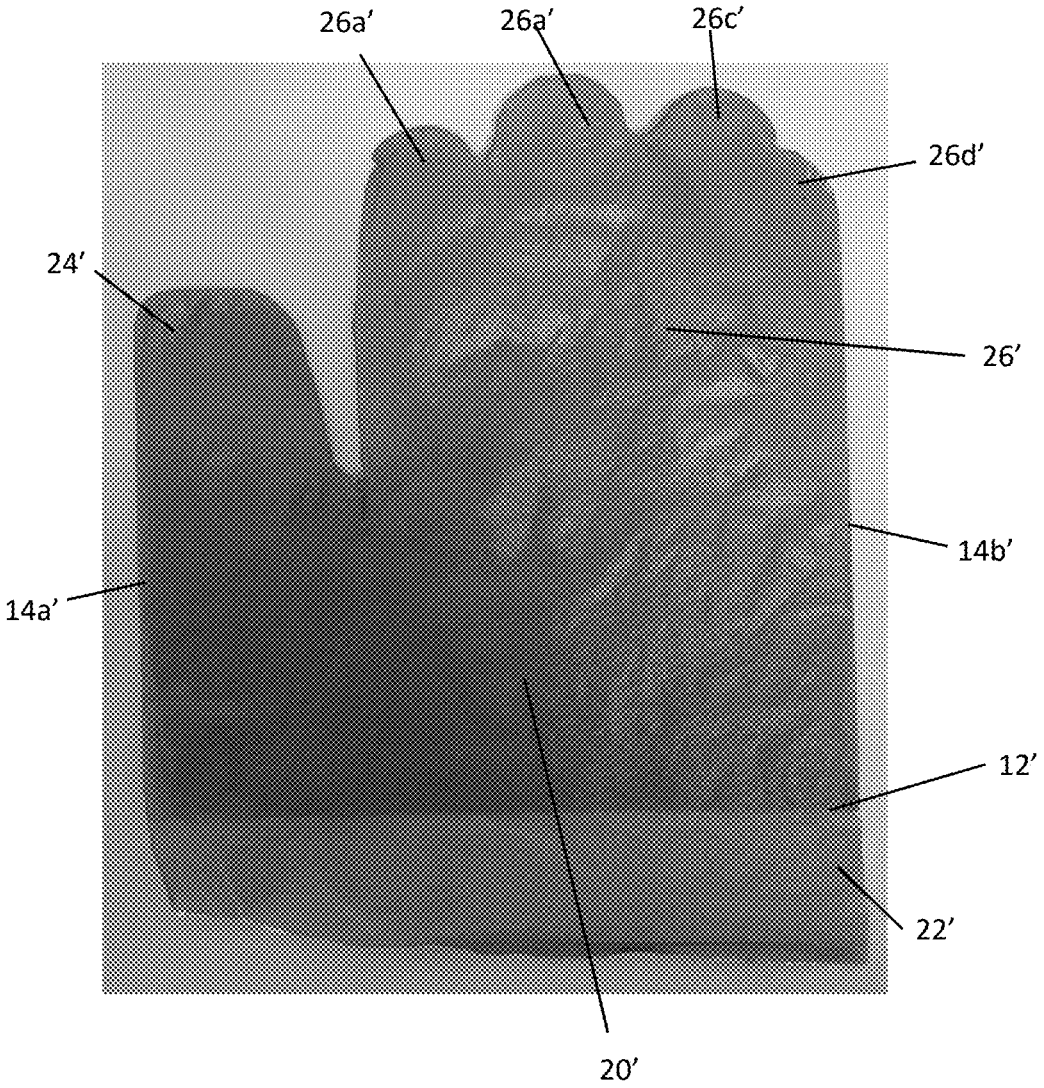
FIG. 21 is a bottom view of the embodiment in FIG. 15.
Figure 22:
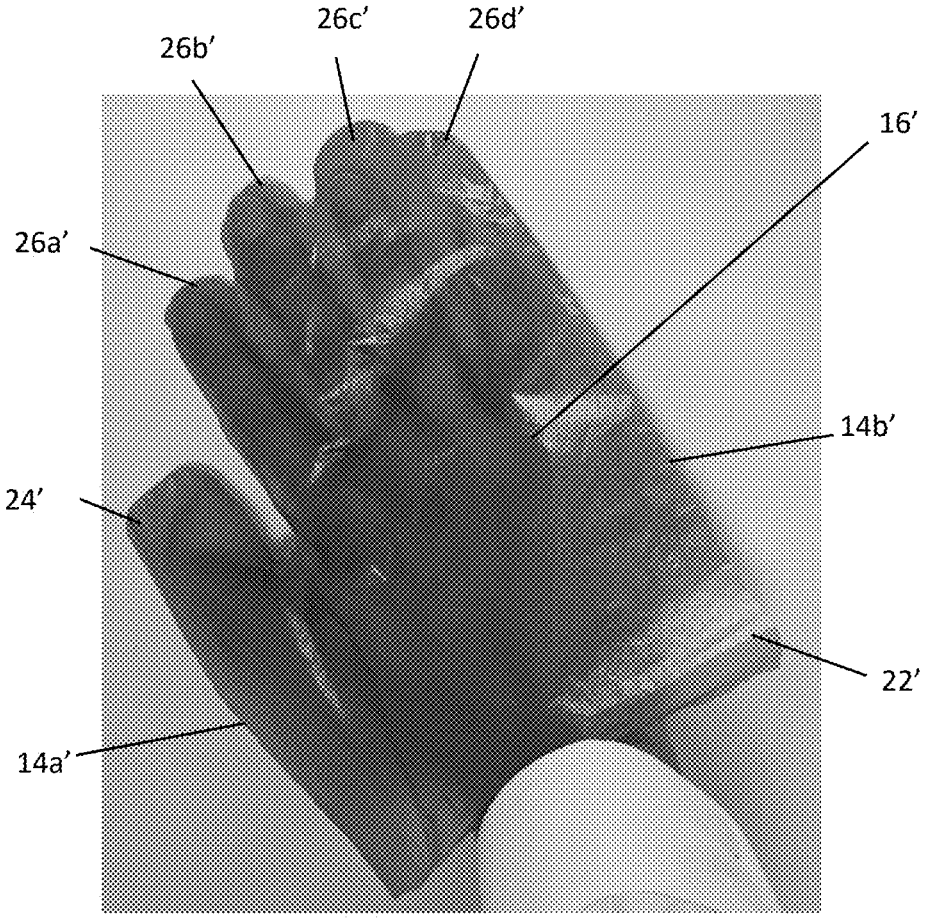
FIG. 22 is an overhead perspective view of the same-hand, hand shield shown in FIG. 15 donned by a user.
Figure 23:
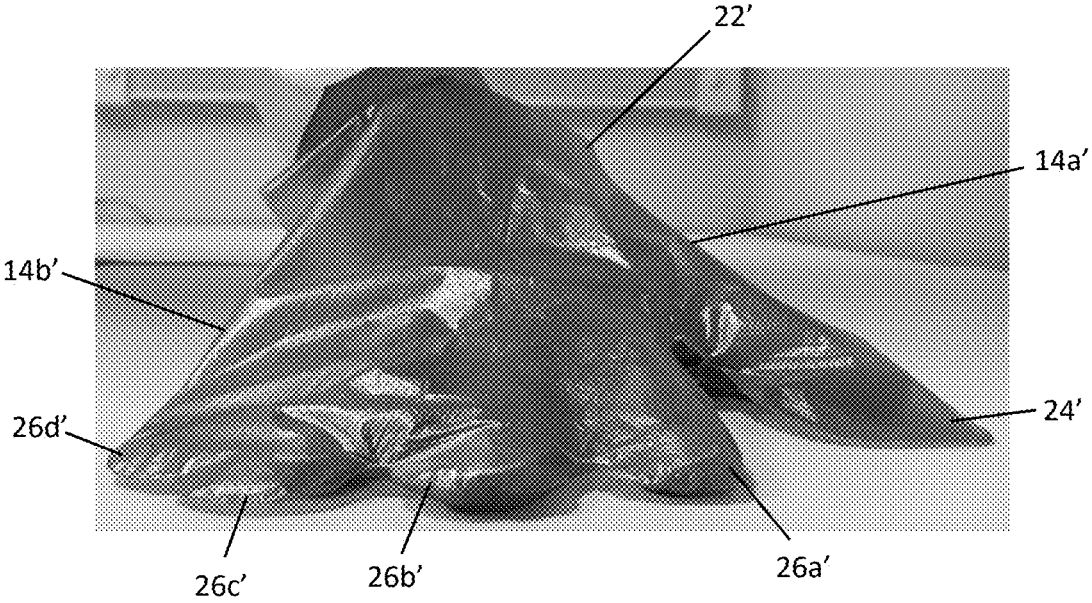
FIG. 23 is a front perspective view of the embodiment in FIG. 22.
Figure 24:
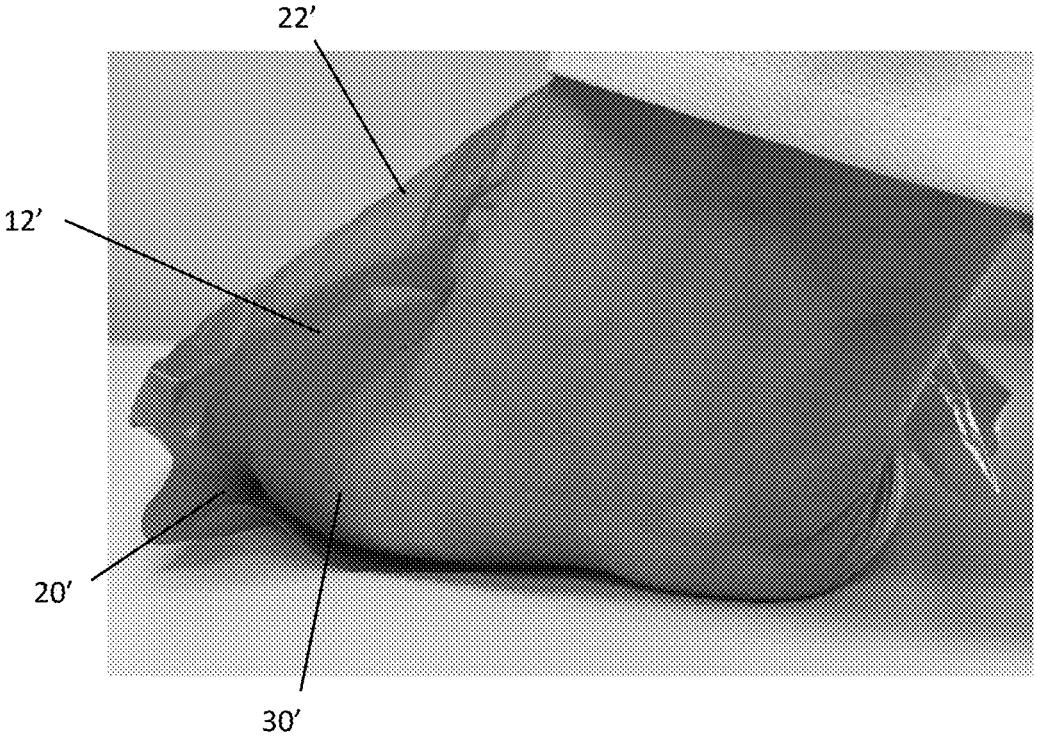
FIG. 24 is a back perspective view of the embodiment in FIG. 22.
Figure 25:
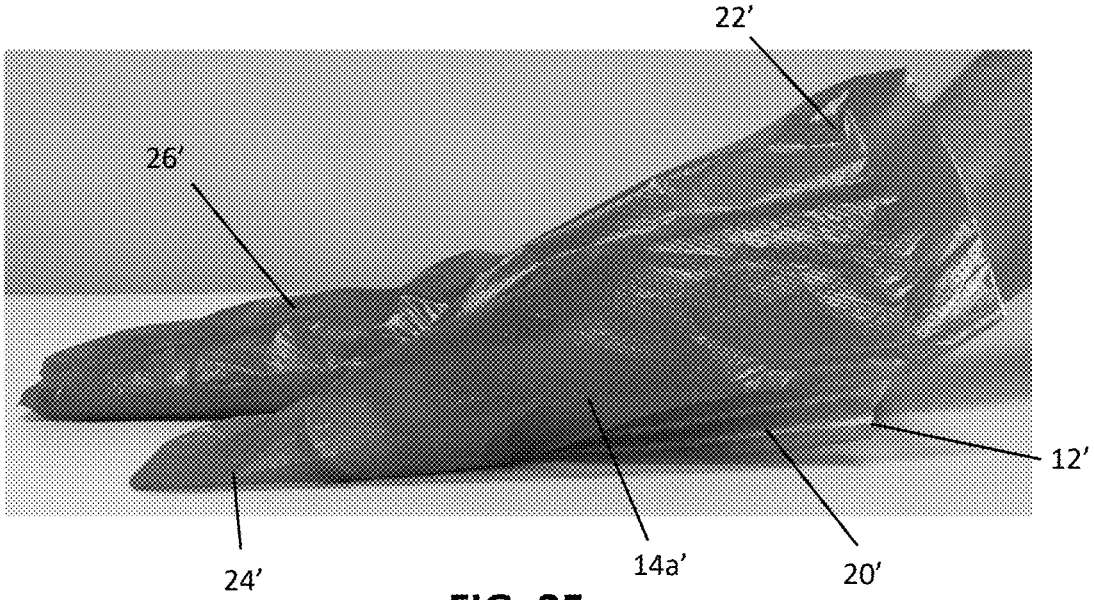
FIG. 25 is a left side perspective view of the embodiment in FIG. 22.
Figure 26:
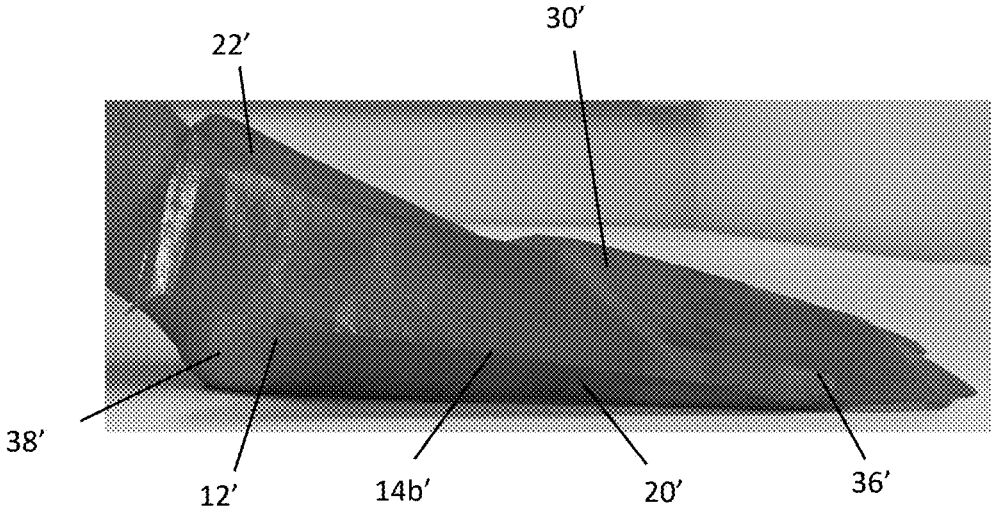
FIG. 26 is a right side perspective view of the embodiment in FIG. 22.
Figure 27:
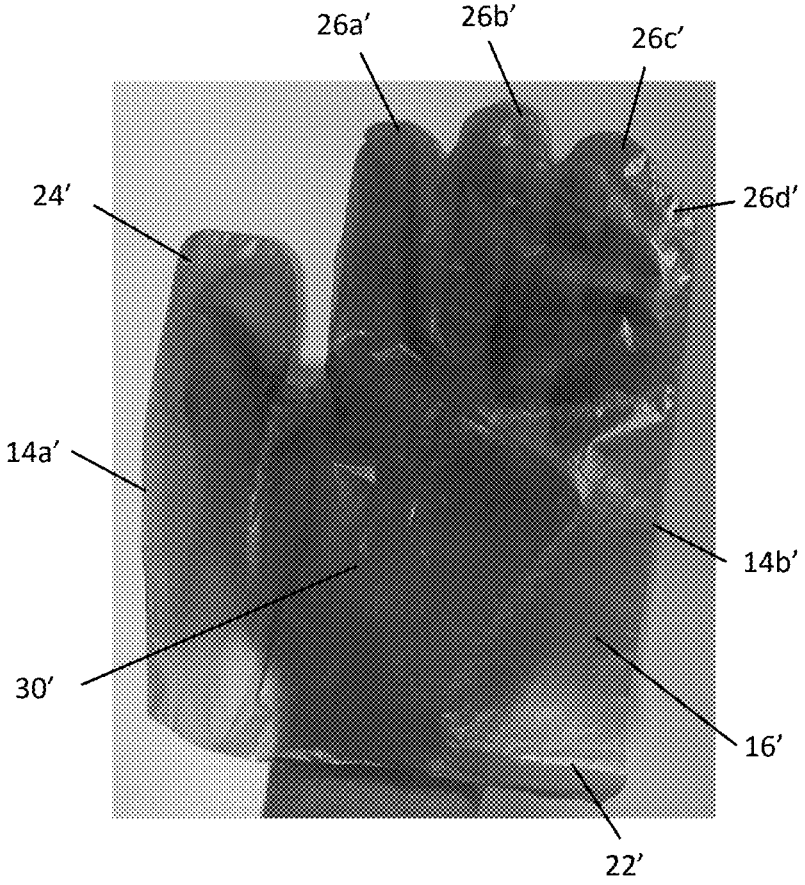
FIG. 27 is a top view of the embodiment in FIG. 22.
Figure 28:
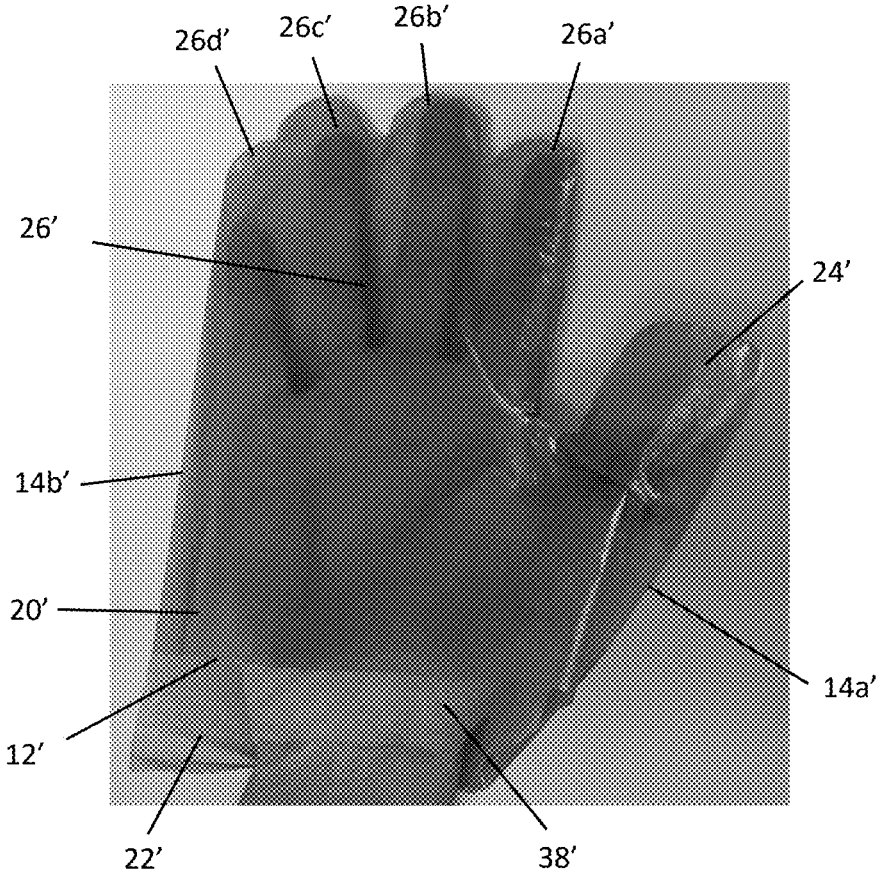
FIG. 28 is a bottom view of the embodiment in FIG. 22.

Turning to FIG. 15, another embodiment of hand shield, designated as 10', is constructed according to the present disclosure. Hand shield 10' is formed of a flexible material and includes an opening 12' for receiving at least a portion of a user's hand, sides 14*a'* and 14*b'* adapted for enabling removal of the shield using the same hand that the shield is being donned, and a partial palm portion 16'. Hand shield 10' may be donned and removed with the same hand without requiring a wearer's opposing hand for assistance.

The partial palm portion 16 may comprise a palm flap 20' and a back flap 22' that cover the palm and back faces of a user's hand, respectively. For example, palm flap 20' and back flap 22' may be comprised of two pieces that are joined together to form partial palm portion 16'. Palm flap 20' and back flap 22' may be thermally joined together to form said hand shield.

As seen in FIGS. 15-21, hand shield 10' includes a thumb portion 24' and a digit portion 26' to cover the thumb and digits of a wearer's hand. Digit portion 26' is comprised of four portions 26*a'*, 26*b'*, 26*c'* and 26*d'*, wherein each portion is adapted to accommodate a digit of a hand. As best seen in FIGS. 22-28, hand shield 10' is donned by a hand 30'. Thumb portion 24' accommodates the thumb 32' of hand 30'. The index finger 33' of hand 30' is inserted into digit portion 26*a'*, while fingers 34', 35' and 36' are inserted into digit portion 26*b*', 26*c*', and 26*d*', respectively. The embodiment shown in FIGS. 15-28 may be useful in various applications wherein an opposable thumb and all digits are needed.

For example, the hand shield 10' may be placed inside or outside public rest rooms wherein a customer can don the shield from a wall-mounted dispenser to use when grabbing the door handle to enter or leave. Hand shield 10' may also be used in restrooms to grab the toilet handle, sink handles or stall door latches in order to protect customers from contracting illnesses as a result of bacteria and viruses contamination.

By way of another example, hand shields 10' may be placed at the entrance of the grocery store or retail store. Hand shields 10' can be donned before grabbing a shopping cart or basket to protect the customer from making contact with the germs that can contaminate those surfaces.

Similarly, hand shield 10' may also be placed at the meat and produce department coolers in the grocery stores. For instance, hand shields 10' may be donned from a dispenser located on the side, top or lower edge of a cooler. Customers can don shields 10' while picking up meat packages to prevent their hands from directly contacting germs and/or liquids that may have leaked out.

Figure 29:
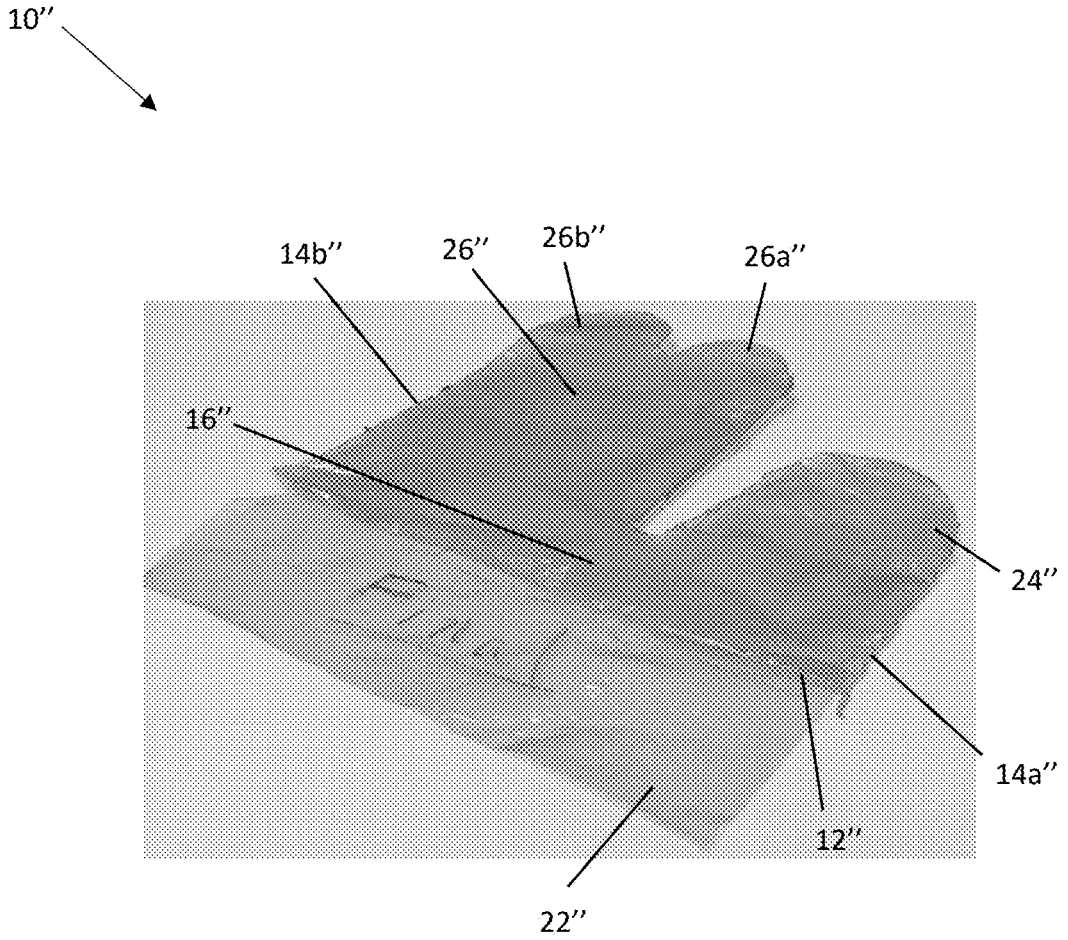
FIG. 29 is an overhead perspective view of an undonned same-hand, hand shield constructed according to another embodiment of the present inventions.
Figure 30:
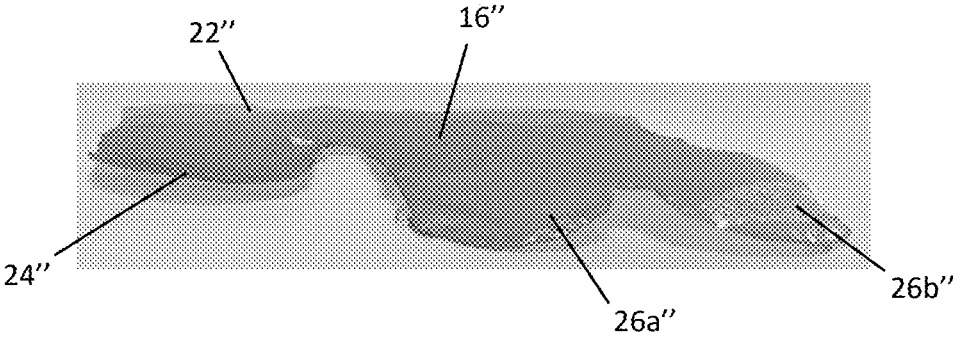
FIG. 30 is a front perspective view of the embodiment in FIG. 29.
Figure 31:
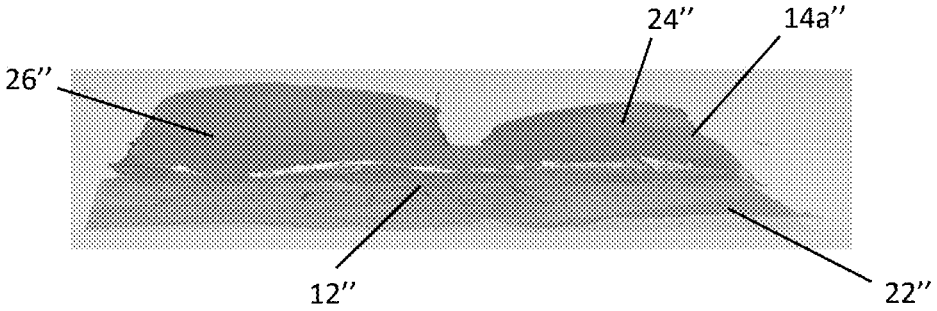
FIG. 31 is a back perspective view of the embodiment in FIG. 29.
Figure 32:
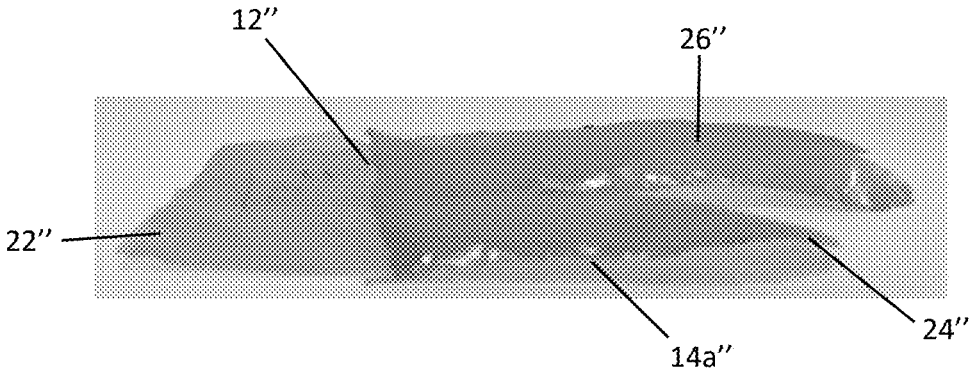
FIG. 32 is a left side perspective view of the embodiment in FIG. 29.
Figure 33:
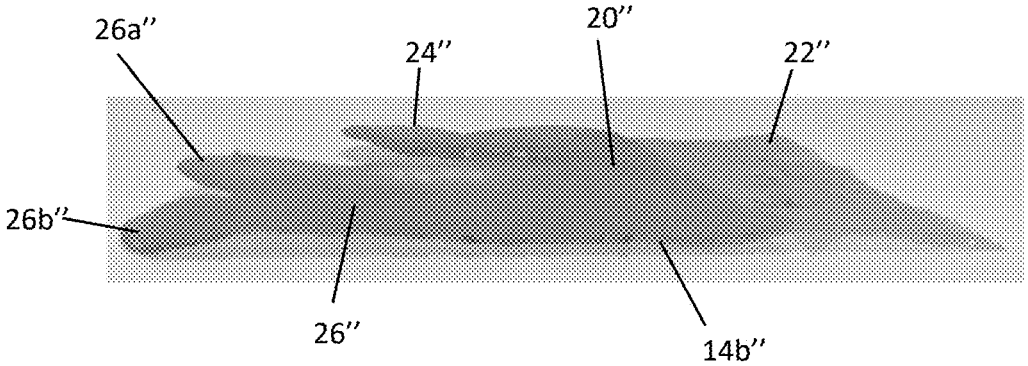
FIG. 33 is a right side perspective view of the embodiment in FIG. 29.
Figure 34:
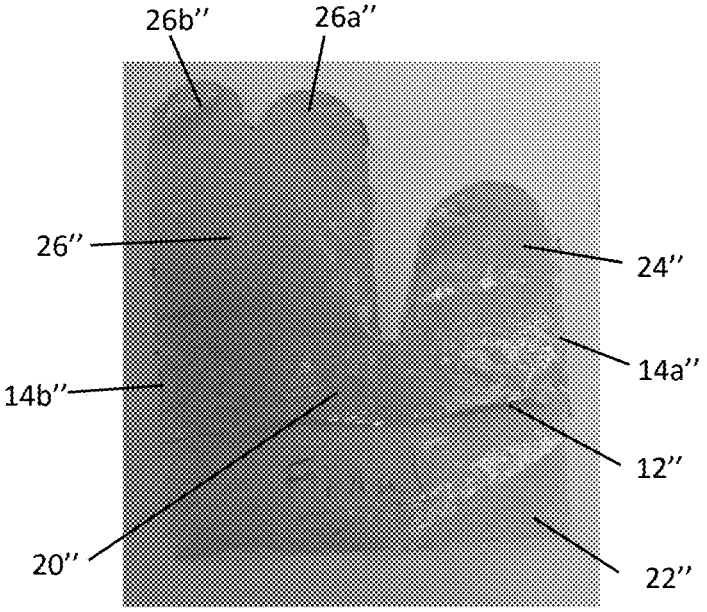
FIG. 34 is a top view of the embodiment in FIG. 29.
Figure 35:
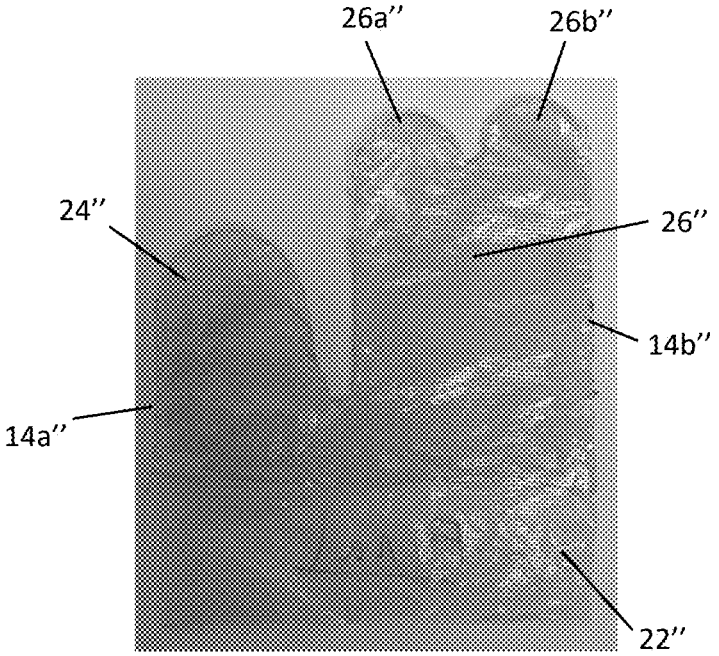
FIG. 35 is a bottom view of the embodiment in FIG. 29.
Figure 36:
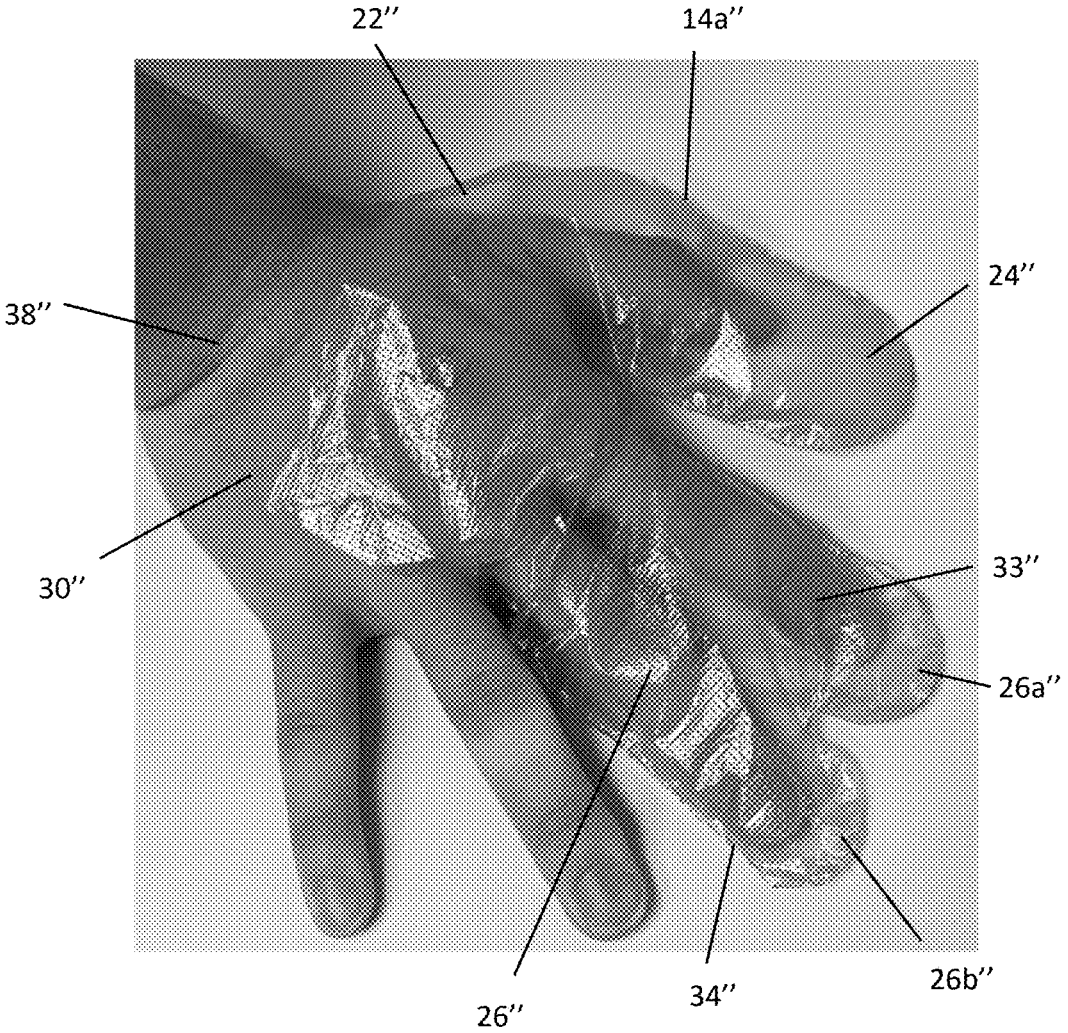
FIG. 36 is an overhead perspective view of the same-hand, hand shield shown in FIG. 29 donned by a user.
Figure 37:
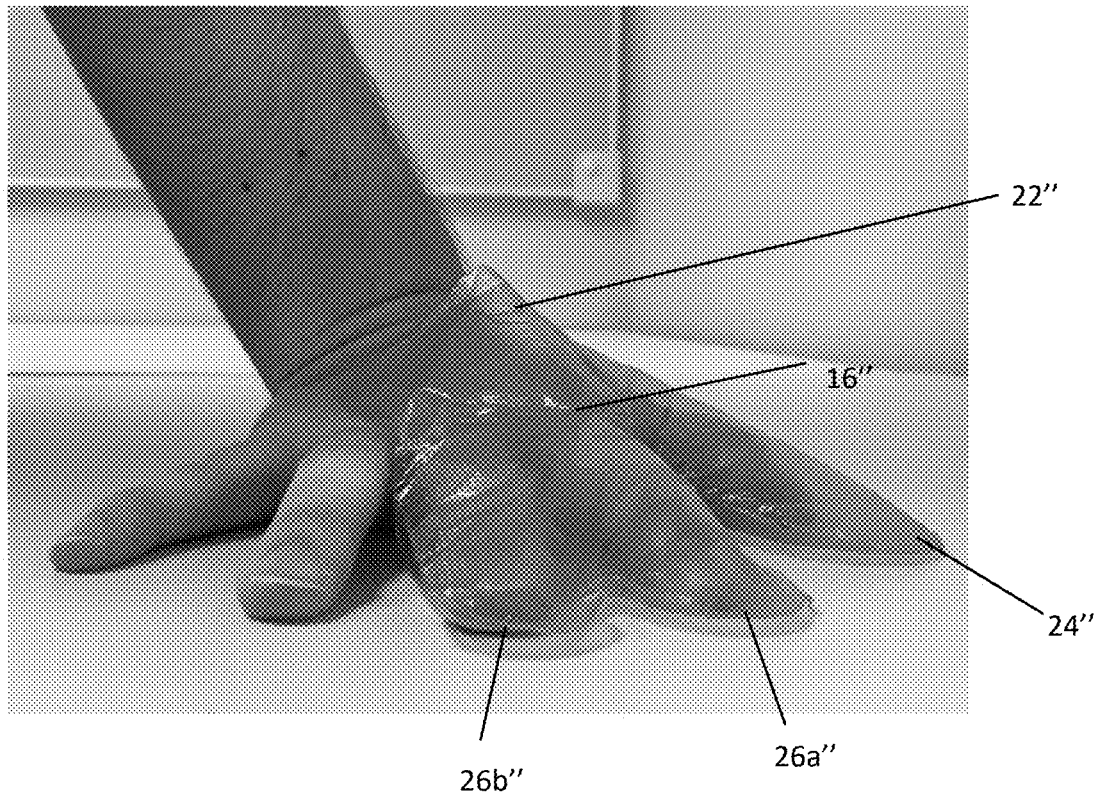
FIG. 37 is a front perspective view of the embodiment in FIG. 36.
Figure 38:
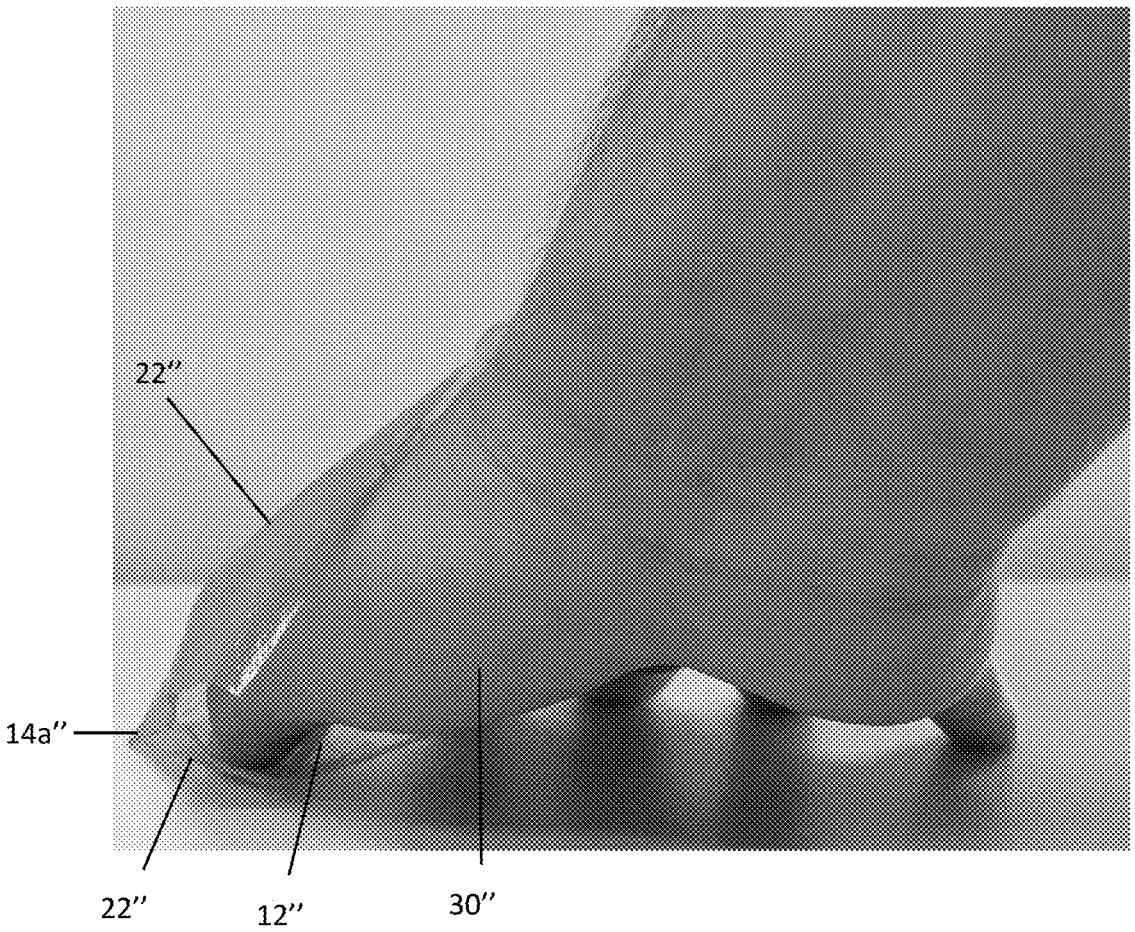
FIG. 38 is a back perspective view of the embodiment in FIG. 36.
Figure 39:
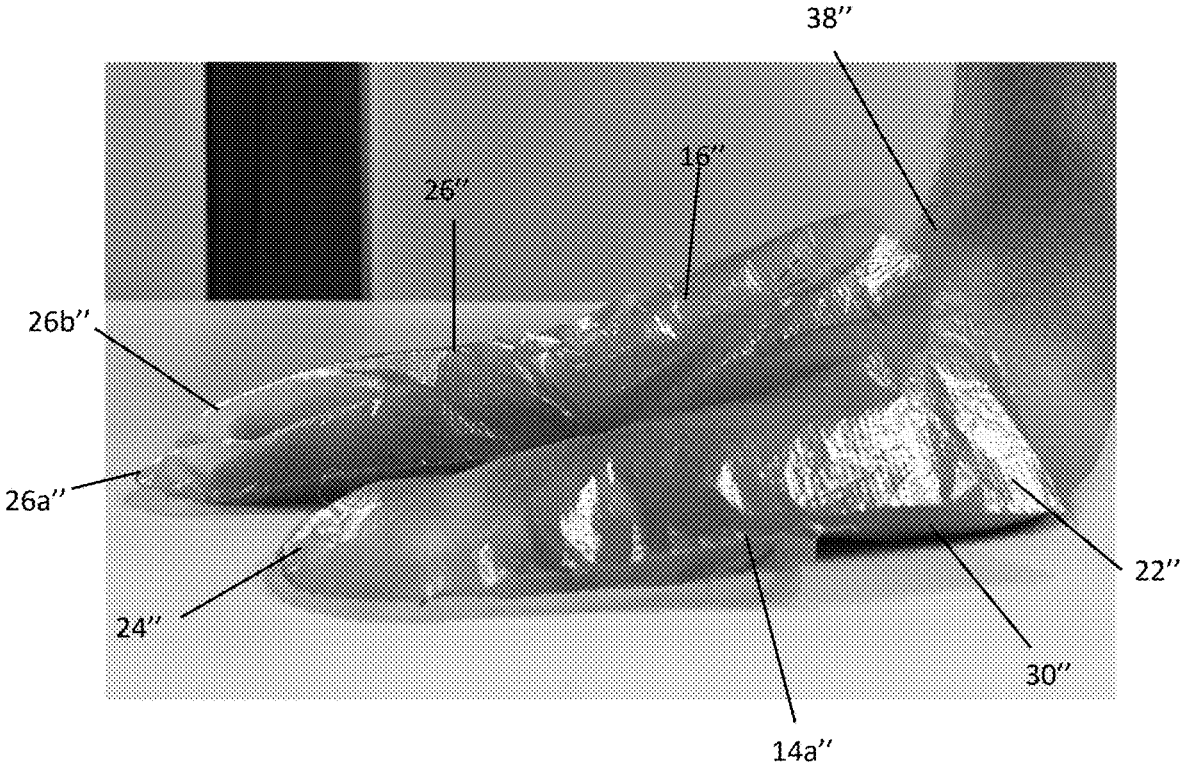
FIG. 39 is a left side perspective view of the embodiment in FIG. 36.
Figure 40:
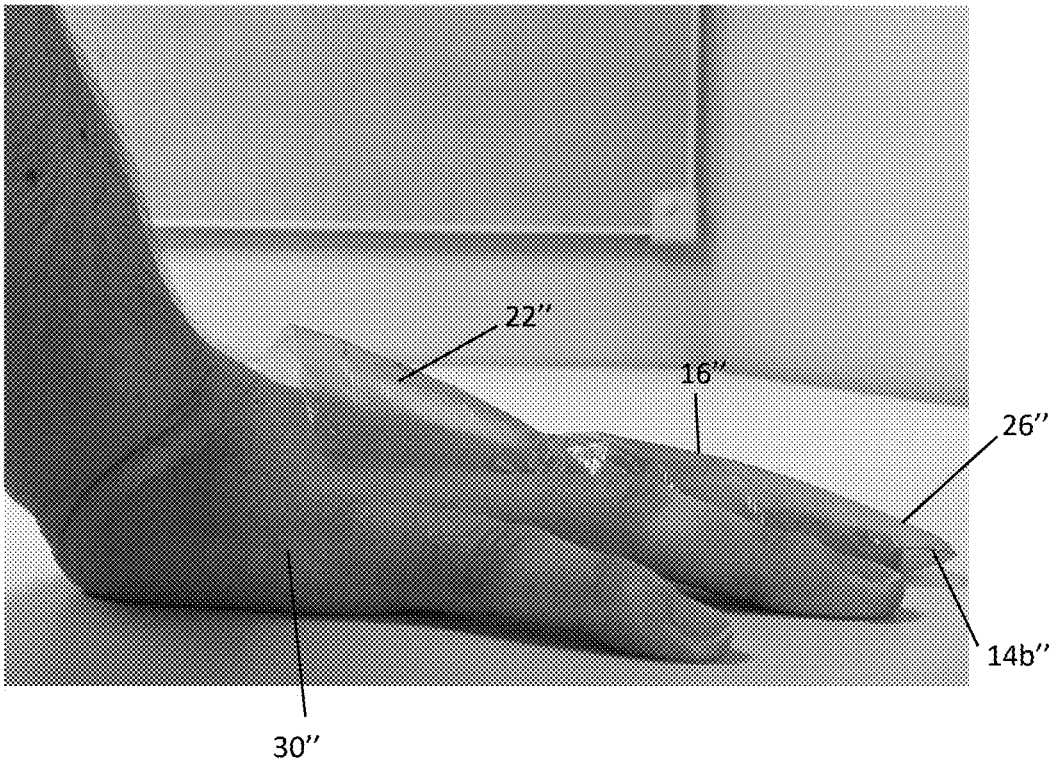
FIG. 40 is a right side perspective view of the embodiment in FIG. 36.
Figure 41:
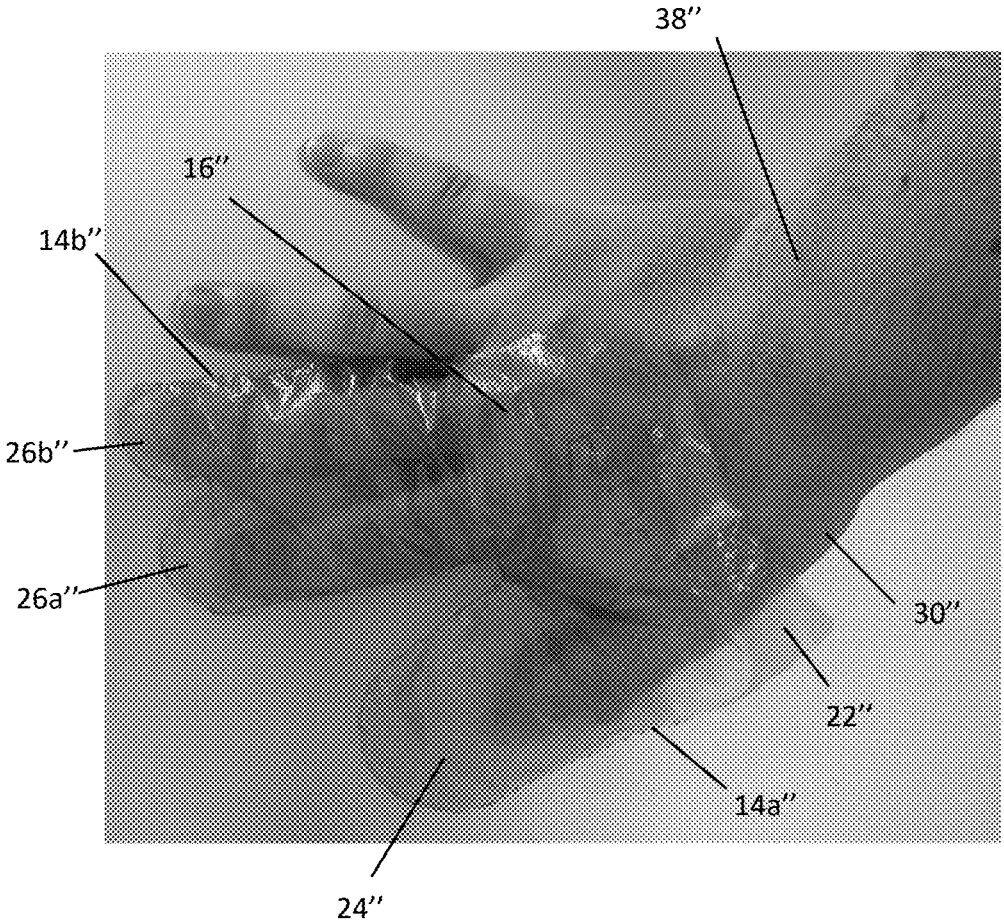
FIG. 41 is a top view of the embodiment in FIG. 36.
Figure 42:
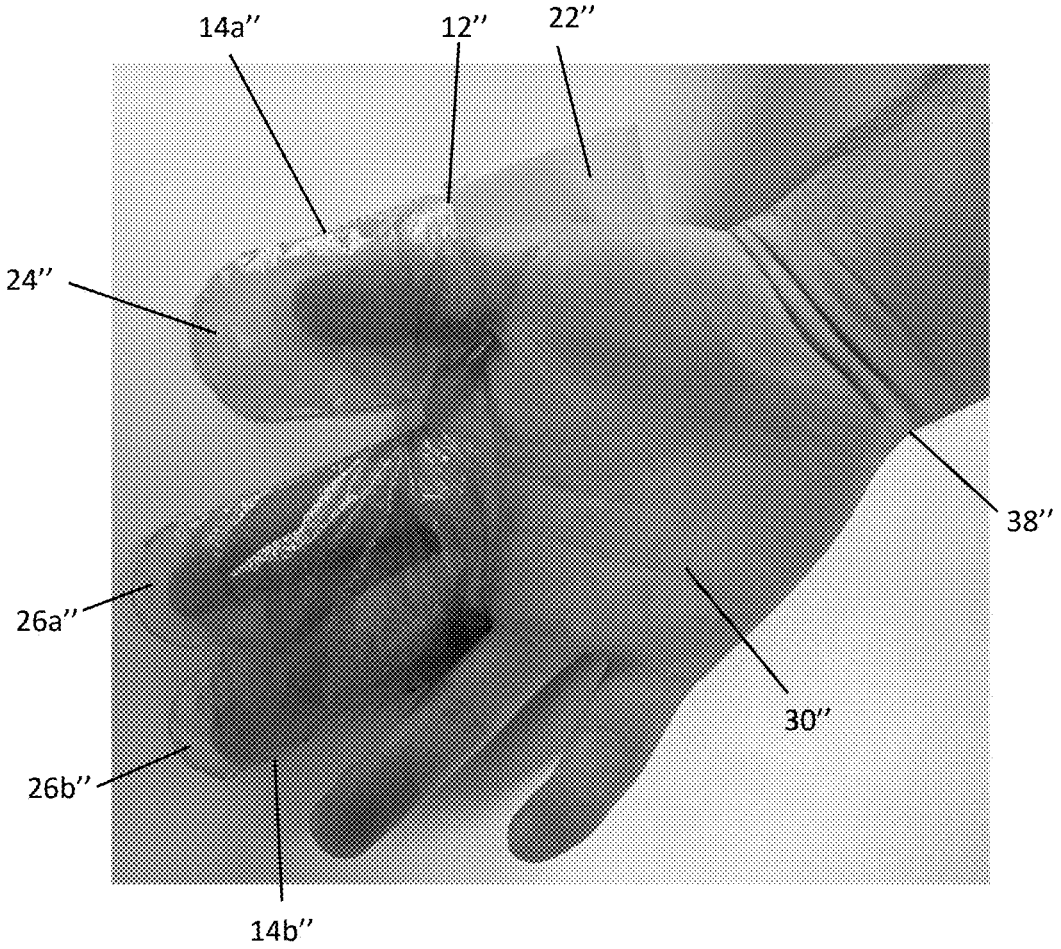
FIG. 42 is a bottom view of the embodiment in FIG. 36.
Figure 43:
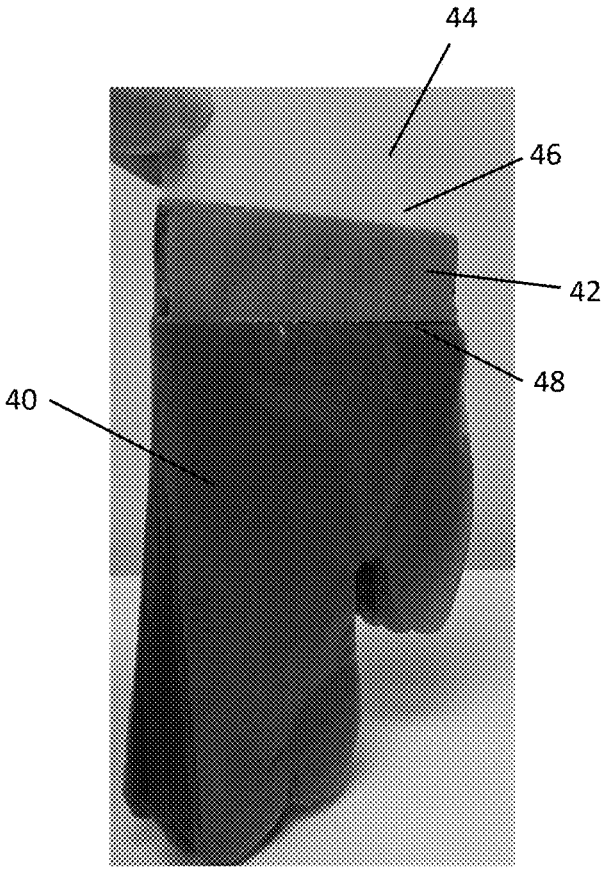
FIG. 43 is an overhead perspective view of a plurality of hand shields fastened together by a header constructed according to one embodiment of the present inventions.
Figure 44:
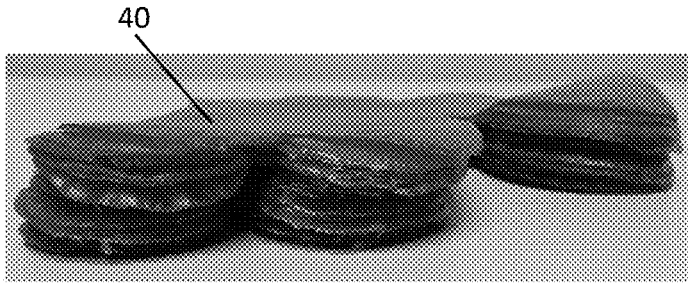
FIG. 44 is a front perspective view of the embodiment in FIG. 43.
Figure 45:
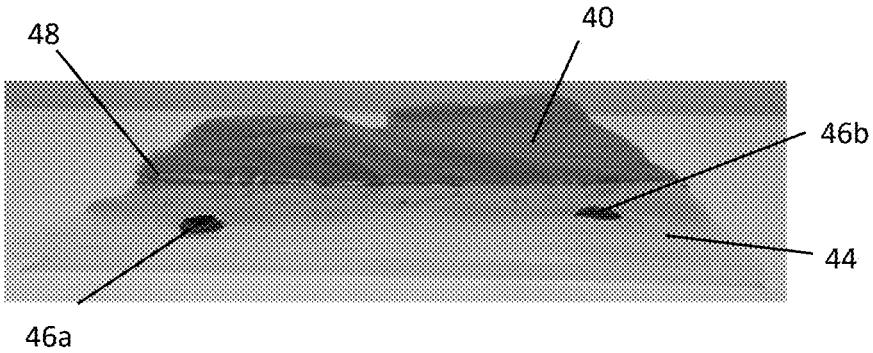
FIG. 45 is a back perspective view of the embodiment in FIG. 43.
Figure 46:
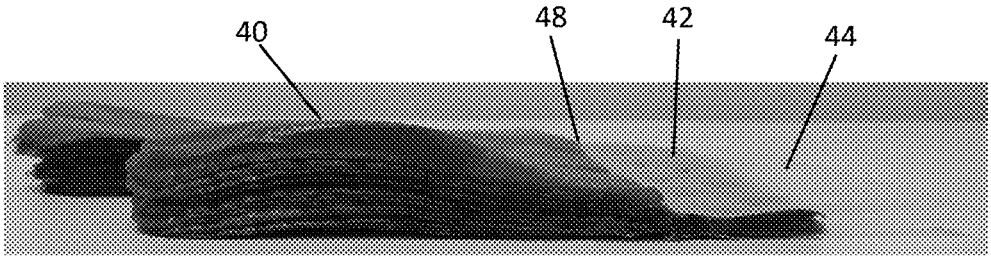
FIG. 46 is a left side perspective view of the embodiment in FIG. 43.

Turning to FIG. 29, another embodiment of hand shield, designated as 10", is constructed according to the present disclosure. Hand shield 10" is formed of a flexible material and includes an opening 12" for receiving at least a portion of a user's hand, sides 14*a*" and 14*b*" adapted for enabling removal of the shield using the same hand that the shield is being donned, and a partial palm portion 16". Hand shield 10" may be donned and removed with the same hand without requiring a wearer's opposing hand for assistance.

The partial palm portion 16 may comprise a palm flap 20" and a back flap 22" that cover the palm and back faces of a user's hand, respectively. For example, palm flap 20" and back flap 22" may be comprised of two pieces that are joined together to form partial palm portion 16". Palm flap 20" and back flap 22" may be thermally joined together to form said hand shield.

As seen in FIGS. 29-35, hand shield 10" includes a thumb portion 24" and a digit portion 26" to cover the thumb and digits of a wearer's hand. Digit portion 26" is comprised of four portions 26*a*", 26*b*", 26*c*" and 26*d*", wherein each portion is adapted to accommodate a digit of a hand. As best seen in FIGS. 36-42, hand shield 10" is donned by a hand 30". Thumb portion 24" accommodates the thumb 32" of hand 30". The index finger 33" of hand 30" is inserted into digit portion 26*a*", while fingers 34", 35" and 36" are inserted into digit portion 26*b*", 26*c*", and 26*d*", respectively. The embodiment shown in FIGS. 29-42 may be useful in applications where only an opposable thumb, index finger, and middle finger are needed for grasping an object.

For example, hand shield 10" may be employed at a stylus station, wherein a customer can don hand shield 10 having a thumb portion 24" and digit portions 26*a*" and 26*b*". Thumb portion 24" and digit portions 26*a*", 26*b*" enable the user to effectively grasp the stylus, while back flap 22" keeps the back face of the user's hand shielded from contamination. Digit portion 26*a*" may also be useful for entering information on a touch screen or keypad at a checkout station. Hand shield 10" may also be used in conjunction with other implements, such as pencils, pens, or markers.

As another example, hand shield 10" may be employed in restaurants for customers to use while dining in. Some customers prefer to avoid using their hands while consuming their entrees. For instance, a customer may want to avoid contaminating their food with germs, or a customer may simply wish to keep their hands clean and oil-free. Also, some types of foods are inherently messy and many consumers waste resources and time cleaning the mess during their meal. Hand shield 10" may be used to provide a means for grasping various food items while shielding the hand and reducing food contamination. Thumb portion 24" and digit portions 26*a*" and 26*b*" enable users to cleanly grasp many types of food items, such as French fries, chicken tenders, or buffalo wings.

Turning to FIG. 43-48, a plurality of hand shields 40 can be fastened together for easier dispensing. The plurality of hand shields 40 may be fastened together by a header 42. Header 42 may include an overhang 44 adapted to secure the plurality of hand shields 40 to a dispenser. Overhang 44 may include one or more holes 46 for securing the plurality of hand shields 40 to a dispenser. Each hand shield may be dispensed by removing it from the plurality of hand shields 40 at perforation 48.

Figure 47:
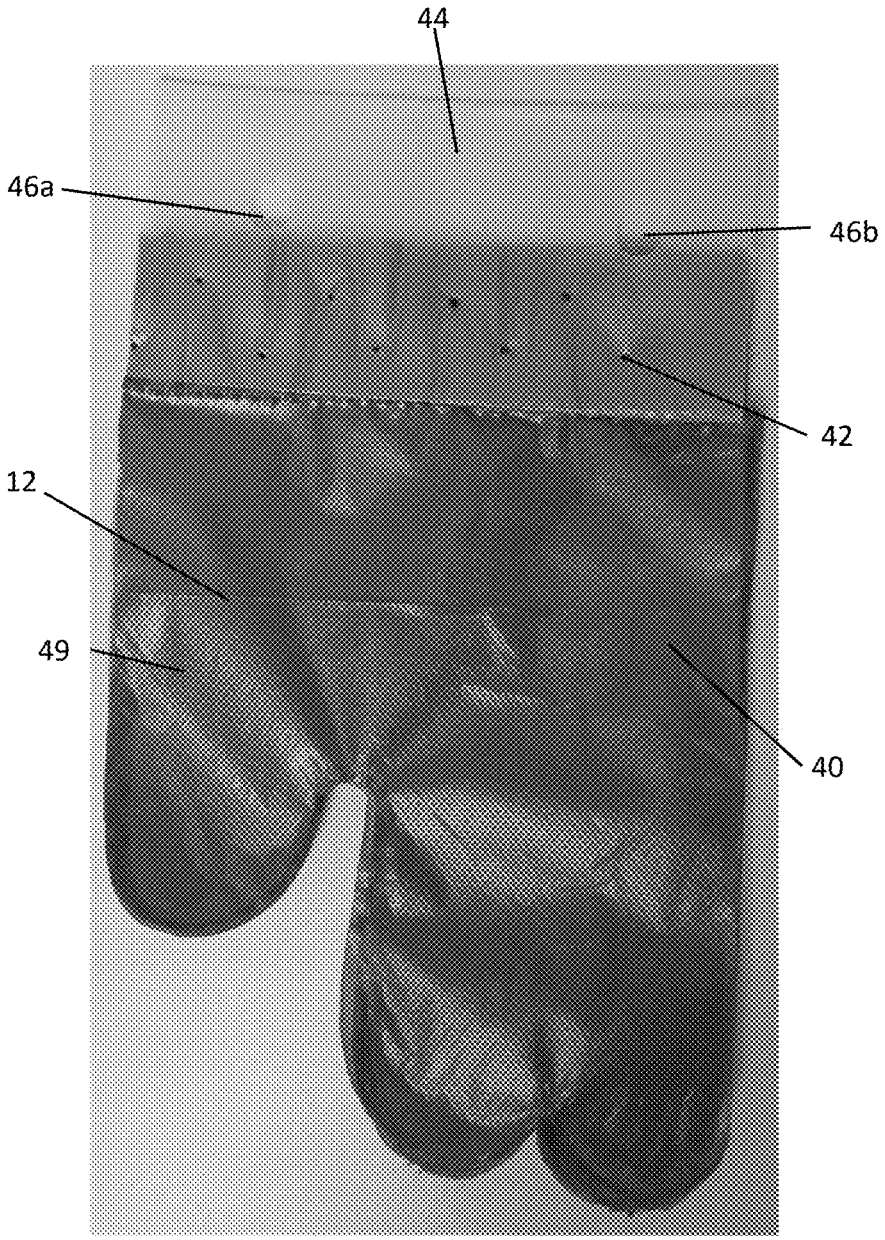
FIG. 47 is a top view of the embodiment in FIG. 43, wherein the bottom view is a mirror thereof.
Figure 48:
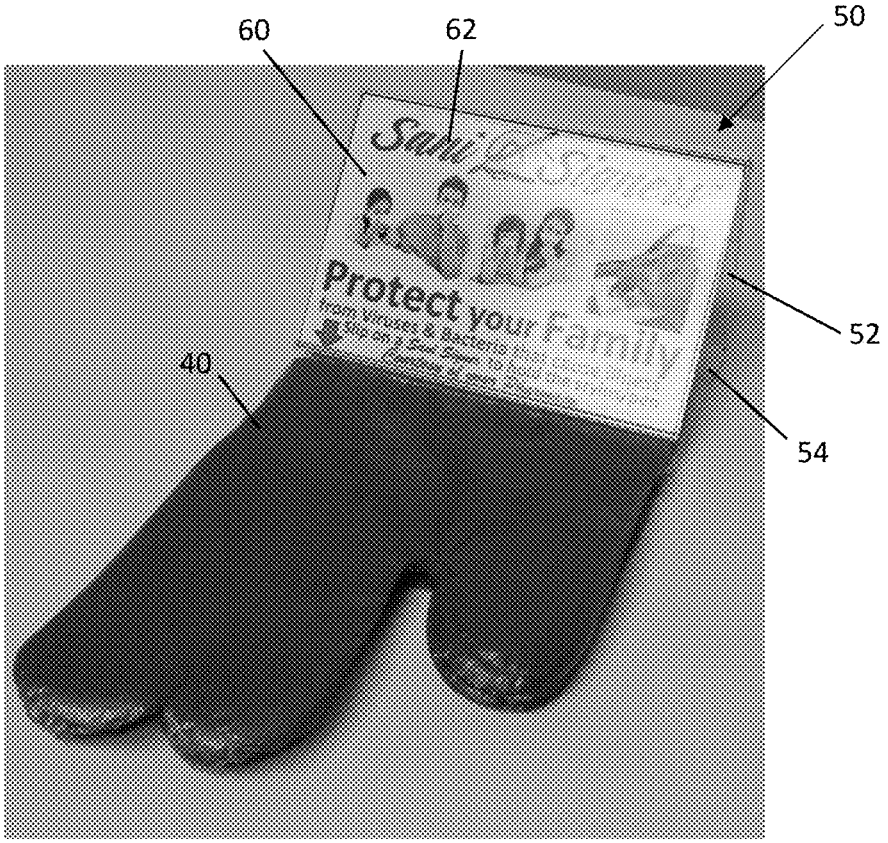
FIG. 48 is an overhead perspective view of a same-hand dispenser having a plurality of hand shields with a header card constructed according to one embodiment of the present inventions.
Figure 49:
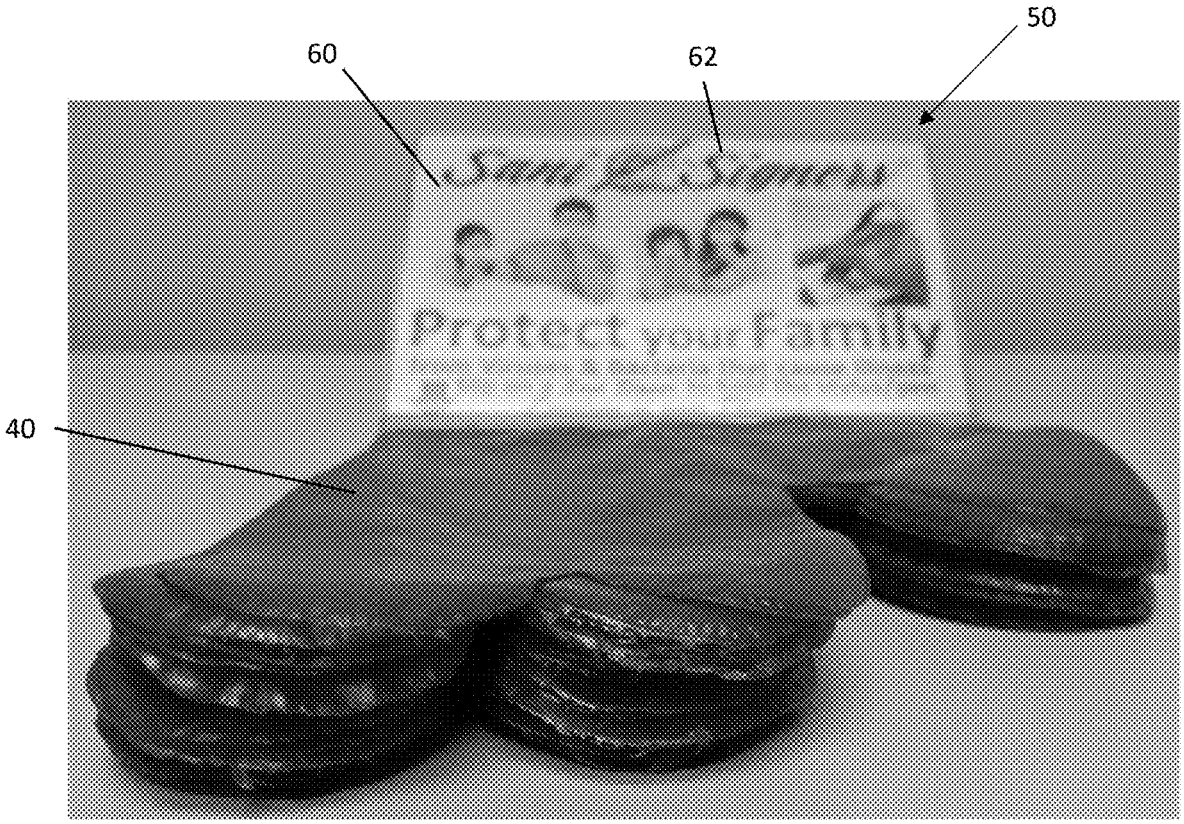
FIG. 49 is a front perspective view of the embodiment in FIG. 48.

As best seen in FIG. 47, some embodiments of hand shields may also include texturing 49 to prevent clinging of said hand shield to a user's hand. For example, the texturing may comprise an embossed pattern for increasing the tear resistance of the hand shield. In some instances, the embossing comprises dimpling.

Figure 50:
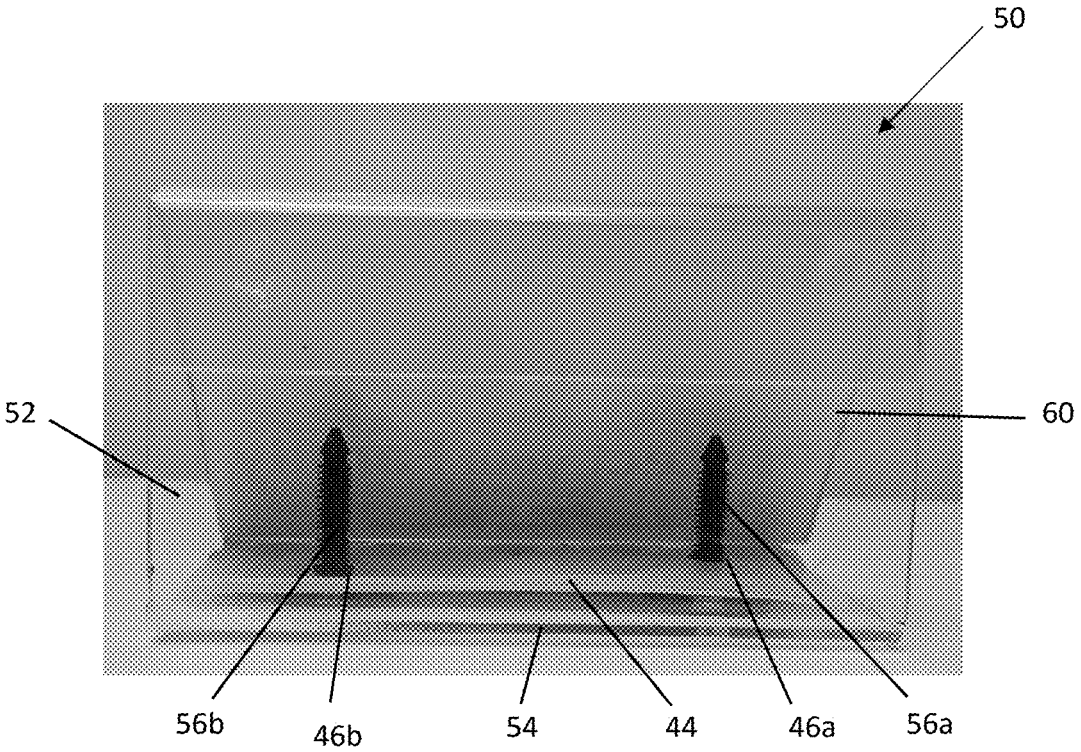
FIG. 50 is a back perspective view of the embodiment in FIG. 48.
Figure 51:
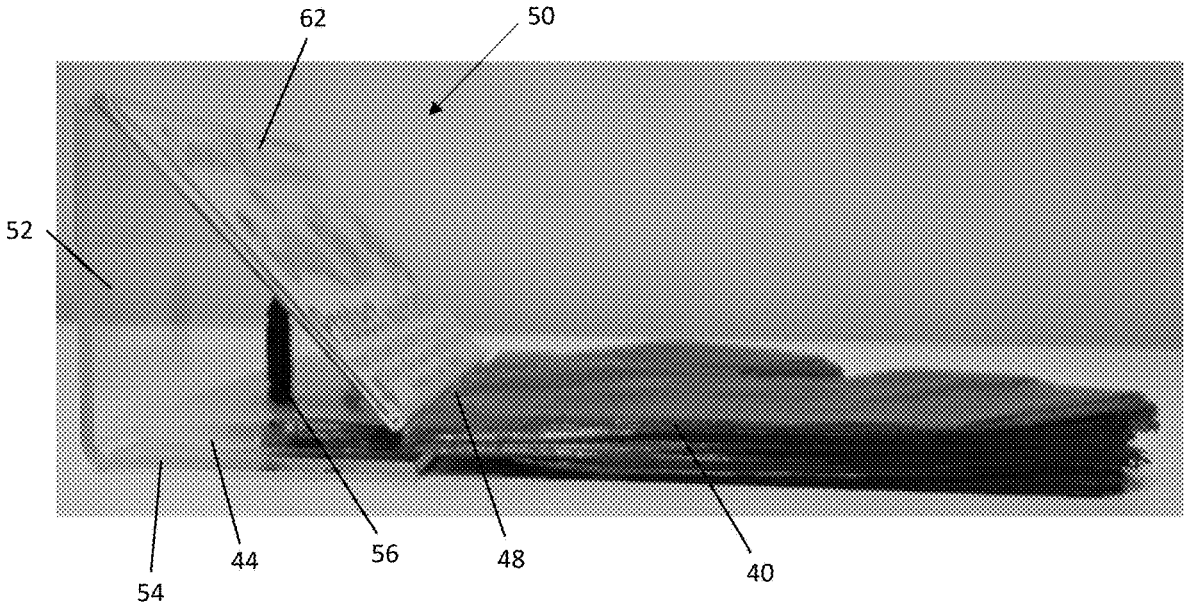
FIG. 51 is a left side perspective view of the embodiment in FIG. 48.
Figure 52:
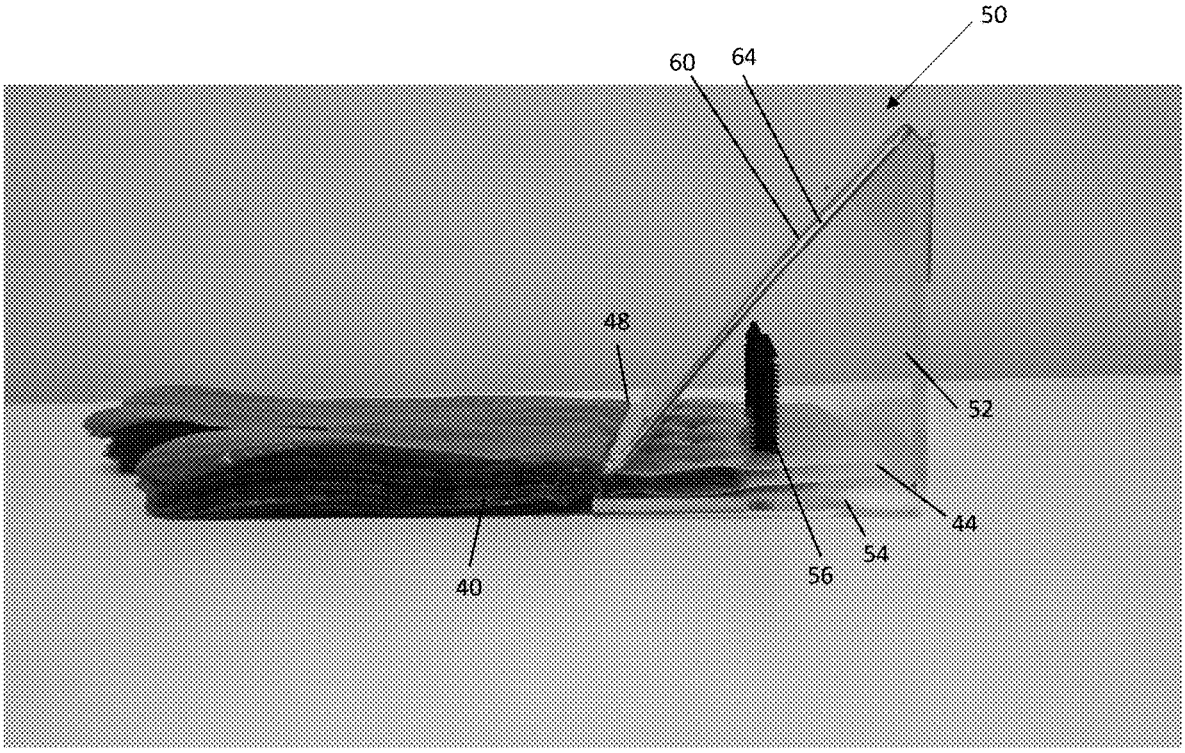
FIG. 52 is a right side perspective view of the embodiment in FIG. 48.
Figure 53:
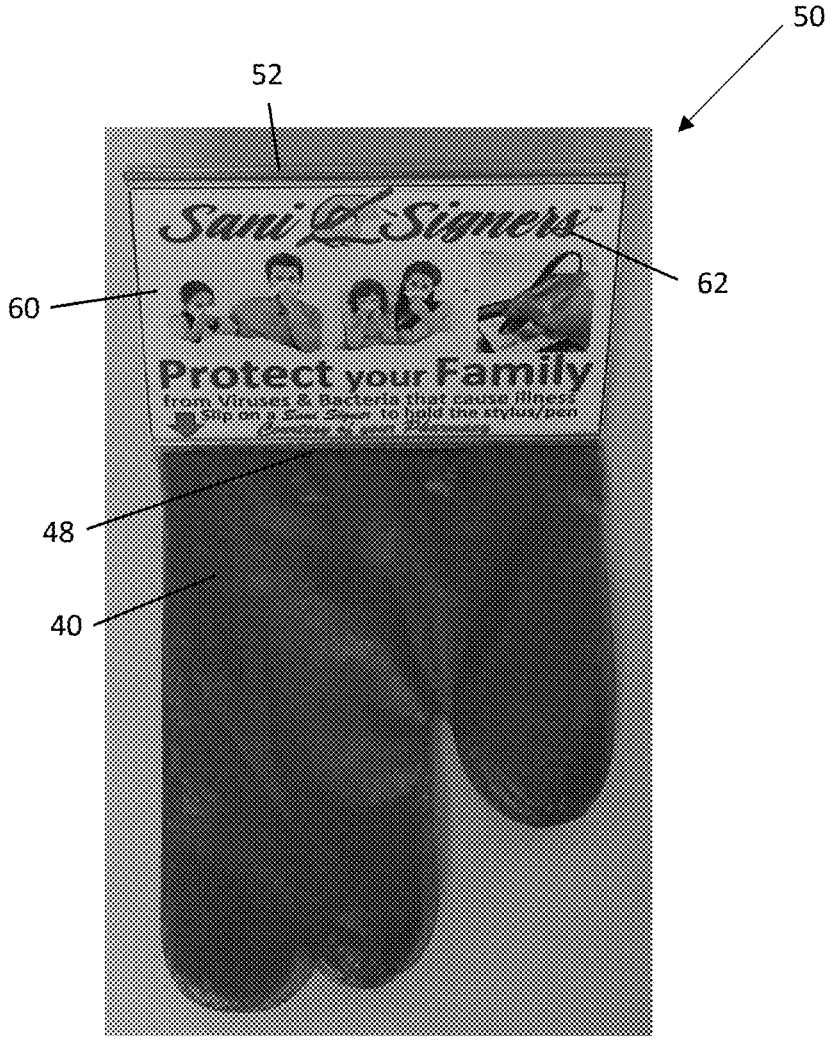
FIG. 53 is a top view of the embodiment in FIG. 48.
Figure 54:
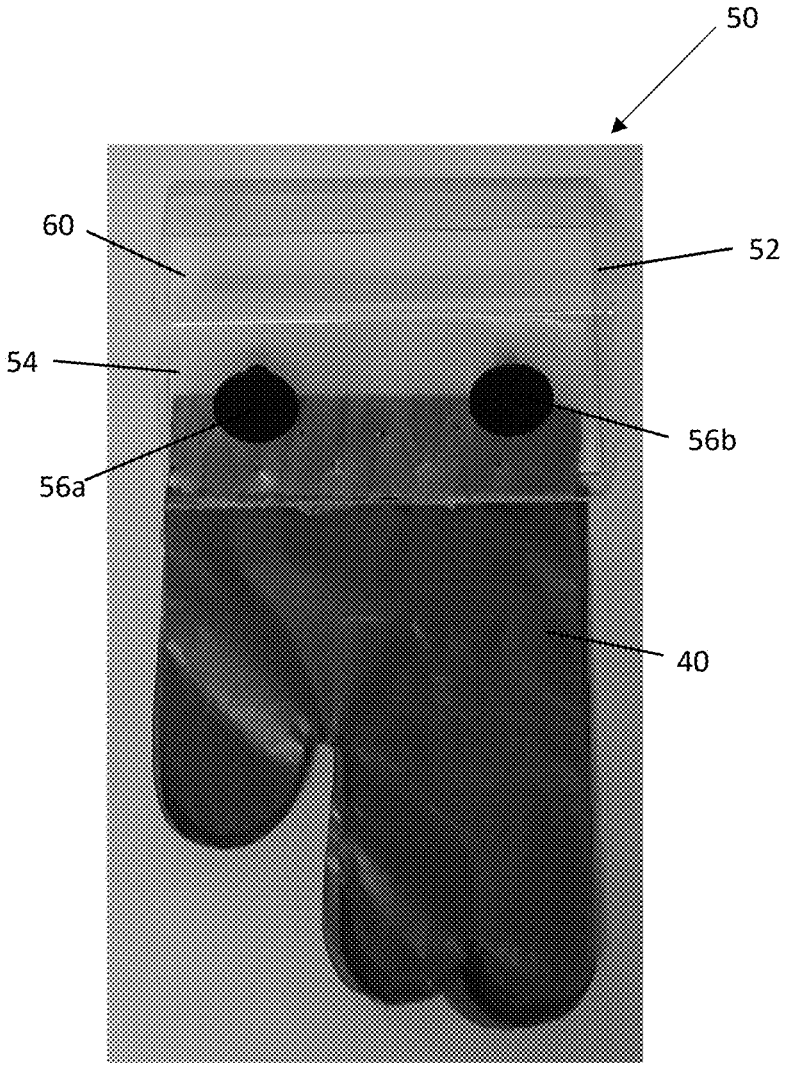
FIG. 54 is a bottom view of the embodiment in FIG. 48.

In operation, the hand shields disclosed herein are preferably dispensed in a manner that does not require the assistance of a second hand. Same-hand donning as the hand shield is dispensed is useful for quicker donning, easier accessibility, and reducing contamination of the hand shield. One example of a same-hand dispenser, generally designated 50, is shown in FIGS. 48-56. In the example shown, same-hand dispenser 50 includes an upper wall 52 supported by a base 54. Same-hand dispenser 50 includes one or more posts 56 to attach a plurality of hand shields 40 to the dispenser. As best seen in FIG. 50, same-hand dispenser 50 includes a first post 56*a* and a second post 56*b*. First post 56*a* and second post 56*b* are inserted through holes 46*a* and 46*b* on the overhang 44 of header 42, respectively.

Same-hand dispenser 50 may further include a header card 60. Header card 60 may be used to cover post 56. Header card 60 may also include indicia 62 for advertising information to others. Indicia 62 may be displayed on header card 60 through various means. For instance, header card 60 may comprise a transparent material and include a slot for inserting a panel 64 through the slot. Panel 64 may be displayed through header card 60. In other embodiments, header card 60 may comprise a single-piece material with indicia 62. In another embodiment, indicia 62 may be adhered onto header card 60. In alternative embodiments, indicia 62 may be electronically displayed on header card 60. For example, indicia 62 may comprise a series of LEDs. In another example, header card 60 may include a LCD display for displaying indicia 62.

Figure 55:
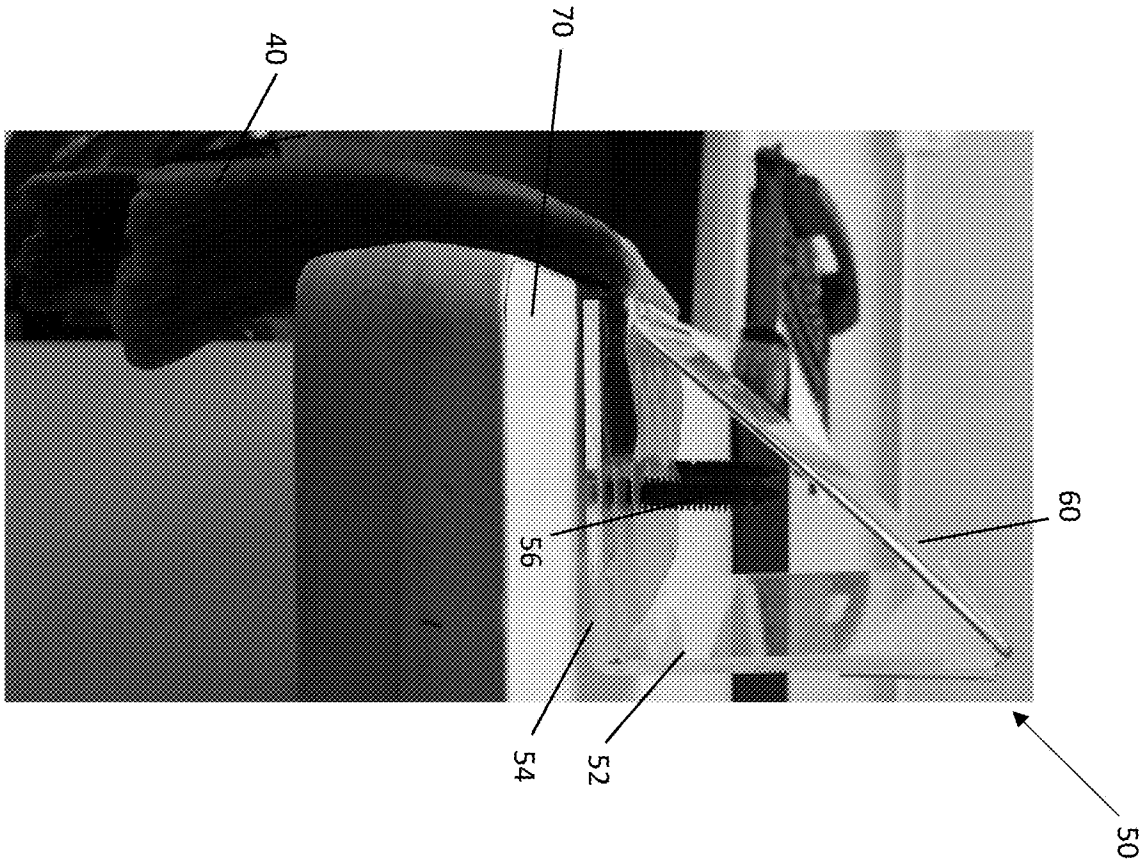
FIG. 55 is a right side perspective view of the embodiment in FIG. 48 wherein the same-hand dispenser is placed on a ledge.
Figure 56:
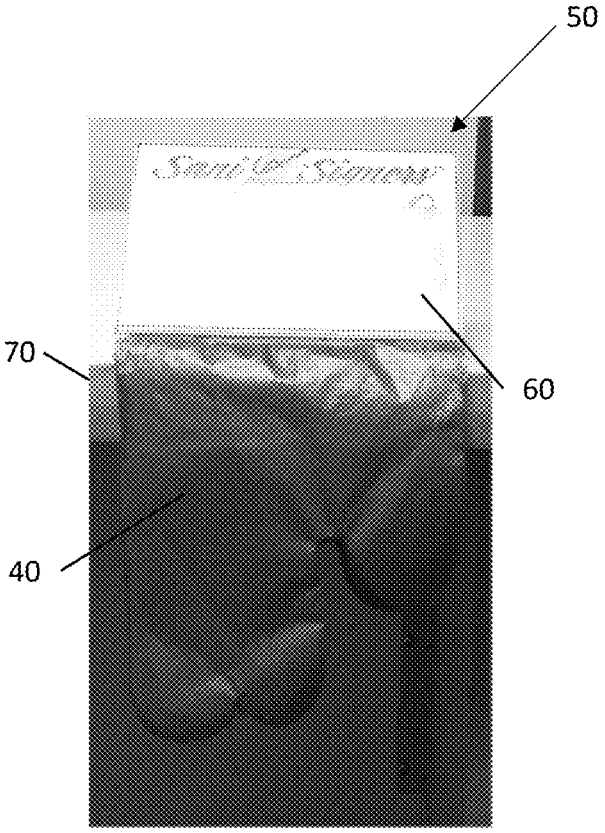
FIG. 56 is a front side perspective view of the embodiment in FIG. 48 wherein the same-hand dispenser is placed on a ledge.
Figure 57:
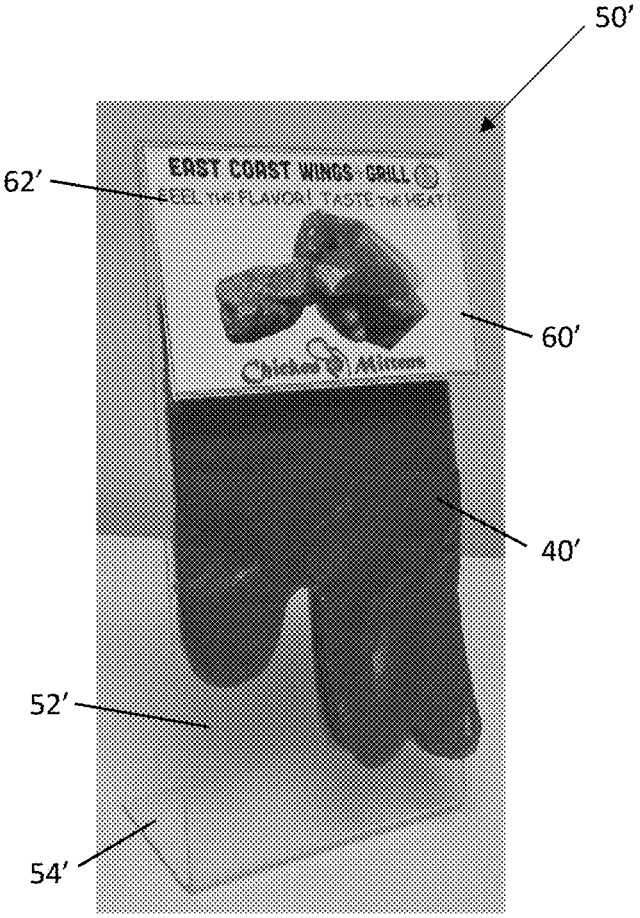
FIG. 57 is an overhead perspective view of a same-hand dispenser having a plurality of hand shields with a header card constructed according to another embodiment of the present inventions.
Figure 58:
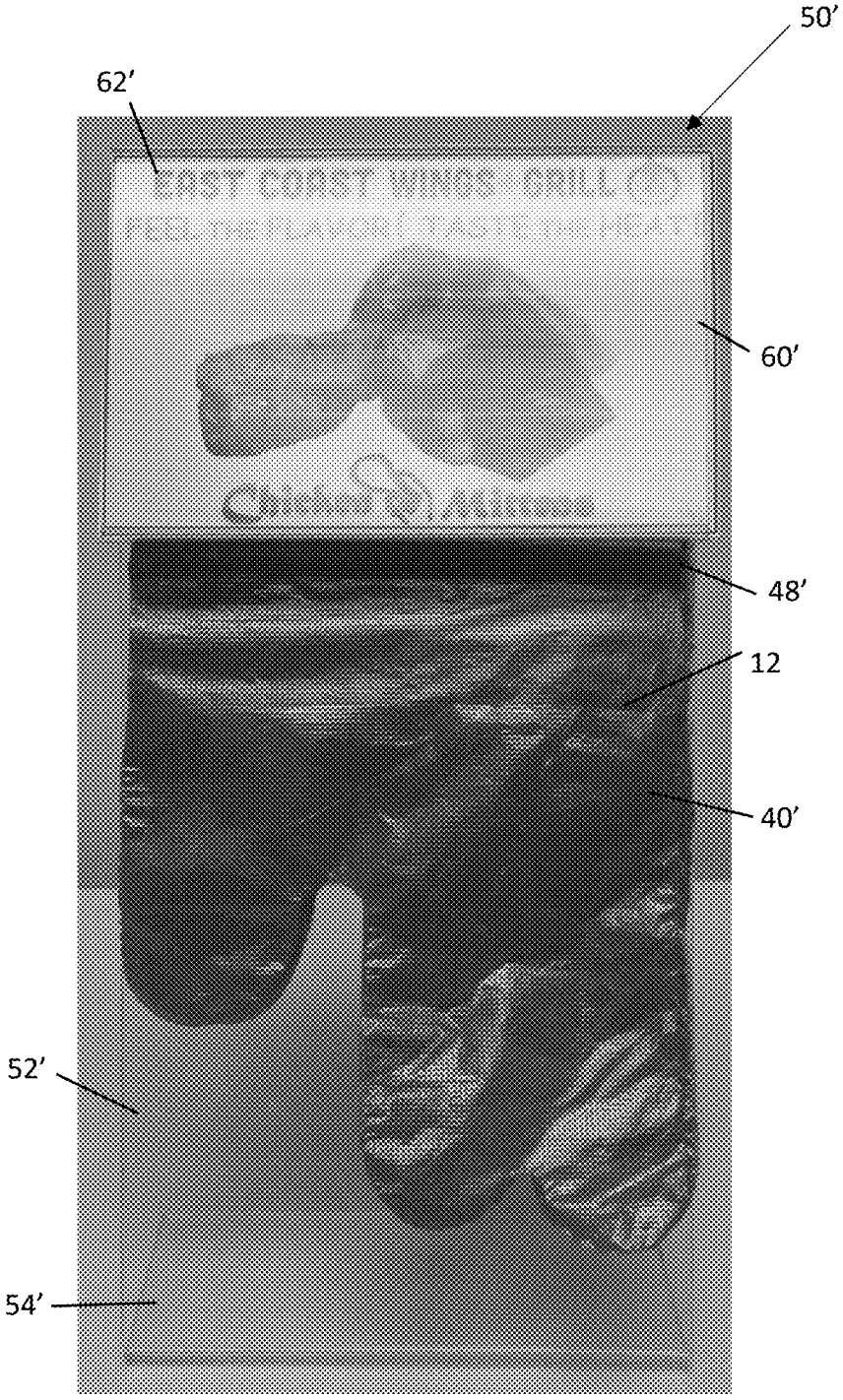
FIG. 58 is a front perspective view of the embodiment in FIG. 57.

As seen in FIGS. 55 and 56, same-hand dispenser 50 may be placed onto a ledge such that the plurality of hand shields 40 are oriented vertically for dispensing. In use, a hand shield may be quickly dispensed by a user inserting a hand into the hand shield and exerting a downward force with the same hand until perforation 48 is broken. The hand shield may be removed after use by simply flicking the wrist so that the hand shield falls off.

Figure 59:
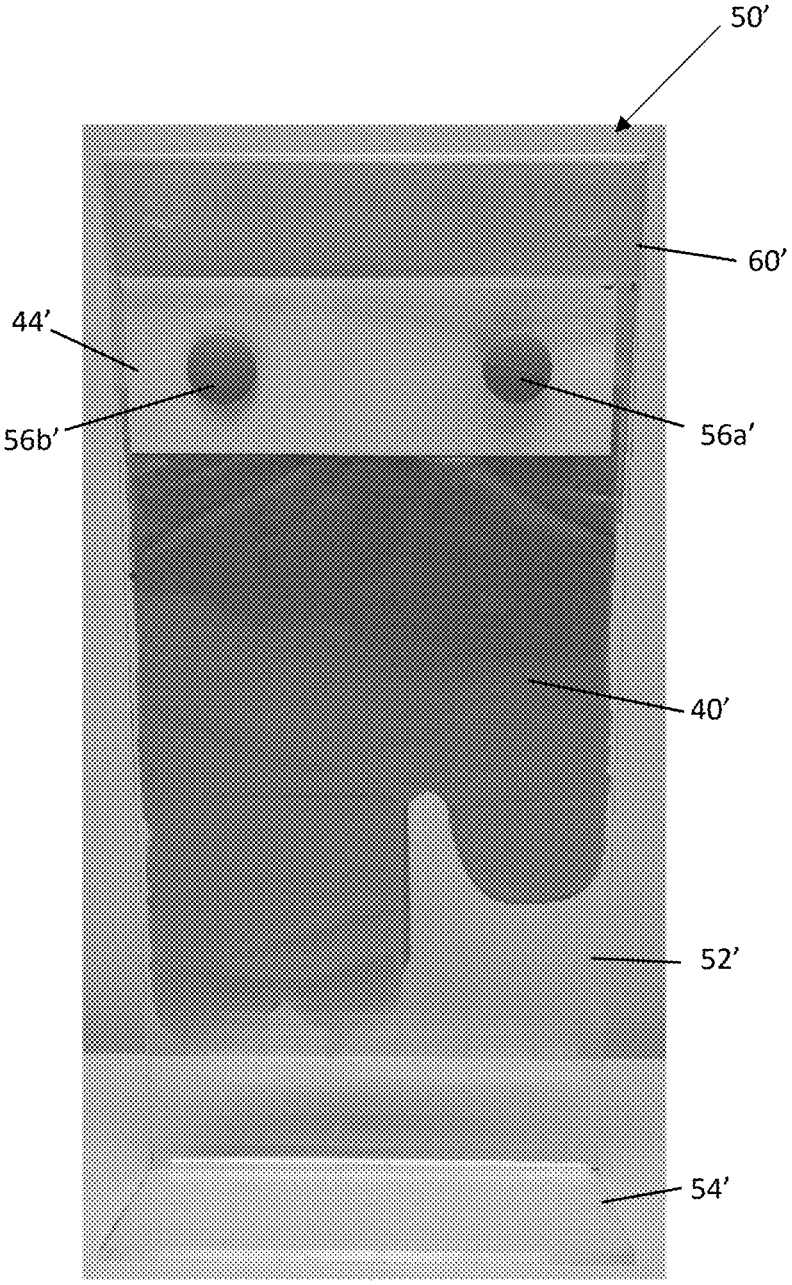
FIG. 59 is a back perspective view of the embodiment in FIG. 57.
Figure 60:
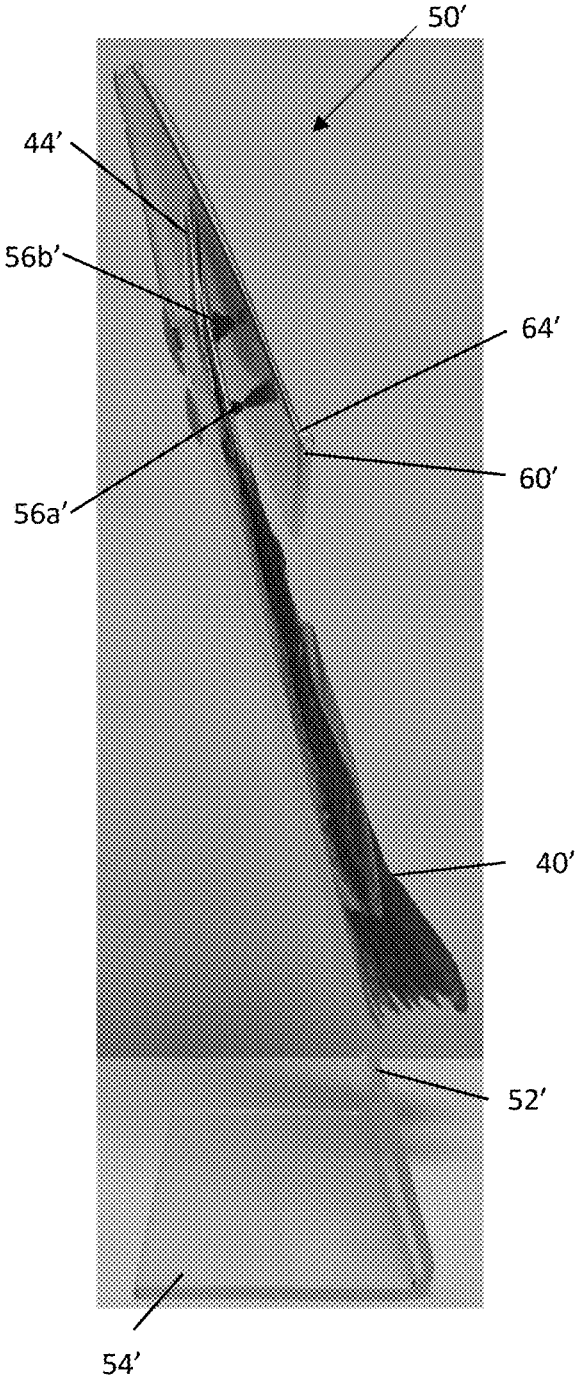
FIG. 60 is a left side perspective view of the embodiment in FIG. 57.
Figure 61:
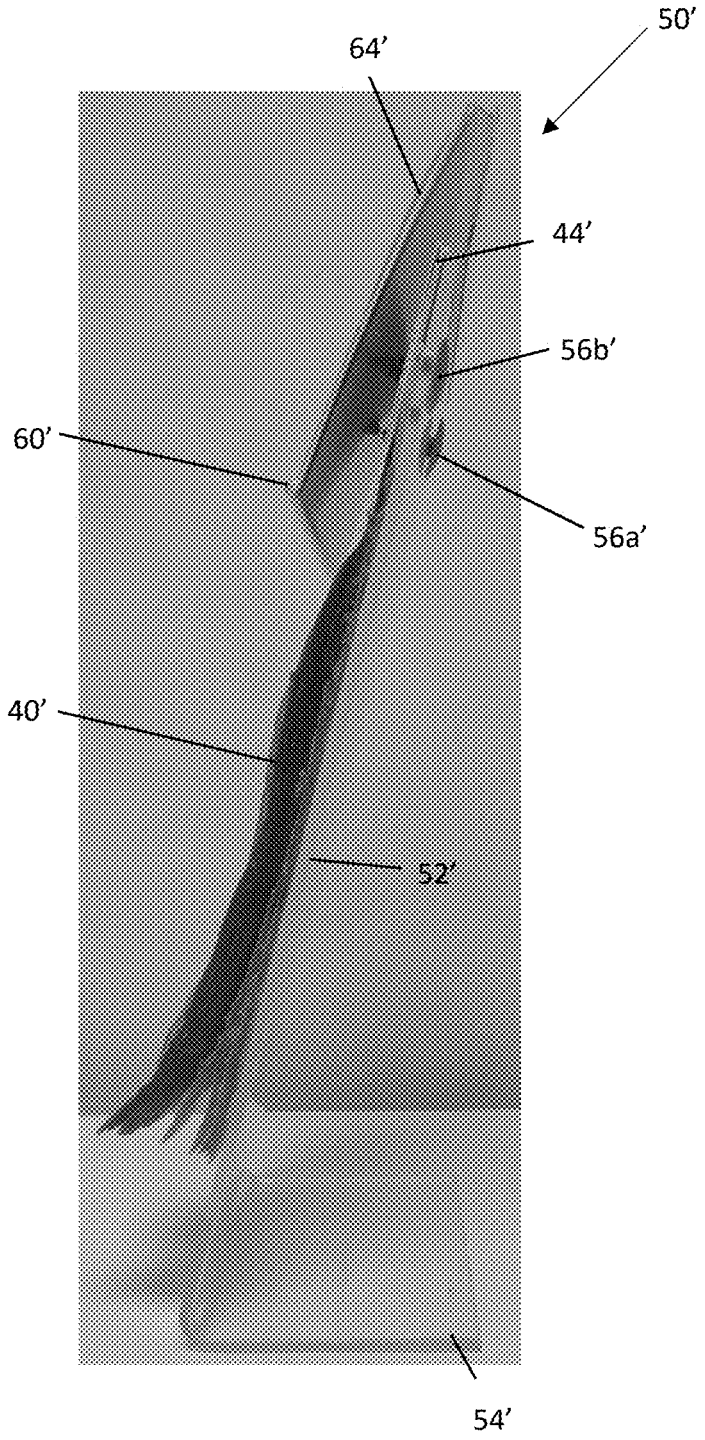
FIG. 61 is a right side perspective view of the embodiment in FIG. 71.
Figure 62:
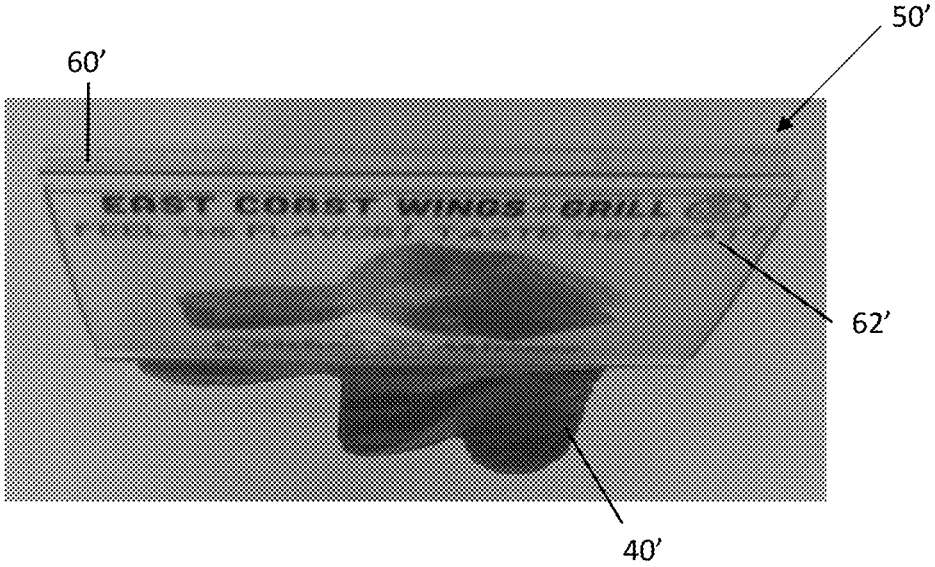
FIG. 62 is a top view of the embodiment in FIG. 57.
Figure 63:
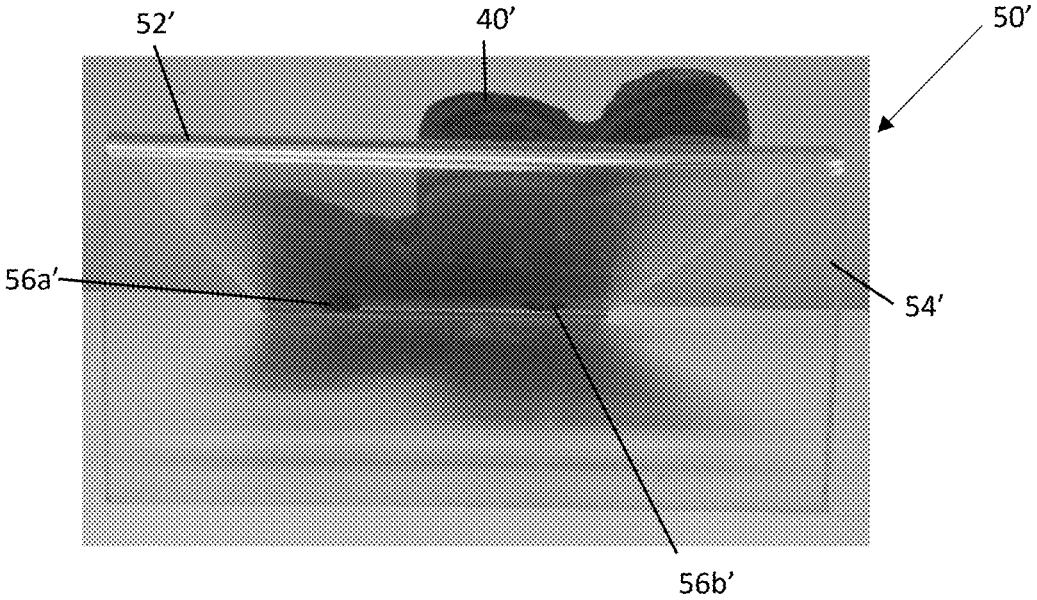
FIG. 63 is a bottom view of the embodiment in FIG. 57.
Figure 64:
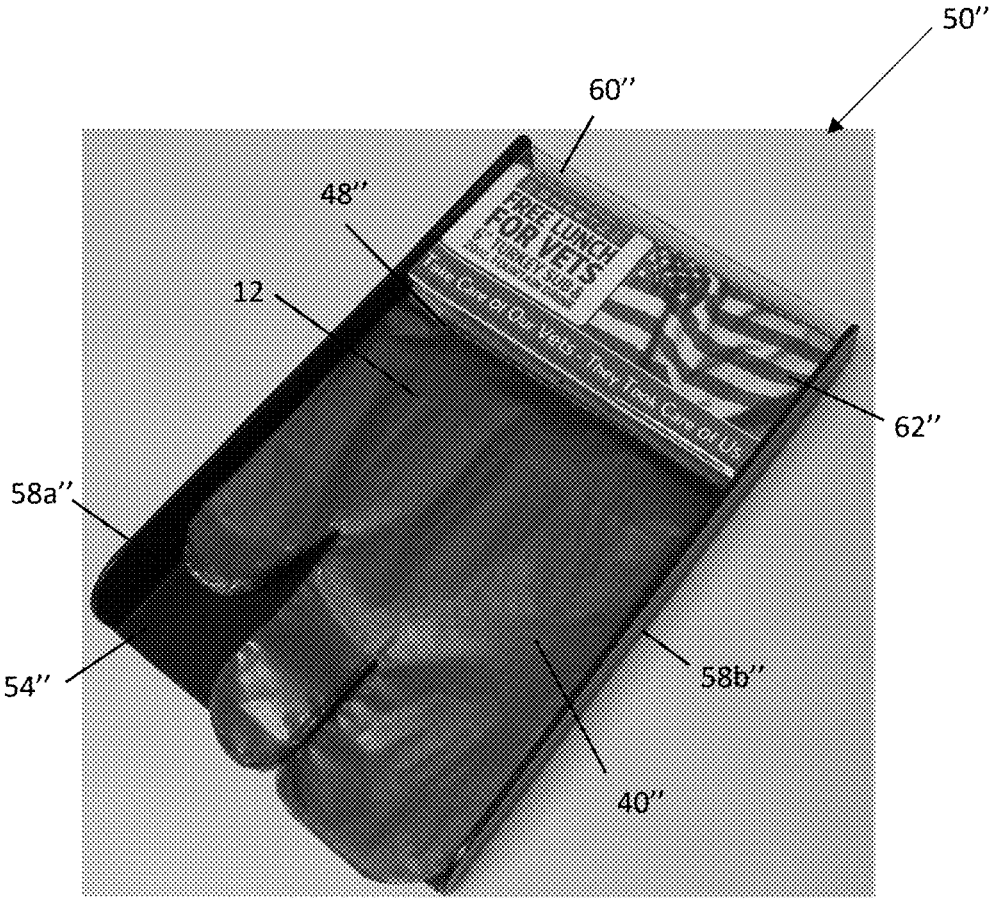
FIG. 64 is an overhead perspective view of a same-hand dispenser having a plurality of hand shields with a header card constructed according to another embodiment of the present inventions.

Another example of a same-hand dispenser, generally designated 50', is shown in FIGS. 57-63. In the example shown, same-hand dispenser 50' includes an upper wall 52' supported by a base 54'. Same-hand dispenser 50' includes one or more posts 56' to attach a plurality of hand shields 40' to the dispenser. As best seen in FIGS. 59 and 60, same-hand dispenser 50' includes a first post 56*a*' and a second post 56*b*'. First post 56*a*' and second post 56*b*' are inserted through holes 46*a* and 46*b* on the overhang 44 of header 42, respectively. In use, a hand shield may be quickly dispensed by a user inserting a hand into the hand shield and exerting a downward force with the same hand until perforation 48' is broken. The hand shield may be removed after use by simply flicking the wrist so that the hand shield falls off.

Same-hand dispenser 50' may further include a header card 60'. Header card 60' may be used to cover post 56'. Header card 60' may also include indicia 62' for advertising information to others. Indicia 62' may be displayed on header card 60' through various means. For instance, header card 60' may comprise a transparent material and include a slot for inserting a panel 64' through the slot. Panel 64' may be displayed through header card 60'. In other embodiments, header card 60' may comprise a single-piece material with indicia 62'. In another embodiment, indicia 62' may be adhered onto header card 60'. In alternative embodiments, indicia 62' may be electronically displayed on header card 60'. For example, indicia 62' may comprise a series of LEDs. In another example, header card 60' may include a LCD display for displaying indicia 62'.

Figure 65:
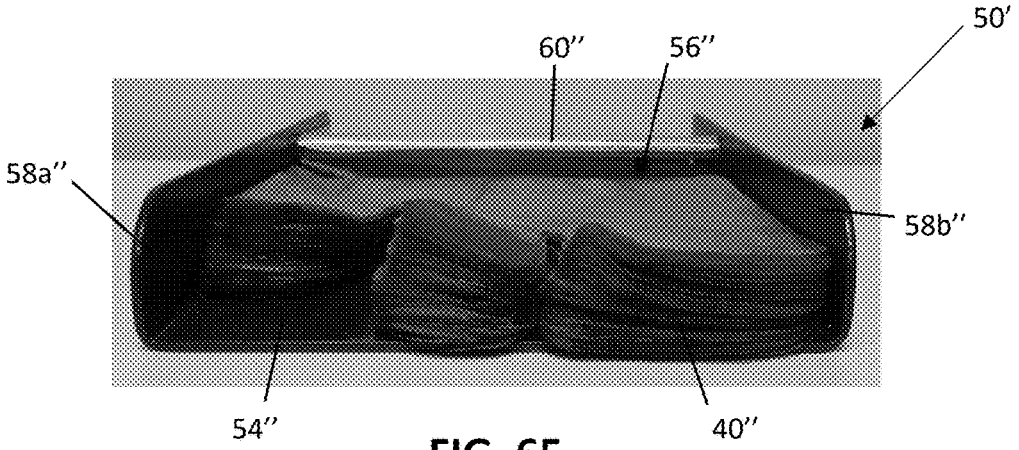
FIG. 65 is a bottom perspective view of the embodiment in FIG. 64.
Figure 66:
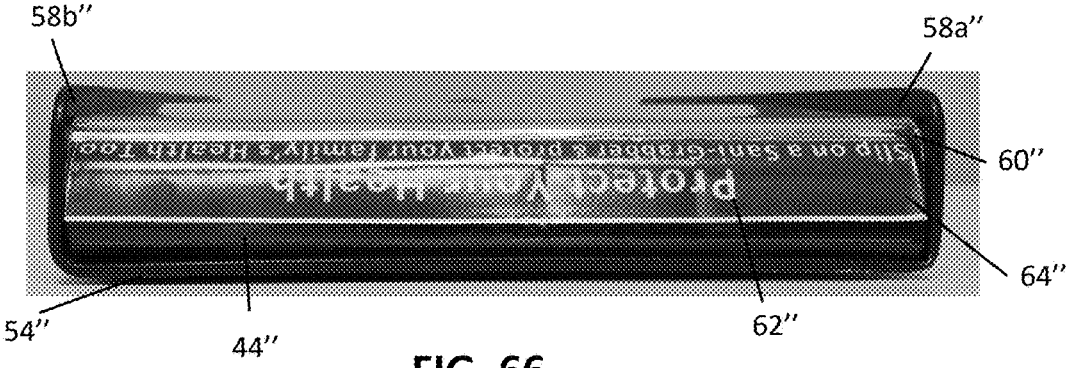
FIG. 66 is a top perspective view of the embodiment in FIG. 64.
Figure 67:
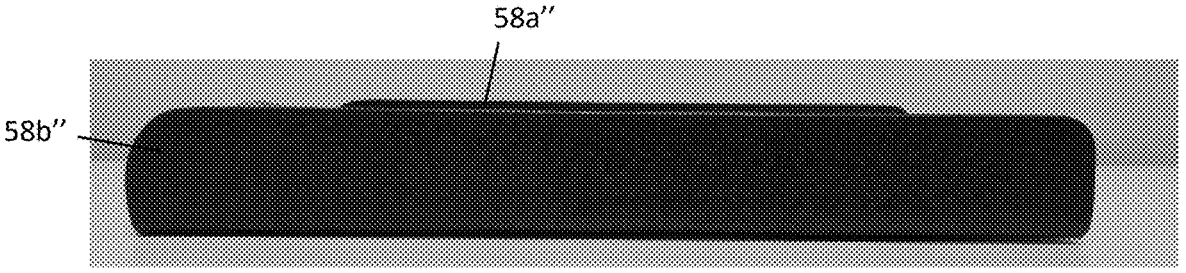
FIG. 67 is a left side perspective view of the embodiment in FIG. 64, wherein the opposing side is a mirror image thereof.
Figure 68:
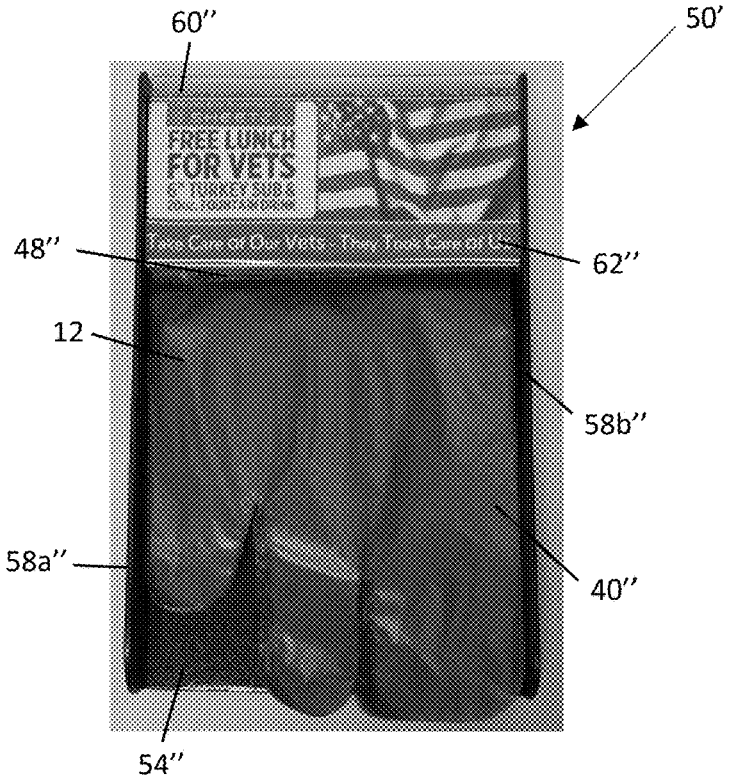
FIG. 68 is a front view of the embodiment in FIG. 64.
Figure 69:
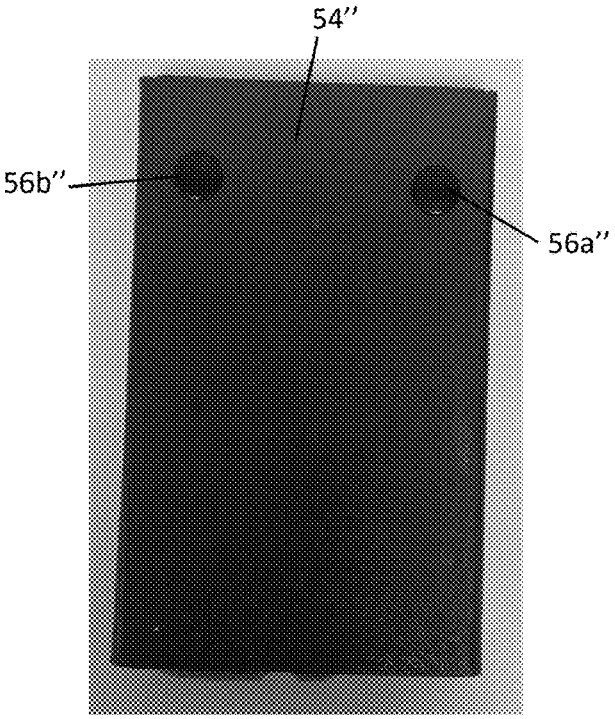
FIG. 69 is a back view of the embodiment in FIG. 64.

Another example of a same-hand dispenser, generally designated 50", is shown in FIGS. 64-69. In the example shown, same-hand dispenser 50" includes an upper wall 52" and side walls 58*a*" and 58*b*" supported by a base 54". As seen in FIGS. 65 and 69, same-hand dispenser 50" includes one or more posts 56" to attach a plurality of hand shields 40" to the dispenser. In use, a hand shield may be quickly dispensed by a user inserting a hand into the hand shield and exerting a downward force with the same hand until perforation 48" is broken. The hand shield may be removed after use by simply flicking the wrist so that the hand shield falls off.

Same-hand dispenser 50" may further include a header card 60". Header card 60" may be used to cover post 56". Header card 60" may also include indicia 62" for advertising information to others. Indicia 62" may be displayed on header card 60" through various means. For instance, header card 60" may comprise a transparent material and include a slot for inserting a panel 64" through the slot. Panel 64" may be displayed through header card 60". In other embodiments, header card 60" may comprise a single-piece material with indicia 62". In another embodiment, indicia 62" may be adhered onto header card 60". In alternative embodiments, indicia 62" may be electronically displayed on header card 60". For example, indicia 62" may comprise a series of LEDs. In another example, header card 60" may include a LCD display for displaying indicia 62".

Figure 70:
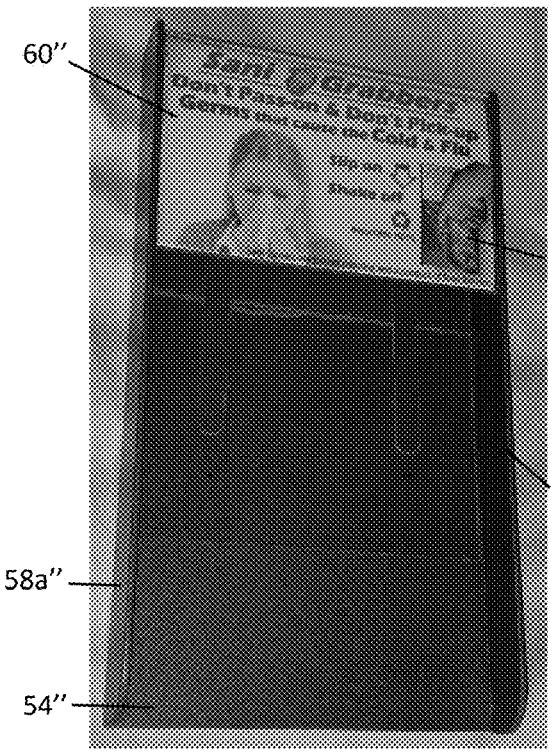
FIG. 70 is an overhead perspective view of a same-hand dispenser with a header card constructed according to another embodiment of the present inventions.
Figure 71:
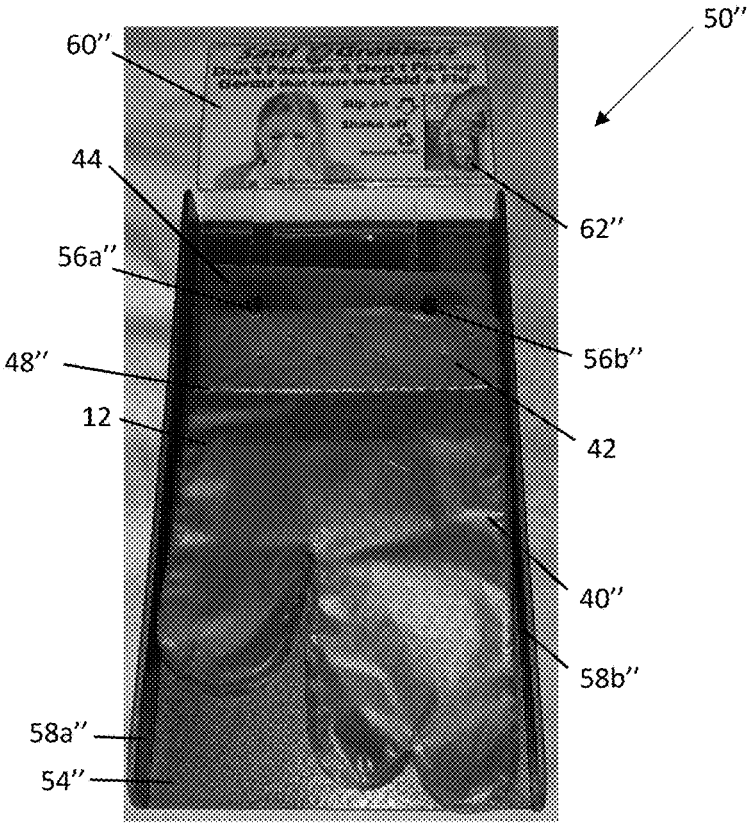
FIG. 71 is an overhead perspective view of the embodiment in FIG. 70 with the header card in an extended position.
Figure 72:
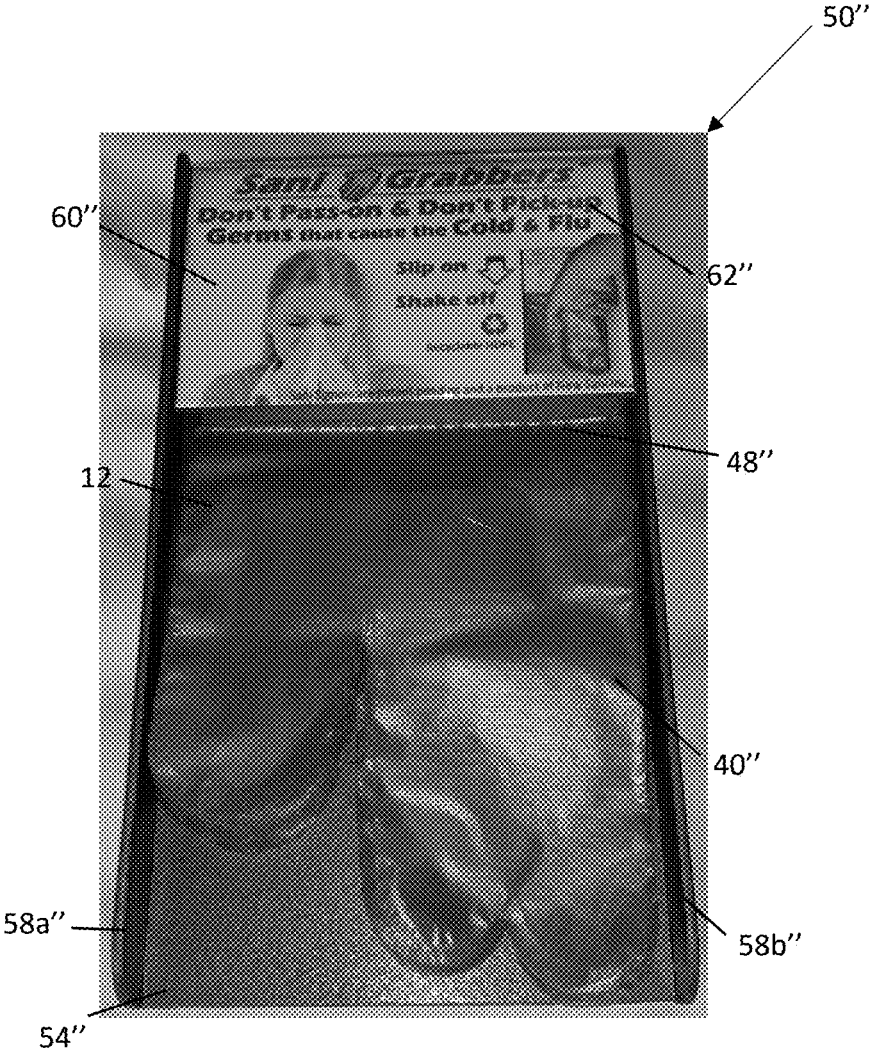
FIG. 72 is an overhead perspective view of the embodiment in FIG. 70 having a plurality of hand shields and with the header card in a covered position.

FIGS. 70-72 illustrate an example of adding a plurality of hand shields 40" to same-hand dispenser 50" for use. FIG. 70 depicts an empty same-hand dispenser 50". As seen in FIG. 71, header card 60" may extend up to expose posts 56"*a* and 56"*b*. Posts 56"*a* and 56"*b* are then inserted into holes 46*a* and 46*b* of overhang 44 to secure the plurality of hand shields 40 to a dispenser. Once the plurality of hand shields 40 are secured, header card 60" may be returned to its covered position to hide posts 56"*a* and 56"*b*, as shown in FIG. 72.

Figure 73:
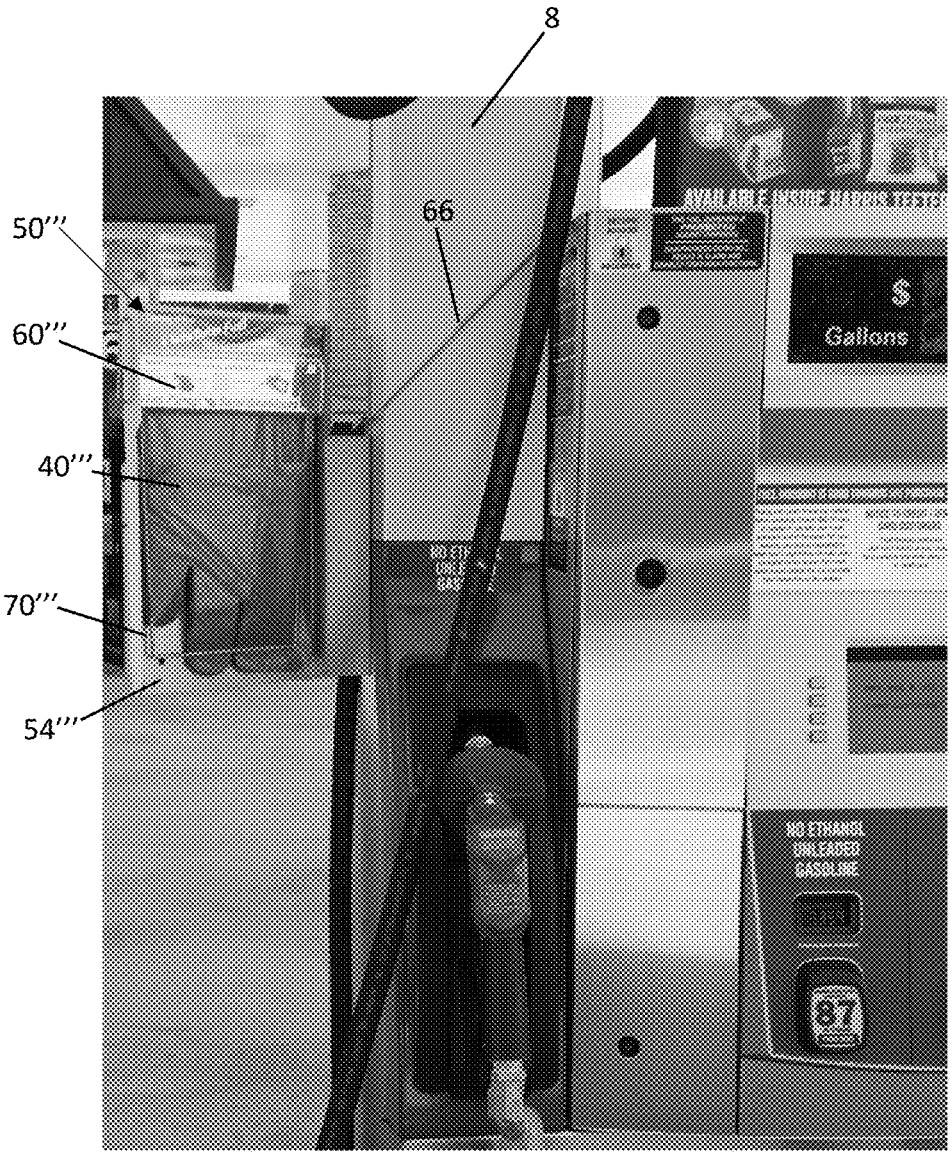
FIG. 73 is a front perspective view of one embodiment of a same-hand dispenser mounted onto a gas pump.
Figure 74:
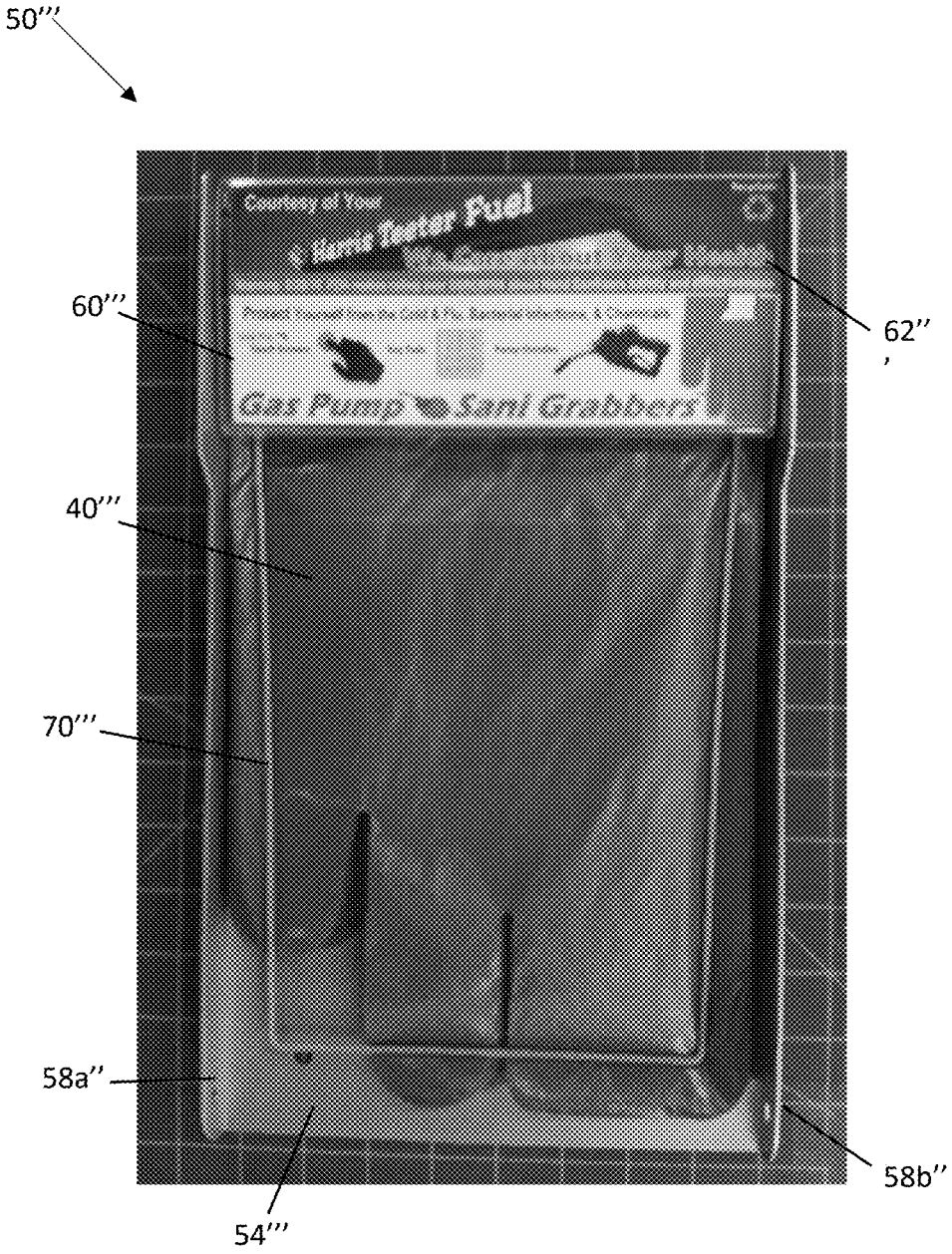
FIG. 74 is a front perspective view of a same-hand dispenser with a wind guard and a plurality of hand shields according to one embodiment of the present inventions.
Figure 75:
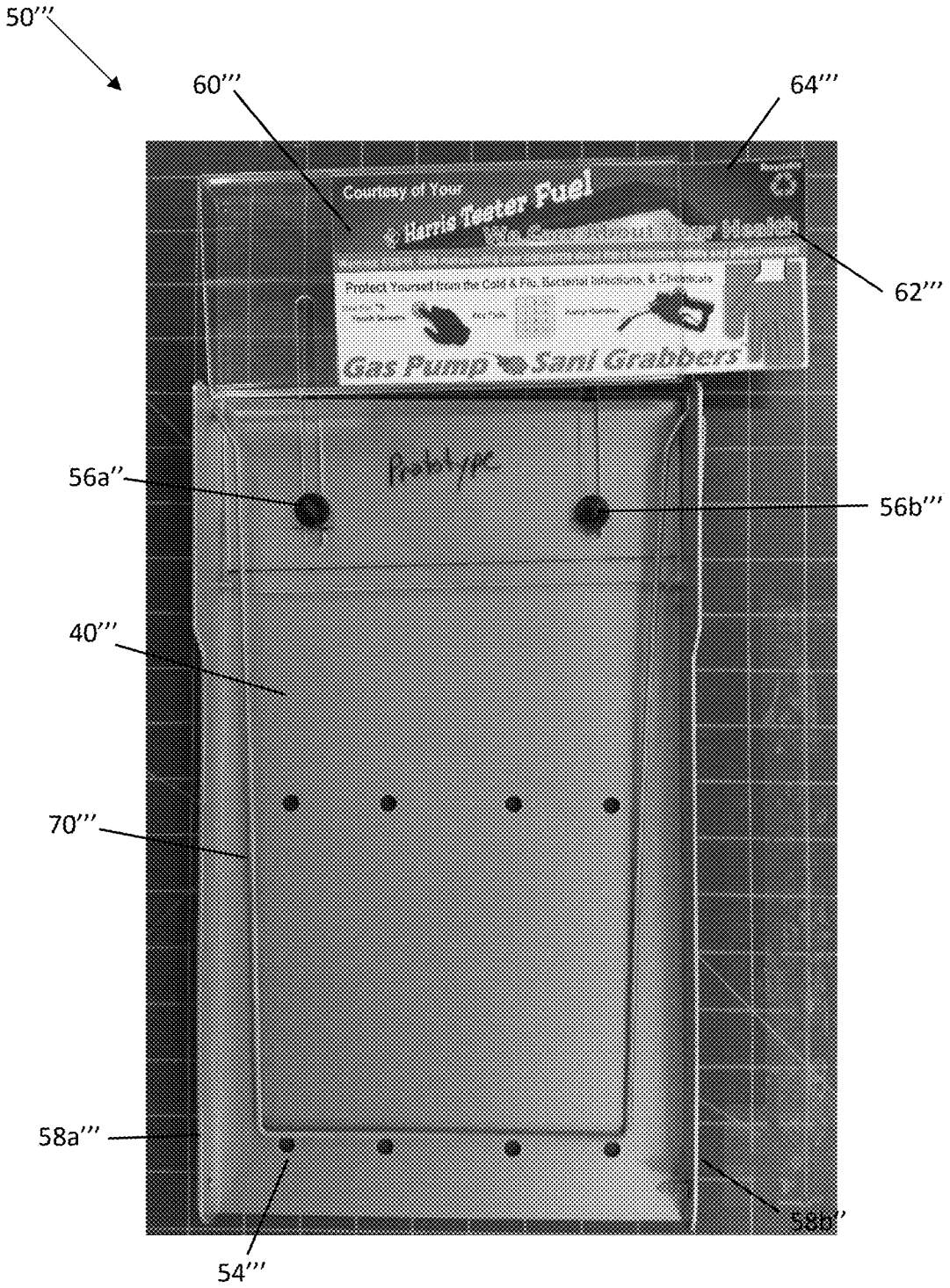
FIG. 75 is a front perspective view of the same-hand dispenser in FIG. 74.

Another example of a same-hand dispenser, generally designated 50''', is shown in FIGS. 73-77. In the example shown, same-hand dispenser 50''' comprises a base 54''' and side walls 58*a*''' and 58*b*'''. As seen in FIG. 75, same-hand dispenser 50''' includes one or more posts 56''' to attach a plurality of hand shields 40''' to the dispenser. In use, a hand shield may be quickly dispensed by a user inserting a hand into the hand shield and exerting a downward force with the same hand until perforation 48''' is broken. For example, FIG. 73 shows an embodiment of a same-hand dispenser 50''' mounted onto a post 8 at a gas station using a mount 66. The hand shield may be removed after use by simply flicking the wrist so that the hand shield falls off.

Same-hand dispenser 50''' may further include a header card 60". Header card 60''' may be used to cover post 56'''. Header card 60''' may also include indicia 62''' for advertising information to others. Indicia 62''' may be displayed on header card 60''' through various means. For instance, header card 60''' may comprise a transparent material and include a slot for inserting a panel 64''' through the slot. Panel 64''' may be displayed through header card 60'''. In other embodiments, header card 60" may comprise a single-piece material with indicia 62'''. In another embodiment, indicia 62''' may be adhered onto header card 60'''. In alternative embodiments, indicia 62''' may be electronically displayed on header card 60'''. For example, indicia 62''' may comprise a series of LEDs. In another example, header card 60''' may include a LCD display for displaying indicia 62'''.

Figure 76:
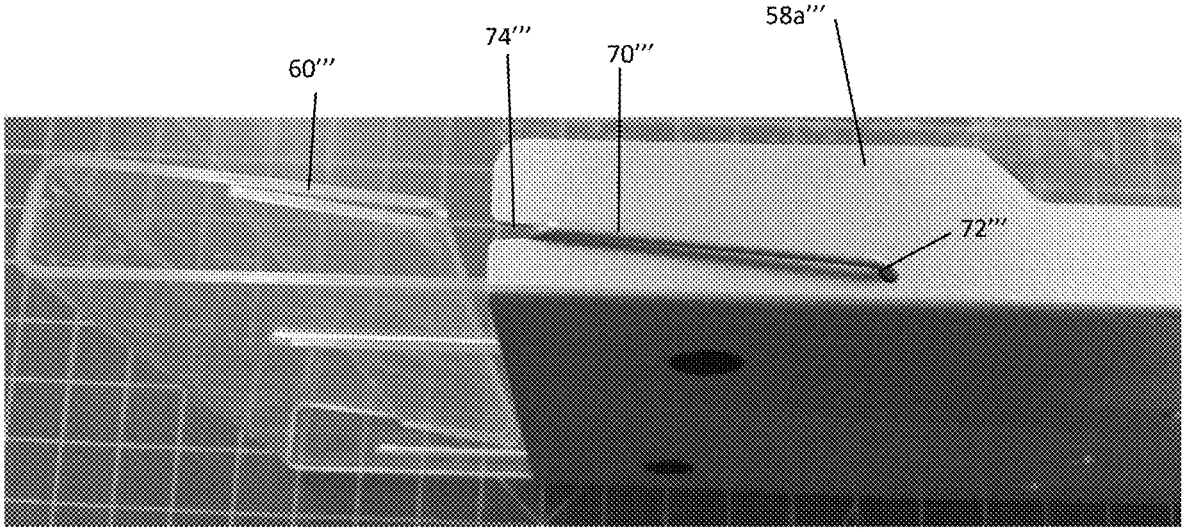
FIG. 76 is an enlarged side perspective view of the embodiment in FIG. 74.
Figure 77:
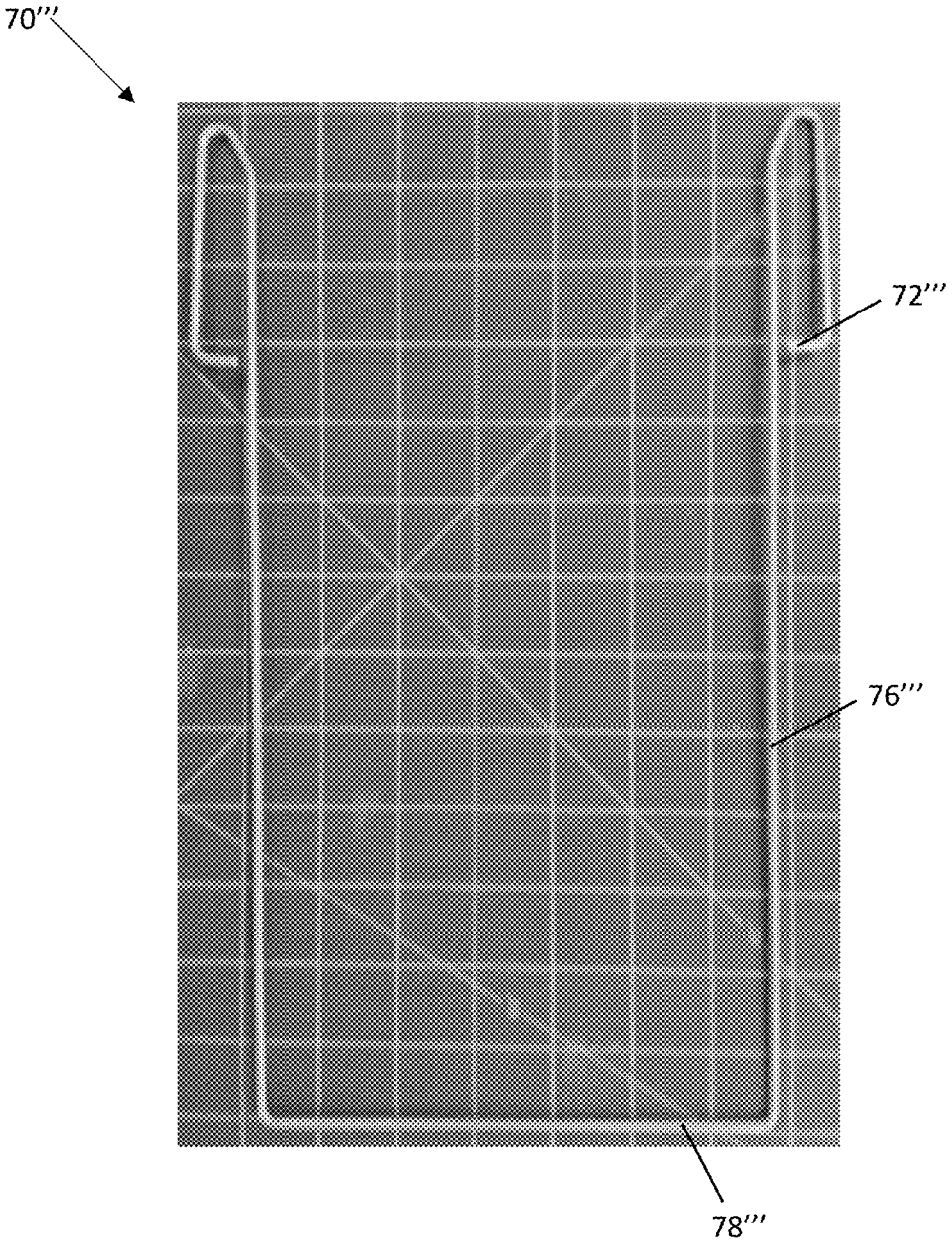
FIG. 77 is a front elevational view of a wind guard according to one embodiment of the present inventions.
Figure 78:
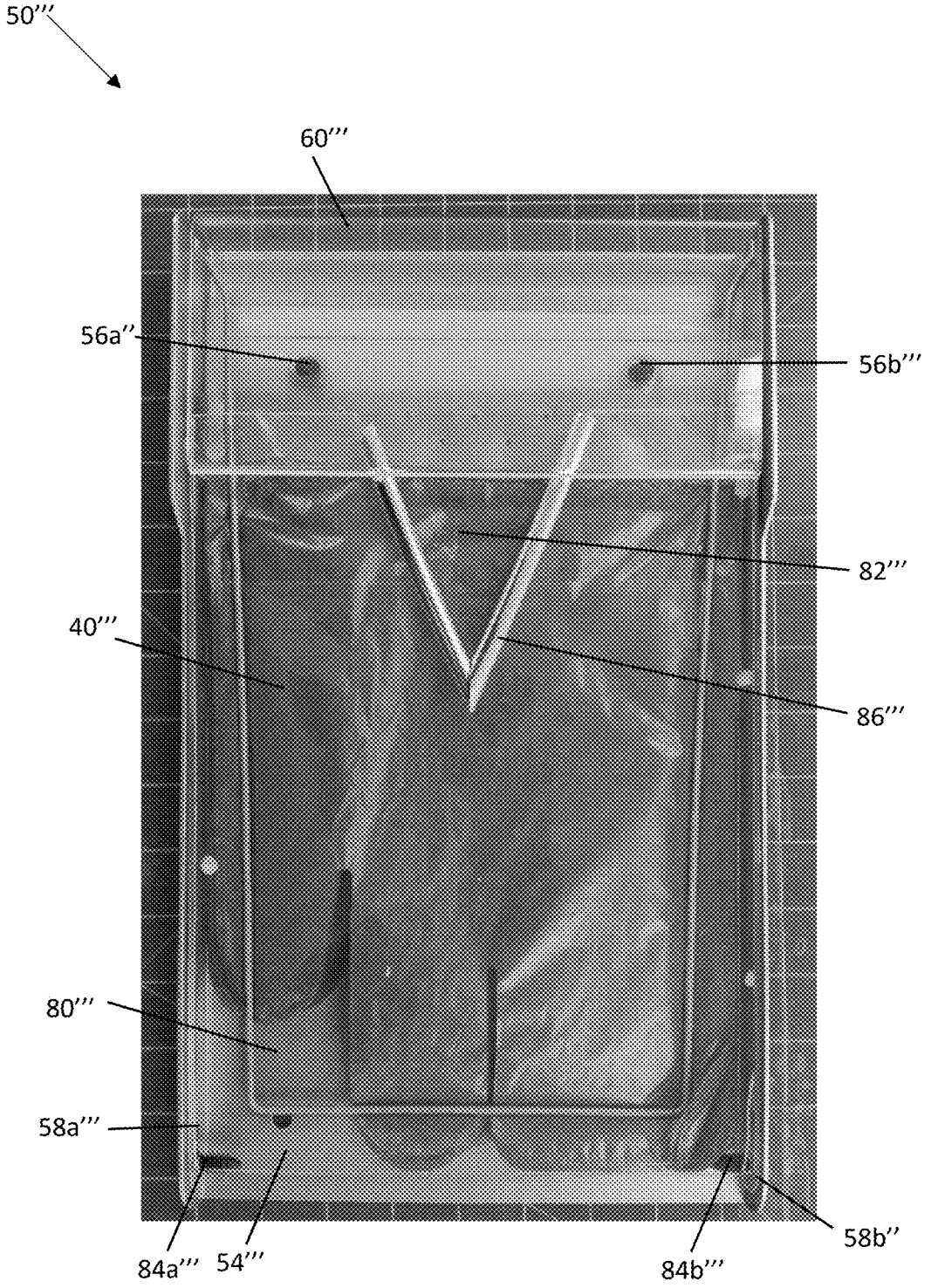
FIG. 78 is a front elevational view of a dispenser having a wind guard according to another embodiment of the present inventions.
Figure 79:
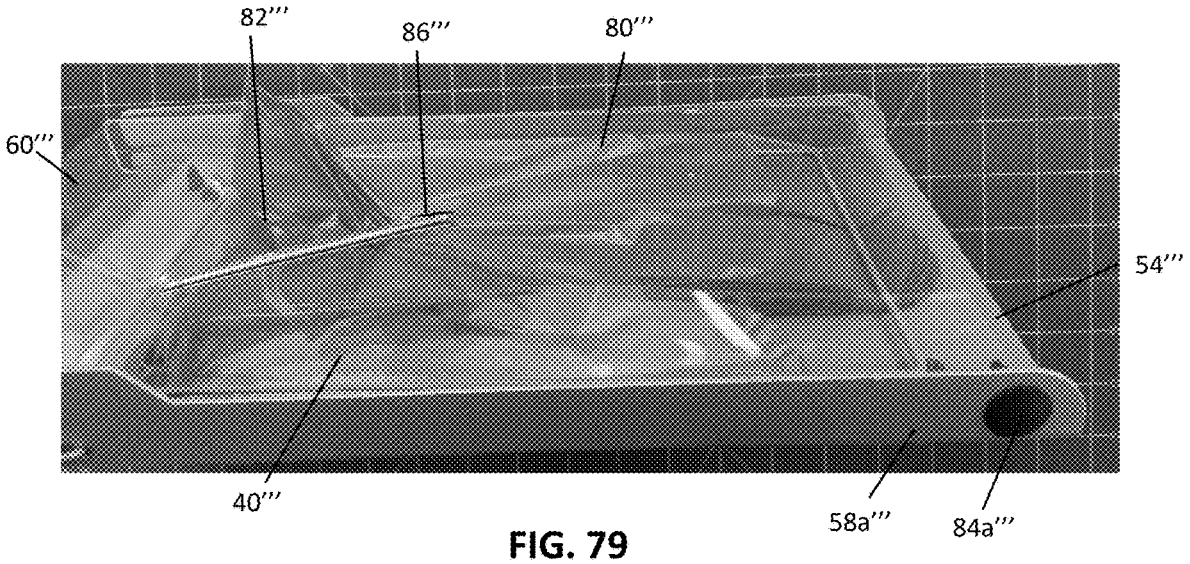
FIG. 79 is a side perspective view of the embodiment in FIG. 78.
Figure 80:
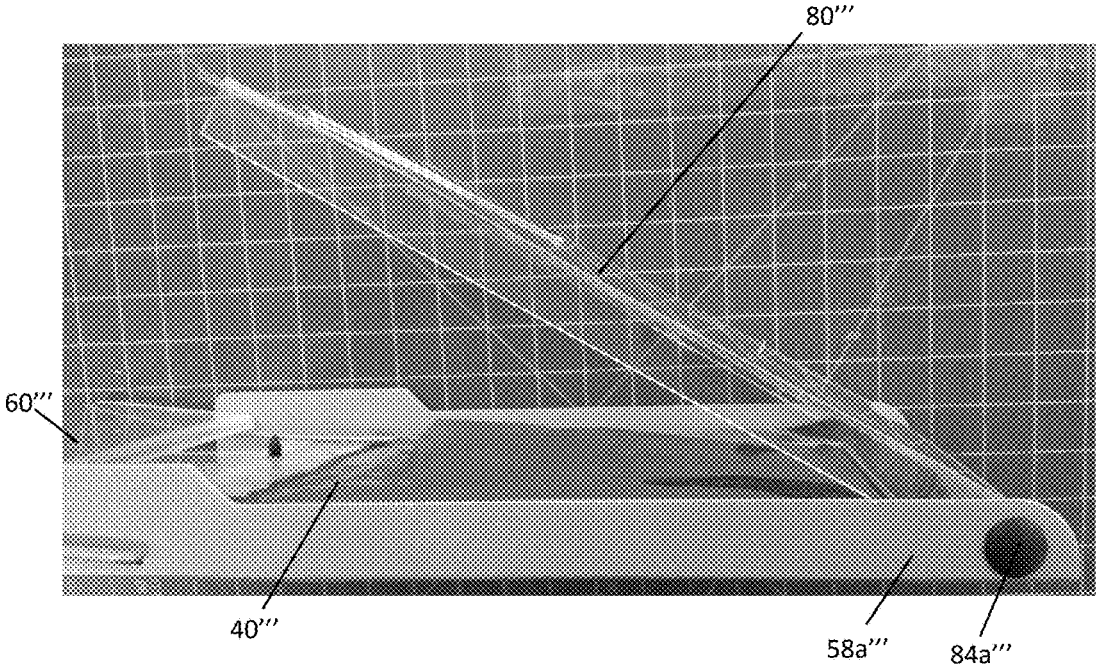
FIG. 80 is a side perspective view of the embodiment in FIG. 78 with the wind guard in a partially open configuration.
Figure 81:
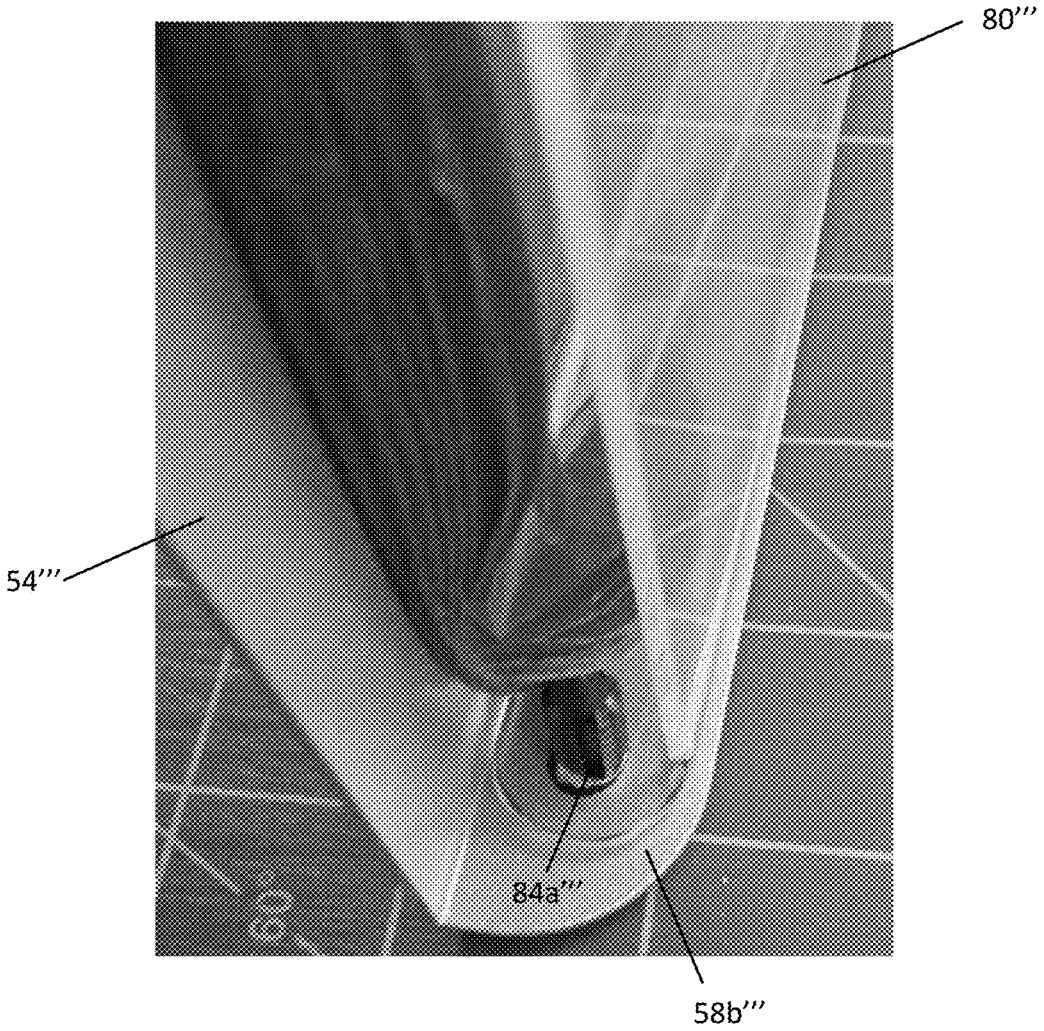
FIG. 81 is an enlarged perspective view of the wind guard attached to the dispenser shown in FIG. 78.

The same-hand dispenser 50''' may also include a wind guard 70''' adapted to retain the plurality of hand shields 40''' within the dispenser in a windy environment. For example, the presence of wind may create a low pressure area in front of the dispenser causing one or more hand shields to potentially be separated from the plurality of hand shields 40'''. One embodiment of the wind guard 70''' is shown in FIG. 73-77, enabling the hand shields 40''' to be retained within the dispenser 50''' while simultaneously retaining the ability to be dispensed with a single hand. As seen in FIG. 76, the wind guard 70''' includes ends 72''' that are inserted into the side walls 58''', and come around through slots 74'''. FIG. 77 illustrates the wind guard 70''' component, comprising of a pair of vertical members 76''' and a horizontal member 78'''. The vertical members 76''' may be substantially parallel with one another. The horizontal member 78''' is adapted to retain the plurality of hand shields 40''' within the dispenser, while simultaneously enabling a user to don and dispense a hand shield using a single hand.

FIGS. 78-81 illustrate another embodiment of a wind guard comprising a cover 80''' adapted to protect the plurality of hand shields 40''' from weather elements including precipitation. The cover 80''' may be comprised of a plastic, and further includes an opening 82''' for a user to retrieve a hand shield. The opening 82''' may be lined with a sheath 86''' or other coating to prevent the user from scratching his/her hand while retrieving a hand shield. The cover 80''' may be installed onto the dispenser 50''' by inserting a pair of posts 84''' into each side wall 54''', so that the cover 80''' may pivot between an open position and a closed position. The open position may be useful for restocking hand shields.

Figure 82:
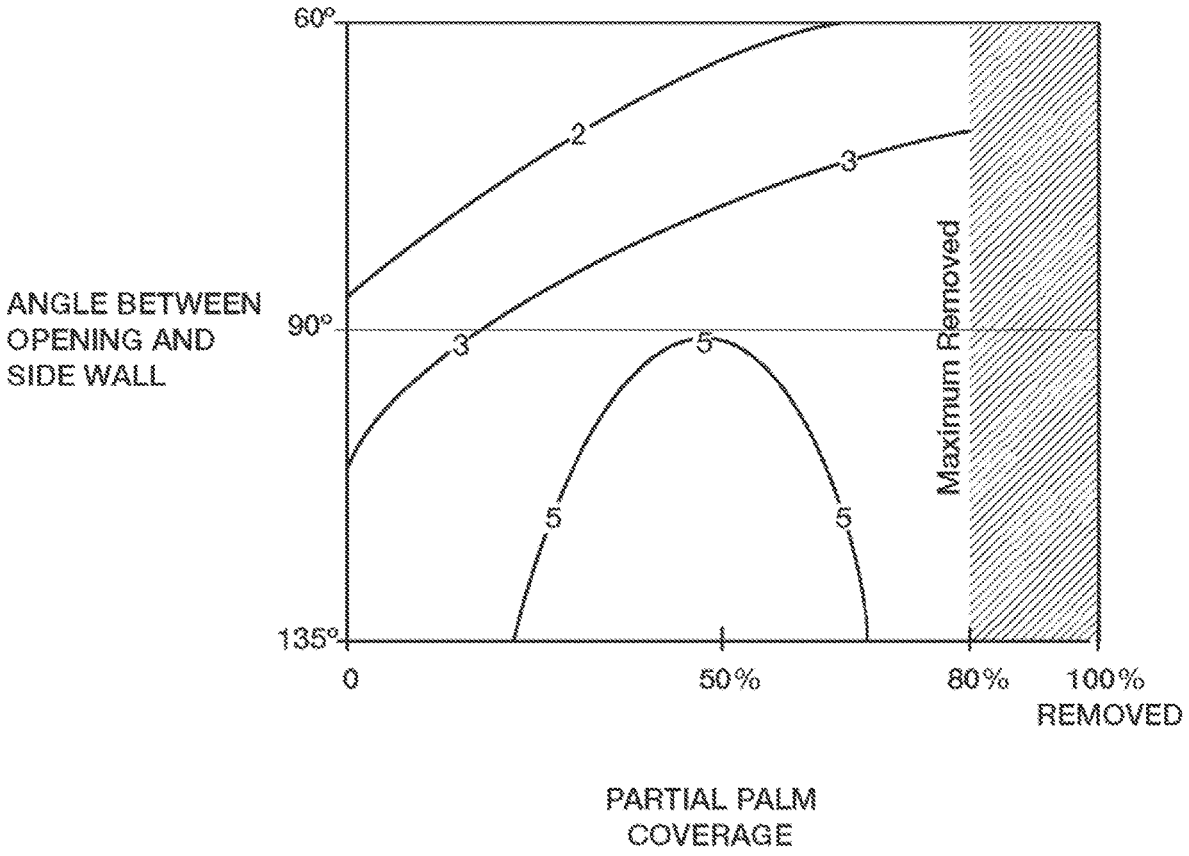
FIG. 82 is a surface plot illustrating the relationship between the angle formed from the opening and sides of a same-hand, hand shield and the partial palm portion.

Turning to FIG. 82, a graphical representation of a response surface shows the relationship between the amount of the partial palm portion 16 removed and the angle formed by opening 12 and sides 14' and 14". The response surface provides a visual illustration of the effects of both the opening of the hand shield and the overall length of the hand shield via a two-dimensional surface plot of a three-dimensional surface. Accordingly, the expected characteristics of various hand shields were plotted and zones on the response surface were ranked from 1 to 5 with 1 being the poorest performing hand shields and 5 being the best performing hand shields in terms of ease of donning and removal. The boundary conditions in FIG. 82 are denoted with solid lines, and indicate the preferred angles and partial palm coverage for use in the present inventions.

As can be seen, hand shields having an opening angle (defined between the opening and side walls) of 90° or more were better performing, while hand shields having an opening angle less than 90° were less desirable since the hand shields became more difficult to don with the same hand. Similarly, hand shields having the partial palm 40% to 70% removed provided the best performance for ease of removal with the same hand while still providing a sufficient level of protection. Hand shields fully covering the partial palm and having an opening angle less than 90° were difficult to don and remove unless a second hand is used for assistance. A barrier shaded in gray is indicated for hand shields having a partial palm portion≥80% removed since those hand shields cannot be properly donned.

Figure 83:
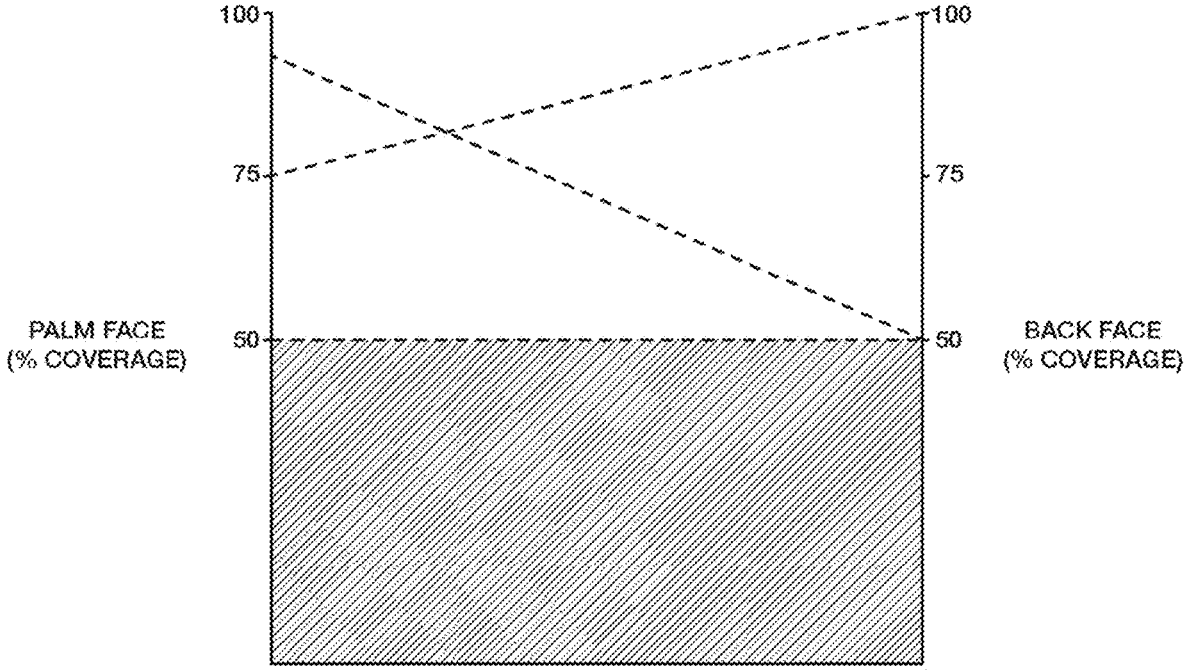
FIG. 83 is a surface plot depicting the relationship between the palm flap and the back flap for various embodiments.

In a preferred embodiment, the angle between opening 12 and sides 14',14" is between about 90 degrees and about 140 degrees and the partial palm portion 16 is between about 0 percent and about 80 percent removed to provide ease of operation for same-hand donning and same-hand removal. In some embodiments, sides 14' and 14" are substantially parallel such that the angle is 90 degrees. In other embodiments, partial palm portion 16 may be between about 40 percent and about 70 percent removed. Turning to FIG. 83, a representative diagram compares the scope of coverage between the palm flap 20 and back flap 22 of the partial palm portion 16. In some preferred embodiments, the palm flap 20 is between about 50 percent and about 90 percent and the back flap 22 is between about 75 percent and about 100 percent. In some preferred embodiments wherein a barrier is provided to shield a user's hand while using a hand-held implement, back flap 22 extends past the proximate edge of palm flap 20 (for example, as seen in the embodiment in FIGS. 29-42). In one embodiment, the palm flap 20 is about 50 percent and the back flap 22 is about 75 percent. In another embodiment, the back flap's proximate edge is co-extensive with the proximate edge of palm flap 20 to provide an ambidextrous hand shield. A barrier shaded in gray is indicated for hand shields having either the palm flap or back flap≥50% removed since those hand shields cannot be properly donned.

Generally, gloves are produced in three size classifications, such as women's, men's, and cadet. Additionally, gloves within each size classification are usually produced in further size classifications, such as small, medium, large, extra-large, etc. Thus, the ranges provided in FIGS. 82 and 83 are for a given hand size, and may vary in other embodiments depending on the size of the hand shield and desired fit.

Certain modifications and improvements will occur to those skilled in the art upon a reading of the foregoing description. By way of example, the same-hand, hand shields described herein may be provided to customers or employees as a courtesy by goods and service providers, or may be carried by individuals. Also, although the hand shields disclosed herein require only one hand for operation, it is understood that both hands may be used for donning and removal if a user desires. It should be understood that all such modifications and improvements have been deleted herein for the sake of conciseness and readability but are properly within the scope of the following claims.

I claim:

1. A same-hand, hand shield formed of a flexible material consisting of:

(a) an opening adapted for receiving at least a portion of a user's hand, said opening having a width, said opening width configured to be greater than a width of a palm and thumb portion of the user's hand;

(b) first and second side wall adapted for same-hand removal, said first and second side wall having a width between one another, said first and second side wall width being configured to be greater than the width of the palm and thumb portion of the user's hand;

(c) wherein said first and second side walls being aligned one with another in a parallel manner, and a defined thumb portion separated from a defined first digit portion and the defined first digit portion separated from a defined second digit portion, said first digit portion including two first digit sides and said second digit portion including two second digit sides, wherein the first digit sides and the second digit sides are all formed parallel with one another along the length of all the sides;

(d) a partial palm portion adapted for same-hand donning, said partial palm portion of said hand shield including (i) a palm flap adapted to cover a portion of a palm face of the user's hand while also leaving a portion of a palm face of the user's hand uncovered and (ii) a back flap adapted to cover a back face of the user's hand, said palm flap having a length measured from an end of the first digit portion to a terminating end of the palm flap at the opening, said back flap having a length measured from the end of the first digit portion to a terminating end of the back flap at the opening, and said back flap length being greater than said palm flap length, wherein the lower peripheral edge of said palm flap being parallel but not coextensive with the lower peripheral edge of said back flap, wherein the palm flap length is between 50 percent up to 90 percent and the back flap length is longer than the palm flap length, (iii) an opening angle defined between the opening and a first side wall and also between the opening and a second side wall, along each hand shield side, the opening angle being 90 degrees, and whereby said hand shield may be donned and removed with the user's hand without requiring an opposing hand.

2. The same-hand, hand shield according to claim 1, wherein said second digit portion comprises two digits.

3. The same-hand, hand shield according to claim 1, wherein said hand shield including said partial palm portion is comprised of two pieces, one piece including said palm flap adapted to cover a palm face of the user's hand and the other piece including said back flap adapted to cover a back face of the user's hand.

4. The same-hand, hand shield according to claim 3, wherein said two pieces are joined together to form said hand shield.

5. The same-hand, hand shield according to claim 4, wherein said two pieces are thermally joined together to form said hand shield.

6. The same-hand, hand shield according to claim 1, wherein the first digit portion sides and the second digit portion sides and also formed parallel with the first side wall and the second side wall and a second.

7. The same-hand, hand shield according to claim 1, wherein said palm flap is adapted to provide between about 50 percent and about 90 percent partial palm coverage and said back flap is adapted to provide between about 75 percent and about 100 percent partial palm coverage to provide a barrier when a hand-held implement is held by a user.

8. The same-hand, hand shield according to claim 7, wherein said back flap extends past said palm flap.

9. The same-hand, hand shield according to claim 8, wherein said palm flap is adapted to provide about 50 percent partial palm coverage and said back flap is adapted to provide about 75 percent partial palm coverage.

* * * * *